US008970460B2

(12) United States Patent
Yaguma et al.

(10) Patent No.: US 8,970,460 B2
(45) Date of Patent: Mar. 3, 2015

(54) LIQUID CRYSTAL DRIVING APPARATUS

(75) Inventors: Hiroshi Yaguma, Kyoto (JP); Motoya Kumagai, Kyoto (JP); Takashi Nagai, Kyoto (JP); Sukenori Itou, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 910 days.

(21) Appl. No.: 12/999,864

(22) PCT Filed: Mar. 31, 2010

(86) PCT No.: PCT/JP2010/055827

§ 371 (c)(1),
(2), (4) Date: Dec. 17, 2010

(87) PCT Pub. No.: WO2010/114014

PCT Pub. Date: Oct. 7, 2010

(65) Prior Publication Data

US 2011/0141098 A1 Jun. 16, 2011

(30) Foreign Application Priority Data

Apr. 1, 2009 (JP) ..... 2009-089244
Apr. 3, 2009 (JP) ..... 2009-091343
Dec. 25, 2009 (JP) ..... 2009-294334

(51) Int. Cl.
*G09G 3/36* (2006.01)

(52) U.S. Cl.
CPC ..... *G09G 3/3696* (2013.01); *G09G 3/3688* (2013.01); *G09G 2310/0291* (2013.01); *G09G 2310/0297* (2013.01); *G09G 2310/08* (2013.01); *G09G 2330/021* (2013.01); *G09G 2330/025* (2013.01); *G09G 2330/026* (2013.01); *G09G 2330/04* (2013.01)
USPC ..... 345/87

(58) Field of Classification Search
CPC ..... G09G 3/2011; G09G 3/2696
USPC ..... 345/87
See application file for complete search history.

(56) References Cited

U.S. PATENT DOCUMENTS

| | | | | |
|---|---|---|---|---|
| 5,451,891 | A | 9/1995 | Tanabe | |
| 7,298,855 | B2 * | 11/2007 | Tsuji et al. | 381/104 |
| 7,907,136 | B2 * | 3/2011 | Kobayashi | 345/208 |
| 2004/0263504 | A1 | 12/2004 | Kato | |
| 2006/0062406 | A1 | 3/2006 | Kinoshita | |
| 2006/0132998 | A1 | 6/2006 | Agari | |
| 2007/0018711 | A1 | 1/2007 | Miki et al. | |
| 2007/0040855 | A1 | 2/2007 | Kato | |

(Continued)

FOREIGN PATENT DOCUMENTS

| | | | |
|---|---|---|---|
| CN | 1770926 | A | 5/2006 |
| CN | 1909758 | A | 2/2007 |

(Continued)

*Primary Examiner* — Waseem Moorad
(74) *Attorney, Agent, or Firm* — Fish & Richardson P.C.

(57) ABSTRACT

A voltage amplifier circuit (300) comprises: an input voltage generating unit (302) that generates an input voltage (VL1) based on a set value (SL); an operational amplifier (303) that amplifies the input voltage (VL1) such that the input voltage (VL1) becomes equal to a feedback voltage (VL3), thereby generating an output voltage (VL2); a feedback resistor unit (304) that performs a voltage division between the output voltage (VL2) applied to one end of the feedback resistor unit and a reference voltage (VL4) applied to the other end of the feedback resistor unit, thereby generating the feedback voltage (VL3); a selector control unit (305) that generates a selector control signal (SS) based on the set value (SL); and a selector (306) that selects, based on the selector control signal SS, the reference voltage (VL4) from a plurality of candidates (GND/VR).

19 Claims, 40 Drawing Sheets

(56) References Cited

U.S. PATENT DOCUMENTS

| | | | |
|---|---|---|---|
| 2007/0171169 | A1 | 7/2007 | Hirama |
| 2008/0043008 | A1 | 2/2008 | Wang |
| 2008/0100603 | A1 | 5/2008 | Matsuda et al. |
| 2009/0140779 | A1 | 6/2009 | Maruo |

FOREIGN PATENT DOCUMENTS

| | | | |
|---|---|---|---|
| CN | 101315753 | A | 12/2008 |
| JP | 08-179270 | | 7/1996 |
| JP | 2005-017536 | | 1/2005 |
| JP | 2006-163814 | | 6/2006 |
| JP | 2006-309272 | | 11/2006 |
| JP | 2007-34506 | | 2/2007 |
| JP | 2007-52103 | | 3/2007 |
| JP | 2007-199203 | | 8/2007 |
| JP | 2008-116556 | | 5/2008 |
| JP | 2008-299129 | | 12/2008 |
| JP | 2009-58694 | | 3/2009 |
| WO | 2006/075768 | | 1/2006 |

* cited by examiner

FIG. 33

| | d13H | d14H | d15H | d16H | d13L | d14L | d15L | d16L |
|---|---|---|---|---|---|---|---|---|
| (1) VCOMH OUTPUT | ON | ON | ON | OFF | ON | OFF | ON | OFF |
| (2) VCOMH HOLD | OFF | ON | OFF | ON | OFF | OFF | OFF | ON |
| (3) VCOML OUTPUT | ON | OFF | ON | OFF | ON | ON | ON | OFF |
| (4) VCOML HOLD | OFF | OFF | OFF | ON | OFF | ON | OFF | ON |
| (5) SHUTDOWN | OFF | ON | ON | ON | OFF | ON | ON | ON |

LIQUID CRYSTAL DRIVING APPARATUS

TECHNICAL FIELD

All of a plurality of technical features disclosed in the present specification relate to various fundamental technologies that are able to be built in a liquid crystal drive apparatus (liquid crystal driver IC).

BACKGROUND ART

First Background Art

FIG. 8 is a block diagram showing a conventional example of a voltage amplification circuit. As shown in FIG. 8, the voltage amplification circuit in the present conventional example includes: an input voltage generation portion a100 that generates an input voltage VIN based on a set value S; an operational amplifier a200 that amplifies the input voltage VIN to generate an output voltage VOUT in such a way that the input voltage VIN and a feedback voltage VFB match each other; and a feedback resistor portion a300 that divides a voltage between the output voltage VOUT applied to one terminal thereof and a ground voltage GND applied to the other terminal thereof to generate the feedback voltage VFB.

In the voltage amplification circuit having the above structure, a feedback gain α set by the feedback resistor portion a300 is fixed, and the following formula (1) is satisfied between the input voltage VIN and the output voltage VOUT.

$$VOUT=\alpha\times VIN \quad (1)$$

Here, there is a patent document 1 as an example of the background art that relates to the above description.

Second Background Art

FIG. 14 is a schematic diagram showing a conventional example of a liquid crystal display apparatus. The liquid crystal display apparatus in the present conventional example includes: a liquid crystal drive apparatus b100; and a TFT (Thin Film Transistor)-type liquid crystal display panel b200.

The liquid crystal drive apparatus b100 is a semiconductor apparatus that in diving the liquid crystal display panel b200, performs polarity inversion control of an output signal O (k) (where k=1, 2, . . . , x, hereinafter, the same) that is applied to x-column liquid crystal elements, and integrates: digital/analog converters E1 (*k*) and F1 (*k*); source amplifiers E2 (*k*) and F2 (*k*); P-channel type MOS [Metal Oxide Semiconductor] field effect transistors E3 (*k*) and F4 (*k*); N-channel type MOS field effect transistors E4 (*k*) and F3 (*k*); and electrostatic discharge protection diodes E5 (*k*) and F5 (*k*).

FIG. 15 is a timing chart showing a conventional example of the polarity inversion control by the liquid crystal drive apparatus b100; and in order from the top of the paper surface, represents: a voltage level of the output signal O (k); a selected state of RGB; a polarity state (positive polarity (POS) frame or negative (NEG) frame of the output signal O (k)); a gate voltage of the transistor E3 (*k*); a gate voltage of the transistor E4 (*k*); a gate voltage of the transistor F3 (*k*); and a gate voltage of the transistor F4 (*k*).

As shown in FIG. 15, in the positive polarity frame (times t21 to t22), the transistor E3 (*k*) is turned on and the transistor F3 (*k*) is turned off. In other words, as the output signal O (k), a positive-polarity analog signal generated by the source amplifier E2 (*k*) is selected. On the other hand, in the negative polarity frame (times t22 to t23), the transistor E3 (*k*) is turned off and the transistor F3 (*k*) is turned on. In other words, as the output signal O (k), a negative-polarity analog signal generated by the source amplifier F2 (*k*) is selected.

According to such a structure that performs the polarity inversion control of the output signal O (k), because a unidirectional voltage is not continued to be applied to a liquid crystal element, it becomes possible to curb deterioration of the liquid crystal element.

Besides, at timing (time t22) the output signal O (k) is inversed from the positive polarity to the negative polarity, the transistor E3 (*k*) is turned off; thereafter, the transistor F3 (*k*) is turned on; and the transistor F4 (*k*) is kept in an on state for a predetermined on period Ton, while at timing (times t21, t23) the output signal O (k) is inversed from the negative polarity to the positive polarity, the transistor F3 (*k*) is turned off; thereafter, the transistor E3 (*k*) is turned on; and the transistor E4 (*k*) is kept in an on state for the predetermined on period Ton, As described above, in the polarity inversion of the output signal O (k), according to a structure in which the output signal O (k) is once set at a ground voltage GND, it becomes possible to lower a potential difference that occurs at a time of the polarity inversion of the output signal O (k), and reduce a drive current for the liquid crystal element.

Here, in FIG. 15, the on periods Ton of the transistor E4 (*k*) and F4 (*k*) are all represented exaggeratedly long; however, in actual setting, for example, it is sufficient if the on period Ton is set at a period that the output signal O (k) takes to change from a positive power-supply voltage VDD or from a negative power-supply voltage VEE to the ground voltage GND, so that the on periods Ton of the transistors E4 (*k*) and F4 (*k*) become sufficiently short compared with one frame period.

There is a patent document 2 as an example of the background art that relates to the above description.

Third Background Art

FIG. 27 is a circuit block diagram showing a conventional example of a power-supply circuit. A power-supply circuit c100 in the present conventional example is a voltage step-down type switching regulator that includes: a drive control portion c101; an AND calculator c102; an output transistor c103; an inductor c104; a diode c105; and a capacitor c106; and turns on/off the output transistor c103 by means of output feedback control of the drive control portion c101, thereby generating a desired output voltage Vout from an input voltage Vin.

Here, the power-supply circuit c100 in the present conventional example has a function to forcibly bring the output transistor c103 to an off state in accordance with an external reset signal R0 that is externally input. More specifically, in the power-supply circuit c100 in the present conventional example, when the external reset signal R0 is brought to a low level (reset logic), a gate signal of the output transistor c103 is fixed at the low level irrespective of the output signal from the drive control portion c101 and the output transistor c103 is forcibly brought to an off state.

Here, there is a patent document 3 as an example of the background art that relates to the above description.

Fourth Background Art

In recent years, in the field of a small-size liquid crystal display apparatus that is used for a mobile phone, a digital camera, a PDA (Personal Digital/Data Assistant), a mobile game machine, car navigation, and car audio and the like, to achieve long life of a battery, low power consumption of a liquid crystal drive apparatus (liquid crystal driver IC) is strongly demanded.

Fifth Background Art

FIG. 36A and FIG. 36B are circuit diagrams that show a first conventional example and a second conventional example of a common voltage generation circuit included in a liquid crystal drive apparatus, respectively. In driving a liquid crystal display panel, so as to allow an arbitrary changeover between a structure (so-called AC drive type) which performs polarity inversion of a common voltage VCOM that is applied in common to all liquid crystal elements which form the liquid crystal display panel and a structure (so-called DC drive type) which keeps the common voltage VCOM at a fixed value, each of common voltage generation circuits e100 in both figures includes: a P-channel type MOS (Metal Oxide Semiconductor) field effect transistor e101; an N-channel type MOS field effect transistors e102, e103; and a control portion e104.

The transistor e101 is connected between an output terminal of the common voltage VCOM and an application terminal of a first voltage VCOMAC_H (high-level voltage of the common voltage VCOM in an AC-drive time); and is turned on/off in accordance with a control signal from the control portion e104.

The transistor e102 is connected between the output terminal of the common voltage VCOM and an application terminal of a second voltage VCOMAC_L (low-level voltage of the common voltage VCOM in an AC-drive time); and is turned on/off in accordance with a control signal from the control portion e104.

The transistor e103 is connected between the output terminal of the common voltage VCOM and an application terminal of a third voltage VCOMDC (common voltage VCOM in a DC-drive time); and is turned on/off in accordance with a control signal from the control portion e104.

Here, in the conventional liquid crystal drive apparatus e100, back gates of the transistors e102 and e103 are all fixedly connected to the application terminal of the second voltage VCOMAC_L or to the application terminal of the third voltage VCOMDC (see FIG. 36A and FIG. 36B).

Sixth Background Art

FIG. 39 is a circuit block diagram showing a conventional example of a common voltage generation circuit that generates the common voltage VCOM which is applied in common to all liquid crystal elements that form a liquid crystal display panel. A common voltage generation circuit f100 in the present conventional example has a structure (so-called AC drive type) in which in driving the liquid crystal display panel, so as to perform polarity inversion control of the common voltage VCOM, the voltage level of the common voltage VCOM is pulse-driven between a first voltage VCOMH and a second voltage VCOML (where VCOMH>VCOML) (see FIG. 40 for behavior of the common voltage VCOM).

BACKGROUND ART DOCUMENTS

Patent Documents

[Patent document 1]: JP-A-2007-34506
[Patent document 2]: International Publication No.: 2006/075768 Pamphlet
[Patent document 3]: JP-A-2006-163814

SUMMARY OF THE INVENTION

Problems to be Solved by the Invention

First Problem

To generate a higher output voltage VOUT in the voltage amplification circuit (see the above FIG. 8) as a conventional example in which the feedback gain α is fixed, a higher input voltage VIN is inevitably necessary. However, in a case where it is impossible to generate the input voltage Vin which exceeds a power-supply voltage VR in the input voltage generation portion a100, an upper limit value of the output voltage VOUT is limited to the power-supply voltage VR.

On the other hand, if the feedback gain α is set high, it is possible to generate a high output voltage VOUT with the input voltage Vin kept low. However, if the feedback gain α is set high, the input voltage VIN must be extremely pulled down in a case where it is necessary to generate a low output voltage VOUT (near the ground voltage GND), so that the operation becomes unstable in the presence of noise and fluctuation in the ground voltage GND.

Here, as a solving means of the first problem, it is possible to employ a structure which performs variable control of the feedback gain α in accordance with the set value S. However, such a structure is likely to bring increase in the number of components and complication of the control.

In light of the first problem found by the inventors of the present application, it is an object of a first technical feature disclosed in the present specification to provide a voltage amplification circuit that is able to stably generate an output voltage, which has a desired variable region, from an input voltage whose variable region is limited; a gradation voltage generation circuit and a pixel drive apparatus that use the voltage amplification circuit.

Second Problem

In the liquid crystal drive apparatus b100 in a conventional example shown in the above FIG. 14, the electrostatic discharge protection diodes E5 (*k*) and F5 (*k*) are disposed for all of the external terminals T (k) that output the output signal O (k), which brings size increase (increase in the chip area) of the liquid crystal drive apparatus b100.

Besides, in the liquid crystal drive apparatus b100 in the above conventional example, the transistors E4 (*k*) and F4 (*k*) for charge share (for GND short) are disposed on the external terminal side of the transistors E3 (*k*) and F3 (*k*) used for the polarity inversion. Accordingly, not only in the transistors E3 (*k*) and F3 (*k*) but also in the transistors E4 (*k*) and F4 (*k*), because a very large potential difference (up to VDD−VEE) is applied across the gate and the source, a high breakdown-voltage element (e.g., 20 V breakdown-voltage element) that has a large element size must be used, which brings size increase (increase in the chip area) of the liquid crystal drive apparatus b100.

In light of the second problem found by the inventors of the present application, it is an object of a second technical feature disclosed in the present specification to provide a liquid crystal drive apparatus that is able to achieve size reduction of the apparatus; and a liquid crystal display apparatus that uses the liquid crystal drive apparatus.

Third Problem

According to the power-supply circuit c100 in a conventional example shown in the above FIG. 27, by bringing the external reset signal R0 to a low level at a turning-on time of the power supply, it is possible to fix the gate signal of the output transistor c103 at the low level even if the output signal from the drive control portion c101 is in an indeterminate logic state, so that it is possible to forcibly bring the transistor c103 to an off state and to nip occurrence of an unintentional overcurrent in the bud.

However, in the power-supply circuit c100 in the conventional example, in a case where the external reset signal R0 is brought to a high level at the turning-on time of the power supply because of some trouble, the output signal from the drive control portion c101 that is in the indeterminate logic state is input as the gate signal of the output transistor c103. Accordingly, in a case where the output signal from the drive control portion c101 is at the high level, the output transistor c103 goes to an on state, so that an unintentional overcurrent is likely to occur.

In light of the third problem found by the inventors of the present application, it is an object of a third technical feature disclosed in the present specification to provide a power-supply circuit that is able to prevent an overcurrent in a turning-on time of a power supply; and a liquid crystal drive apparatus that uses the power-supply circuit.

Fourth Problem

In the conventional liquid crystal drive apparatus, during a time an image is output onto a liquid crystal display panel, all internal circuits are always kept in operation states; and for low power consumption, it is a focus of the technology development how to reduce the power consumption in an operation time of the liquid crystal drive apparatus.

Besides, the conventional liquid crystal drive apparatus has a structure in which in stopping the operation of the liquid crystal drive apparatus, the electric charges accumulated in an output capacitor are discharged in such a way that an unnecessary image does not remain on the liquid crystal display panel. Because of this, in the conventional liquid crystal drive apparatus, it is impossible to stop the operation of the liquid crystal drive apparatus with the output state of an image on the liquid crystal display panel kept.

In light of the fourth problem found by the inventors of the present application, it is an object of a fourth technical feature disclosed in the present specification to provide a liquid crystal drive apparatus that is able to achieve low power consumption by stopping operation of itself with an image output state kept.

Fifth Problem

In the common voltage generation circuit e100 shown in the above FIG. 36A and FIG. 36B, as described above, the back gates of the transistors e102 and e103 are all fixedly connected to the application terminal of the second voltage VCOMAC_L or to the application terminal of the third voltage VCOMDC. Accordingly, in the conventional common voltage generation circuit e100, because connection points of the back gates of the transistors e102 and e103 must be always kept at the lowest potential of the circuit system, a potential relationship between the second voltage VCOMAC_L and the third voltage VCOMDC is determined, and there is a problem that flexibility of the liquid crystal drive apparatus e100 is damaged.

Specifically, as shown in FIG. 36A, the first voltage VCOMAC_H, the second voltage VCOMAC_L, and the third voltage VCOMDC must be set in such a way that a potential relationship of VCOMAC_H>VCOMDC>VCOMAC_L is satisfied in a case where the back gates of the transistors e102 and e103 are all connected to the application terminal of the second voltage VCOMAC_L. Besides, the first voltage VCOMAC_H, the second voltage VCOMAC_L, and the third voltage VCOMDC must be set in such a way that a potential relationship of VCOMAC_H>VCOMAC_L>VCOMDC is satisfied in a case where the back gates of the transistors e102 and e103 are all connected to the application terminal of the third voltage VCOMDC.

Here, if the back gates of the transistors e102 and e103 are all connected to an application terminal of a fourth voltage VEE that is lower than the first voltage VCOMAC_H, the second voltage VCOMAC_L, and the third voltage VCOMDC, the above problem is solved; however, in a case where such a structure is employed, because the element breakdown voltages required for the transistors e102 and e103 become large, there is a problem that the chip size becomes large.

In light of the fifth problem found by the inventors of the present application, it is an object of a fifth technical feature disclosed in the present specification to provide a common voltage generation circuit that curbs increase in the chip size and has high flexibility; and a liquid crystal drive apparatus that uses the common voltage generation circuit.

Sixth Problem

In the common voltage generation circuit f100 shown in the above FIG. 39, in driving the liquid crystal element, charge and discharge of an element capacitor Clcd of the liquid crystal element are performed. However, in the common voltage generation circuit f100 having the above conventional structure, because all the electric charges are thrown out in the discharge time of the element capacitor Clcd, electric charges must be anew accumulated in the charge time of the element capacitor Clcd. Because of this, in the common voltage generation circuit f100 having the above conventional structure, the power consumption due to the charge and discharge of the element capacitor Clcd accounts for a large percentage of the total power consumption.

In light of the sixth problem found by the inventors of the present application, it is an object of a sixth technical feature disclosed in the present specification to provide a liquid crystal drive apparatus that is able to curb power consumption due to charge and discharge of an element capacitor.

Means for Solving the Problems

Means for Solving the First Problem

To solve the first problem, a voltage amplification circuit having the first technical feature is so structured (1-1 structure) as to include: an input-voltage generation portion that generates an input voltage based on a set value; an operational amplifier that amplifies the input voltage to generate an output voltage in such a way that the input voltage and a feedback voltage match each other; a feedback resistor portion which divides a voltage between the output voltage applied to one terminal of which and a reference voltage applied to the other terminal of which to generate the feedback voltage; a selector control portion that generates a selector control signal based on the set value; and a selector that based on the selector control signal, selects one from a plurality of candidates as the reference voltage.

Here, in the voltage amplification circuit having the 1-1 structure, a structure (1-2 structure) may be employed, in which the selector selects a first reference voltage when the set value is a predetermined value or larger, and selects a second reference voltage higher than the first reference voltage when the set value is smaller than the predetermined value; and the input-voltage generation portion generates the input voltage in such a way that across a whole variable region of the set value, the output voltage linearly changes with respect to the set value.

Besides, the voltage amplification circuit having the 1-1 structure or the 1-2 structure may be so structured (1-3 structure) as to include: a second selector that based on the selector control signal, selects one from a plurality of candidates as a trimming table to be supplied to the feedback resistor portion; wherein the feedback resistor portion finely adjusts a voltage-division ratio of itself based on the trimming table selected by the second selector.

Besides, the voltage amplification circuit having the 1-3 structure may be so structured (1-4 structure) as to include: a non-volatile memory that stores a plurality of trimming tables which are the selection candidates in the second selector; and a plurality of registers that respectively store the plurality of trimming tables which are read from the non-volatile memory at a startup time of the voltage amplification circuit.

Besides, in the voltage amplification circuit having the 1-3 structure or the 1-4 structure, a structure (1-5 structure) may be employed, in which the second selector selects a first trimming table when the set value is the predetermined value or larger, and selects a second trimming table when the set value is smaller than the predetermined value.

Besides, a degradation voltage generation circuit having the first technical feature is so structured (1-6 structure) as to include: a resistor ladder which divides a voltage between an upper-limit voltage applied to one terminal of which and a lower-limit voltage applied to the other terminal of which to generate a plurality of gradation voltages; and the voltage amplification circuit according to any one of the structures 1-1 to 1-5 that outputs the output voltage as the lower-limit voltage.

Besides, a pixel drive apparatus having the first technical feature is so structured (1-7 structure) as to include: a digital/analog converter that converts a digital pixel signal into an analog pixel signal and supplies it to a pixel; and the gradation voltage generation circuit including the 1-6 structure that supplies the plurality of gradation voltages to the digital/analog converter.

Means for Solving the Second Problem

To solve the second problem, a liquid crystal drive apparatus having the second technical feature is so structured (2-1 structure) as to integrate: a first amplifier that is driven between a reference voltage and a first power-supply voltage higher than the reference voltage; a second amplifier that is driven between the reference voltage and a second power-supply voltage lower than the reference voltage; a first switch that is connected between an output terminal of the first amplifier and a first external terminal; and a second switch that is connected between an output terminal of the second amplifier and the first external terminal; and to perform polarity inversion control of an output signal that is applied from the first external terminal to a liquid crystal element by turning on/off the first switch and the second switch in a complementary manner; the liquid crystal drive apparatus further integrates: a third switch that is connected between the output terminal of the first amplifier and an application terminal of the reference voltage; and a fourth switch that is connected between the output terminal of the second amplifier and the application terminal of the reference voltage; wherein when the first switch is changed from an on state to an off state, the third switch is kept in an on state for a predetermined period before the first switch is turned off; and when the second switch is changed from an on state to an off state, the fourth switch is kept in an on state for a predetermined period before the second switch is turned off.

Here, in the liquid crystal drive apparatus having the 2-1 structure, a structure (2-2 structure) may be employed, in which the first switch and the second switch are all field effect transistors; and a body diode parasitic between a source and a back gate of each of the first switch and the second switch is used as an electrostatic discharge protection diode for the first external terminal.

Besides, the liquid crystal drive apparatus having the 2-1 structure or the 2-2 structure may be so structured (2-3 structure) as to further integrate: a fifth switch that is connected between the output terminal of the first amplifier and a second external terminal; and a sixth switch that is connected between the output terminal of the second amplifier and the second external terminal; and to perform polarity inversion control of an output signal that is applied from the second external terminal to the liquid crystal element by means of polarity which is inverse to the output signal applied from the first external terminal to the liquid crystal element by, in a complementary manner, turning on/off the first switch and the fifth switch, and the second switch and the six switch.

Besides, in the liquid crystal drive apparatus having the 2-3 structure, a structure (2-4 structure) may be employed, in which the fifth switch and the sixth switch are all field effect transistors; and a body diode parasitic between a source and a back gate of each of the fifth switch and the sixth switch is used as an electrostatic discharge protection diode for the second external terminal.

Besides, in the liquid crystal drive apparatus having the 2-2 structure or the 2-4 structure, a structure (2-5 structure) may be employed, in which the field effect transistor includes: a drain region; a first region and a second region that are separately disposed on both sides of the drain region and all connected to the first external terminal.

Besides, in the liquid crystal drive apparatus having the 2-5 structure, a structure (2-6 structure) may be employed, in which the field effect transistor includes a contact region of a back gate that is so formed as to enclose the drain region, the first source region, and the second source region.

Besides, in the liquid crystal drive apparatus having the 2-6 structure, a structure (2-7 structure) may be employed, in which each of the drain region, the first source region, and the second source region is formed away from the contact region of the back gate by a distance of 2 to 4 μm.

Besides, a liquid crystal display apparatus having the second technical feature is so structured as to include: the liquid crystal drive apparatus having any one of the structures 2-1 to 2-7; and a liquid crystal display panel.

Means for Solving the Third Problem

To solve the third problem, a power-supply circuit having the third technical feature is so structured (3-1 structure) as to include: a feedback control circuit that generates a feedback control signal of an output transistor in such a way that a desired output voltage is generated from an input voltage; and a reset circuit that forcibly keeps the output transistor in an off state from at least a turning-on time of a power supply to a time a predetermined time elapses.

Besides, in the power-supply circuit having the 3-1 structure, a structure (3-2 structure) may be employed, in which the reset circuit includes a power on reset portion that generates a power on reset signal that has reset logic from at least the turning-on time of the power supply to the time the predetermined time elapses; wherein when the power on reset signal has the reset logic, on/off control of the output transistor in accordance with the feedback control signal is prohibited to forcibly bring the output transistor to an off state.

Besides, in the power-supply circuit having the 3-2 structure, a structure (3-3 structure) may be employed, in which the reset circuit includes an internal reset signal generation portion that has the reset logic when at least one of the power on reset signal and an external reset signal has the reset logic, and has reset release logic only when both of the power on reset signal and the external reset signal have the reset release logic; prohibits the on/off control of the output transistor in accordance with the feedback control signal to forcibly bring the output transistor to the off state when the internal reset signal has the reset logic; and permits the on/off control of the output transistor in accordance with the feedback control signal when the internal reset signal has the reset release logic.

Besides, in the power-supply circuit having the 3-2 structure or the 3-3 structure, a structure (3-4 structure) may be employed, in which the power on reset portion includes: a power-supply monitor portion that generates a power-supply monitor signal which indicates whether the predetermined time elapses from the turning-on time of the power supply; and a power on reset signal generation portion that keeps the power on reset signal in the reset logic in accordance with the power-supply monitor signal before the predetermined time elapses; and controls the reset release of the power on reset signal in accordance with an enable signal for controlling operation of the feedback control circuit after the predetermined time elapses.

Besides, in the power-supply circuit having the 3-4 structure, a structure (3-5 structure) may be employed, in which the power on reset signal generation portion includes: a latch portion that fetches the enable signal as a latch output signal at every pulse of a clock signal, and resets the latch output signal to disable logic in accordance with the power-supply monitor signal before the predetermined time elapses; and a logic gate that has the reset logic when at least one of the enable signal and the latch output signal has the disable logic, and has the reset release logic only when both of the enable signal and the latch output signal have enable logic.

Besides, in the power-supply circuit having the 3-5 structure, a structure (3-6 structure) may be employed, in which the latch portion includes a plurality of flip-flops that are connected to each other in a tandem manner.

Besides, in the power-supply circuit having the 3-5 structure or the 3-6 structure, a structure (3-7 structure) may be employed, in which the clock signal is continuously input into the latch portion during a time the power-supply circuit operates.

Besides, in the power-supply circuit having any one of the structures 3-1 to 3-7, a structure (3-8 structure) may be employed, in which the reset circuit is shared with a plurality of the feedback control circuits.

Besides, a liquid crystal drive apparatus having the third technical feature includes: the power-supply circuit having any one of the structures 3-1 to 3-8; and is so structured (3-9 structure) as to perform drive control of a liquid crystal display panel by means of an output voltage of the power-supply circuit.

Means for Solving the Fourth Problem

To solve the fourth problem, a liquid crystal drive apparatus having the fourth technical feature is so structured (4-1 structure) as to include: an amplifier that is kept in a startup state during a first period to generate an output voltage for the liquid crystal element, and kept in an output high-impedance state during a second period; and a capacitor that holds the output voltage that is generated during the first period.

Means for Solving the Fifth Problem

To solve the fifth problem, a common voltage generation circuit having the fifth technical feature is so structured (5-1 structure) as to include: a P-channel type field effect transistor that is connected between an application terminal of a first voltage and an output terminal of a common voltage; a first N-channel type field effect transistor that is connected between an application terminal of a second voltage lower than the first voltage and the output terminal of the common voltage; a second N-channel type field effect transistor that is connected between an application terminal of a third voltage lower than the first voltage and the output terminal of the common voltage; a selector that selects one of the application terminal of the second voltage and the application terminal of the third voltage as a connection point for respective back gates of the first and second N-channel type field effect transistors; and a back gate control portion that controls the switch in accordance with a potential relationship between the second voltage and the third voltage.

Means for Solving the Sixth Problem

To solve the sixth problem, a liquid crystal drive apparatus having the sixth technical feature is so structured (6-1 structure) as to include: a reserve capacitor that in discharging an element capacitor of a liquid crystal element, reserves part of electric charges accumulated in the element capacitor; wherein in charging the element capacitor of the liquid crystal element, part of the electric charges reserved in the reserve capacitor are reused to charge the element capacitor.

Advantages of the Invention

By putting separately each of the plurality of technical features disclosed in the present specification into practical use or by putting an arbitrary combination of them into practical use, it becomes possible to increase the product value of a liquid crystal drive apparatus (liquid crystal driver IC).

BRIEF DESCRIPTION OF DRAWINGS

FIG. 33 is a table for describing a generation operation of a common voltage VCOM.

BEST MODE FOR CARRYING OUT THE INVENTION (Whole Structure)

First, whole structures of a liquid crystal display apparatus and a liquid crystal drive apparatus (liquid crystal driver IC) to which the present invention (various technical features described later) is applied are described in detail with reference to drawings.

Figure 28:
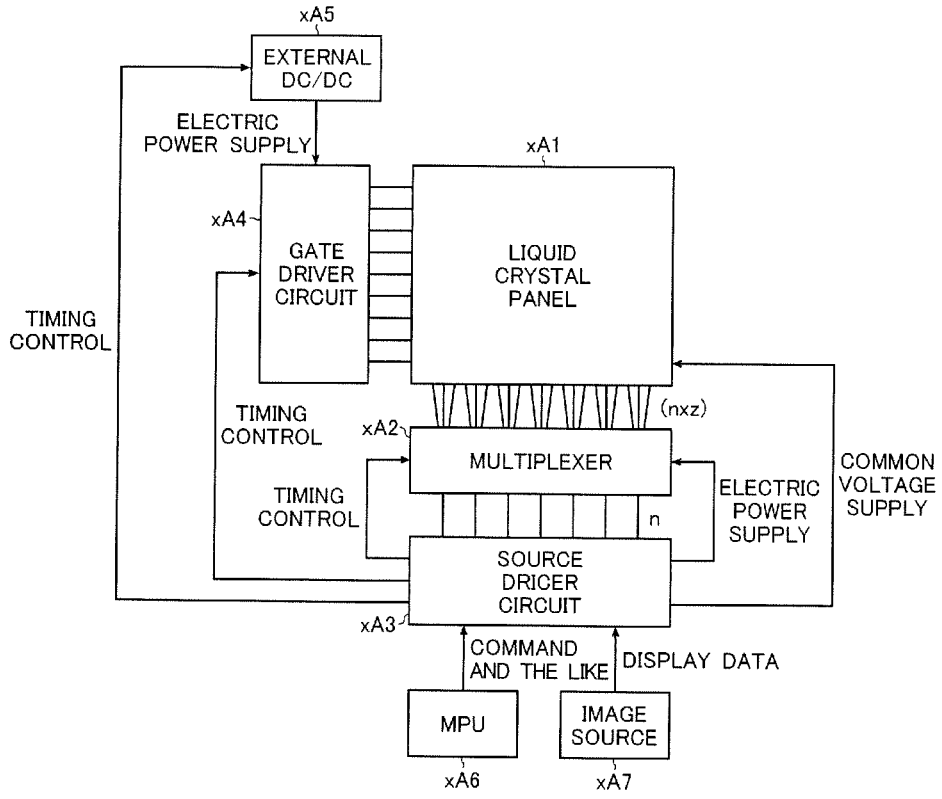
FIG. 28 is a block diagram showing a whole structure of a liquid crystal display apparatus to which the present invention is applied.

FIG. 28 is a block diagram showing a whole structure of a liquid crystal display apparatus to which the present invention is applied. As shown in FIG. 28, the liquid crystal display apparatus (and applications such as a mobile phone that incorporate this and the like) in the present structural example includes: a liquid crystal display panel xA1; a multiplexer xA2; a source driver circuit xA3; a gate driver circuit xA4; an external DC/DC converter xA5; an MPU (Micro Processing Unit) xA6; and an image source xA7.

The liquid crystal display panel xA1 is a TFT (Thin Film Transistor) type image output means that uses a liquid crystal element whose light transmission factor changes in accordance with a voltage value of display data (analog voltage signal) that is supplied from the source driver circuit xA3 via the multiplexer xA2.

The multiplexer xA2, based on a timing signal input from the source driver circuit xA3, distributes n-system display data output from the source driver circuit xA3 to z systems (z is an integer equal to 1 or larger), thereby generating (n×z)-system display data and supplying the data to the liquid crystal display panel xA1.

The source driver circuit xA3 converts digital display data input from the image source xA7 into analog display data (analog voltage signal); and supplies the analog display data to each pixel (precisely, a source terminal of an active element that is connected to each pixel of the source driver circuit xA1) of the liquid crystal display panel xA1 via the multiplexer xA2. Besides, the source driver circuit xA3 includes: a function to receive inputs such as a command and the like from the MPU xA6; a function to supply electric power to each portion (multiplexer xA2 and the like) of the liquid crystal display apparatus; a function to perform timing control of each portion (multiplexer xA2, gate driver circuit xA4, and external DC/DC converter xA5) of the liquid crystal display apparatus; and a function to supply a common voltage to the liquid crystal display panel xA1.

The gate driver circuit xA4 performs vertical scan control of the liquid crystal display panel xA1 based on a timing signal input from the source driver circuit xA3.

The external DC/DC converter xA5 generates a power-supply voltage necessary to drive the gate driver circuit xA4 based on a timing signal input from the source driver circuit xA3.

The MPU xA6 is a main portion that performs comprehensive control of the entire set that incorporates the liquid crystal display apparatus; and supplies various commands, a clock signal, and simple display data used in an 8-color display mode to the source driver circuit xA3.

The image source xA7 supplies display data and a clock signal that are used in a usual display mode to the source driver circuit xA3.

Figure 29:
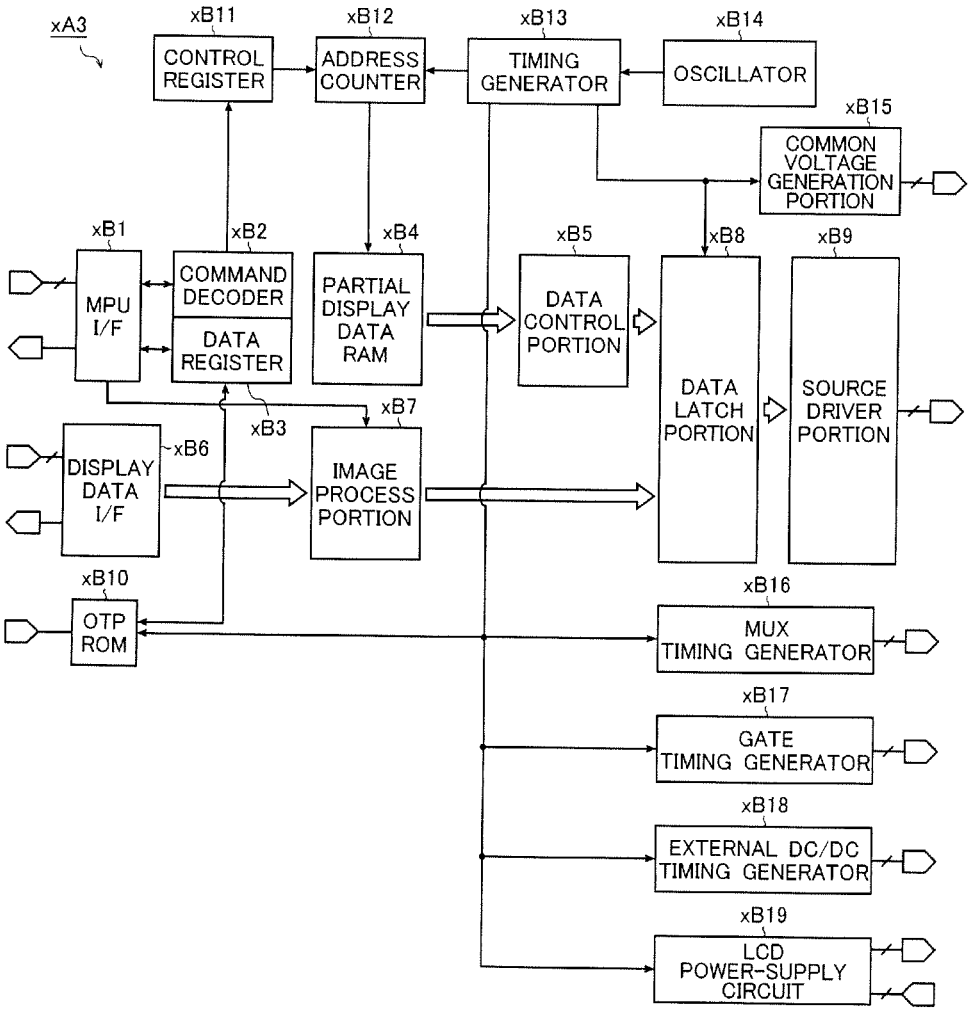
FIG. 29 is a block diagram showing a structural example of a source driver circuit xA3.

FIG. 29 is a block diagram showing a structural example of the source driver circuit xA3. The source driver circuit xA3 is a semiconductor apparatus (so-called source driver IC) that has: an MPU interface xB1; a command decoder xB2; a data register xB3; a partial display data RAM (Random Access Memory) xB4; a data control portion xB5; a display data interface xB6; an image process portion xB7; a data latch portion xB8; a source driver portion xB9; an OTPROM (One Time Programmable Read Only Memory) xB10; a control register xB11; an address counter (RAM controller) xB12; a timing generator xB13; an oscillator xB14; a common voltage generation portion xB15; a multiplexer timing generator xB16; a gate driver timing generator xB17; an external DC/DC timing generator xB18; and a power-supply circuit xB19 for the liquid crystal display apparatus.

The MPU interface xB1 performs transmission and reception of various commands, a clock signal, simple display data used in the 8-color display mode to and from the MPU xA6.

The command decoder xB2 applies a decode process to a command, simple display data and the like that are obtained via the MPU interface xB1.

The data register xB3 temporarily stores various set data that is obtained via the MPU interface xB1 and initial set data that is read from the OTPPOM xB10.

The partial display data RAM xB4 is used as a storage portion for simple display data.

The data control portion xB5 performs read control of the simple display data stored in the partial display data RAM xB4.

The display data interface xB6 performs transmission and reception of display data and a clock signal that are used in the usual display mode to and from the image source xA7.

The image process portion xB7 applies predetermined image processes (brightness dynamic range correction, color correction, various noise removal corrections and the like) to display data input via the display data interface xB6.

The data latch portion xB8 latches display data input via the image process portion xB7 or simple display data input via the data control portion xB5.

The source driver portion xB9 performs drive control of the liquid crystal display panel xA1 based on display data and simple display data that are input via the data latch portion xB8.

The OTPROM xB10 stores, in a non-volatile manner, the initial set data to be stored into the data register xB3. Here, it is possible to perform data writing into the OTPROM xB10 only one time.

The control register xB11 temporarily stores a command and simple display data that are obtained by the command decoder xB2.

The address counter xB12, based on a timing signal generated by the timing generator xB13, reads the simple display data that is temporarily stored in the control register xB11 and writes the simple display data into the partial display data RAM xB4.

The timing generator xB13, based on an internal clock signal input from the oscillator xB14, generates a timing signal necessary for synchronization control of the entire liquid crystal display apparatus; and supplies the timing signal to each portion (data latch portion xB8, address counter xB12, common voltage generation portion xB15, multiplexer timing generator xB16, gate driver timing generator xB17, external DC/DC timing generator xB18, and power-supply circuit xB19 for the liquid crystal display apparatus) of the source driver circuit xA3.

The oscillator xB14 generates an internal clock signal that has a predetermined frequency and supplies this to the timing generator xB13.

The common voltage generation portion xB15, based on a timing signal input from the timing generator xB13, generates a common voltage and supplies this to the liquid crystal display panel xA1.

The multiplexer timing generator xB16, based on a timing signal input from the timing generator xB13, generates a timing signal for a multiplexer and supplies this to the multiplexer xA2.

The gate driver timing generator xB17, based on a timing signal input from the timing generator xB13, generates timing signal for a gate driver and supplies this to the gate driver circuit xA4.

The external DC/DC timing xB18, based on a timing signal input from the timing generator xB13, generates a timing signal for an external DC/DC and supplies this to the external DC/DC converter xA5.

The power-supply circuit xB19 for the liquid crystal display apparatus, based on a timing signal input from the timing generator xB13, generates a power-supply voltage (e.g., positive power-supply voltage VSP and negative power-supply voltage) for the liquid crystal display apparatus and supplies this to each portion (multiplexer xA2, gate driver circuit xA4, source driver portion xB9 and the like) of the liquid crystal display apparatus. Here, it is possible to use a switching regulator and the like as the power-supply circuit xB19 for the liquid crystal display apparatus.

Figure 30:
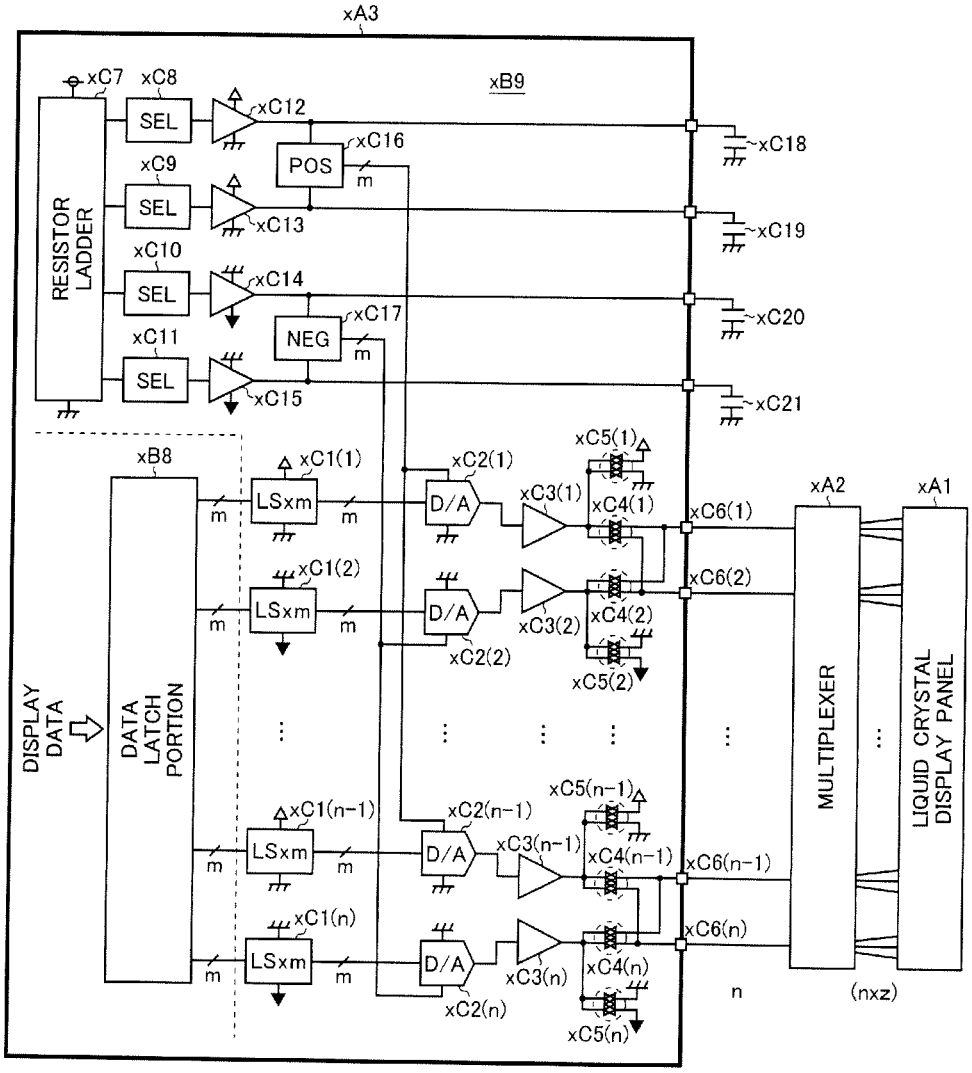
FIG. 30 is a block diagram showing a structural example of a source driver circuit xB9.

FIG. 30 is a block diagram showing a structural example of the source driver portion xB9. As shown in the figure, the source driver portion xB19 in the present structural example, in driving the liquid crystal display panel xA1, performs polarity inversion control of the output signal applied to the liquid crystal element; and has: level shifter circuits xC1 (1) to xC1 (*n*); digital/analog conversion circuits xC2 (1) to xC2 (*n*); source amplification circuits xC3 (1) to xC3 (*n*); path switches xC4 (1) to xC4 (*n*) for polarity inversion control; path switches xC5 (1) to xC5 (*n*) for the 8-color display mode; output terminals xC6 (1) to xC6 (*n*); a resistor ladder xC7; selectors xC8 to xC11; amplifiers xC12 to xC15; a first gradation voltage generation portion xC16; a second gradation voltage generation portion xC17; and output capacitors xC18 to xC21.

Each of the level shifter circuits xC1 (1) to xC1 (*n*) performs the level shifting of m-bit display data input from the data latch portion xB8 and transmits it to a post-stage. Specifically, an odd-number-line level shifter circuit xC1 (*i*) (i=1, 3, 5, . . . , (n−1), hereinafter, the same) is a positive-polarity level shifter circuit that converts an input signal into an output signal that is pulse-driven between a ground potential and a positive potential. On the other hand, an even-number-line level shifter circuit xC1 (*j*) (j=(1+1)=2, 4, 6, . . . , n, hereinafter, the same) is a negative-polarity level shifter circuit that converts an input signal into an output signal that is pulse-driven between the ground potential and a negative potential. Here, each of the level shifter circuits xC1 (1) to xC1 (*n*) includes m level shifter circuits which are connected in parallel and allow m-bit display data to be received in parallel.

Each of the digital/analog conversion circuits xC2 (1) to xC2 (*n*) converts m-bit display data input via the level shifter circuits xC1 (1) to xC1 (*n*) into an analog signal and outputs it.

Specifically, an odd-number-line digital/analog conversion circuit xC2 (*i*) is driven between a ground potential and a positive potential to convert digital display data into analog display data (positive-polarity voltage). Here, first gradation voltages (positive polarity) of $2^m$ gradations are input into the digital/analog conversion circuit xC2 (*i*) from the first gradation voltage generation portion xC16. In other words, the analog display data generated by the digital/analog conversion circuit xC2 (*i*) is one of the first gradation voltages (positive polarity) of $2^m$ gradations that is selected in accordance with the digital display data (m bits) that is input from the level shifter circuit xC1 (*i*).

On the other hand, an even-number-line digital/analog conversion circuit xC2 (*j*) is driven between the ground potential and a positive potential to convert digital display data into analog display data (negative-polarity voltage). Here, second gradation voltages (negative polarity) of $2^m$ gradations are input into the digital/analog conversion circuit xC2 (*j*) from the second gradation voltage generation portion xC17. In other words, the analog display data generated by the digital/analog conversion circuit xC2 (*j*) is one of the second gradation voltages (negative polarity) of $2^m$ gradations that is selected in accordance with the digital display data (m bits) that is input from the level shifter circuit xC1 (*j*).

The source amplification circuits xC3 (1) to xC3(*n*) amplify analog display data respectively generated by the digital/analog conversion circuits xC2 (1) to xC2 (*n*) and output them to a post-stage. Specifically, an odd-number-line source amplification circuit xC3 (*i*) is driven between a ground potential and a positive potential; increases an electric-current capability of the display data (positive-polarity signal) input from the digital/analog conversion circuit xC2 (*i*) and outputs it to a post-stage. On the other hand, an even-number-line source amplification circuit xC3 (*j*) is driven between the ground potential and a negative potential; increases an electric-current capability of the display data (negative-polarity signal) input from the digital/analog conversion circuit xC2 (*j*) and outputs it to a post-stage.

The path switches xC4 (1) to xC4 (*n*) for polarity inversion control change a connection relationship between source amplification circuits xC3 (*i*), xC3 (*j*) and output terminals xC6 (*i*), xC6 (*j*) in such a way that the output terminal xC6 (*i*) and the output terminal xC6 (*j*) adjacent to each other share a set of the positive-polarity circuit (xC1 (*i*) to xC3 (*i*)) and the negative-polarity circuit (xC1 (*j*) to xC3 (*j*)).

For example, in a first frame, to connect the source amplification circuit xC3 (*i*) and the output terminal xC6 (*i*) to each other and to connect the source amplifier xC3 (*j*) and the output terminal xC6 (*j*) to each other, on/off control of the path switches xC4 (1) to xC4 (*n*) for polarity inversion control is performed. According to such switching control, in the first frame, as the output signal that is output to the liquid crystal element from the odd-number-line output terminal xC6 (*i*), a positive-polarity analog signal generated by the odd-number-line source amplifier xC3 (*i*) is selected; as the output signal that is output to the liquid crystal element from the even-number-line output terminal xC6 (*j*), a negative-polarity analog signal generated by the even-number-line source amplifier xC3 (*j*) is selected.

Next, in a second frame that follows the first frame, to connect the source amplification circuit xC3 (*i*) and the output terminal xC6 (*j*) to each other and to connect the source amplifier xC3 (*j*) and the output terminal xC6 (*i*) to each other, the on/off control of the path switches xC4 (1) to xC4 (*n*) for polarity inversion control is performed. According to such switching control, in the second frame, as the output signal that is output to the liquid crystal element from the odd-number-line output terminal xC6 (*i*), a negative-polarity analog signal generated by the even-number-line source amplifier xC3 (*j*) is selected; as the output signal that is output to the liquid crystal element from the even-number-line output terminal xC6 (*j*), a positive-polarity analog signal generated by the odd-number-line source amplifier xC3 (*i*) is selected.

According to the structure that performs such polarity inversion, a unidirectional voltage is not continuously applied to the liquid crystal element, so that it becomes possible to curb deterioration of the liquid crystal element.

Besides, according to the structure that performs the above polarity control, it is possible to fix the common voltage (voltage applied to opposite electrodes of all the liquid crystal elements) of the liquid crystal display panel xA1 at the ground potential, so that charge and discharge of an opposite capacitor of the liquid crystal display panel xA1 become unnecessary and it is possible to achieve reduction in the power consumption.

Besides, according to the structure that performs the above polarity control, it is possible for the output terminal xC6 (*i*) and the output terminal xC6 (*j*) adjacent to each other to share a set of the positive-polarity circuit (xC1 (*i*) to xC3 (*i*)) and the negative-polarity circuit (xC1 (*j*) to xC3 (*j*)), so that it becomes possible to contribute to size reduction (chip-area reduction) of the source driver circuit xA3.

The path switches xC5 (1) to xC5 (*n*) for the 8-color display mode are, in a time of the 8-color display mode (operation mode in which an image is displayed based on simple display data input from the MPU xA6), used to output only a high-level/low-level binary voltage rather than a gradation voltage of the $2^m$ gradations. Specifically, an odd-number-line path switch xC5 (*i*) for the 8-color display mode has: a first path switch connected between the output terminal of the source amplifier xC3 (*i*) and an application terminal of a positive potential; and a second path switch connected between the output terminal of the source amplifier xC3 (*i*) and the application terminal of the ground potential; on/off control of the first and second path switches is exclusively (in a complementary manner) performed in such a way that either of the positive potential and the ground potential is output based on the simple display data. Besides, an even-number-line path switch xC5 (*j*) for the 8-color display mode has: a third path switch connected between the output terminal of the source amplifier xC3 (*j*) and an application terminal of a negative potential; and a fourth path switch connected between the output terminal of the source amplifier xC3 (*j*) and the application terminal of the ground potential; on/off control of the first and second path switches is exclusively (in a complementary manner) performed in such a way that either of the negative potential and the ground potential is output based on the simple display data. Here, in the time of the 8-color display mode, the electric-power supply to the level shifter circuits xC1 (1) to xC1 (*n*), the digital/analog conversion circuits xC2 (1) to xC2 (*n*), and the source amplification circuits xC3 (1) to xC3 (*n*) is interrupted, so that their respective operations are stopped. According to such structure, in the time of the 8-color display mode, it becomes possible to reduce unnecessary power consumption.

The output terminals xC6 (1) to xC6 (*n*) are external terminals used to supply n-system output signals from the source driver circuit xA3 to the multiplexer xA2.

The resistor ladder xC7 generates a plurality of divided voltages by dividing a predetermined reference voltage (Vref) by means of a resistor.

Each of the selectors xC8 to xC11 selects one voltage from the plurality of divided voltages generated by the resistor ladder xC7. Here, the divided voltage selected by the selector xC8 and the divided voltage selected by the selector xC9 have voltages different from each other. Besides, the divided voltage selected by the selector xC10 and the divided voltage selected by the selector xC11 also have voltages different from each other.

The amplifiers xC12 and xC13 are all driven between a ground potential and a positive potential; amplify the divided voltages input from the selectors xC8 and xC9 respectively to generate first and second positive-polarity amplified voltages. The amplifiers xC14 and xC15 are all driven between the ground potential and a negative potential; amplify the divided voltages input from the selectors xC10 and xC11 respectively to generate third and fourth negative-polarity amplified voltages.

The first gradation voltage generation portion xC16 generates the first gradation voltage (positive polarity) of the $2^m$ gradations that discretely changes between the first positive-polarity amplified voltage input from the amplifier xC12 and the second positive-polarity amplified voltage input from the amplifier xC13.

The second gradation voltage generation portion xC17 generates the second gradation voltage (negative polarity) of the $2^m$ gradations that discretely changes between the third negative-polarity amplified voltage input from the amplifier xC14 and the fourth negative-polarity amplified voltage input from the amplifier xC15.

The output capacitors xC18 to xC21 are connected to the output terminals of the amplifiers xC12 to xC15 respectively to smooth the first to fourth amplified voltages.

Figure 31:
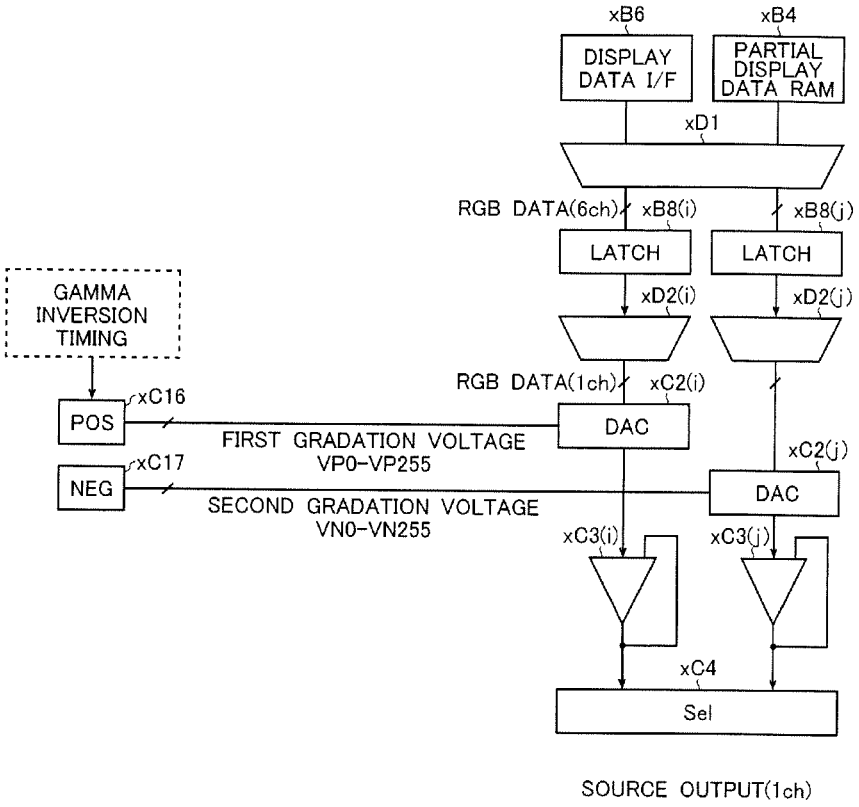
FIG. 31 is a block diagram showing a peripheral structure of the source driver circuit xB9.

FIG. 31 is a block diagram showing a peripheral structure of the source driver circuit xB9. The display data (6-channel RGB data) from the display data interface xB6 and from the partial display data RAM xB4 are suitably distributed to data latch portions xB8 (1) and xB8 (*j*) via a selector xD1. As for the 6-channel RGB data contained in each output from the data latch portions xB8 (*i*) and xB8 (*j*), only the RGB data on any one channel is selected and output to the digital/analog conversion circuits xC2 (*i*) and xC2 (*j*) via selectors xD2 (*i*) and xD2 (*j*), respectively.

First gradation voltages VP0 to VP255 (positive polarity) of 256 gradations are input into the digital/analog conversion circuit xC2 (*i*) from the first gradation voltage generation portion xC16; the digital/analog conversion circuit xC2 (*i*) converts the digital display data into the analog display data (positive-polarity voltage) and outputs it to the source amplification circuit xC3 (*i*). On the other hand, second gradation voltages VN0 to VN255 (negative polarity) of 256 ($=2^8$) gradations are input into the digital/analog conversion circuit xC2 (*j*) from the second gradation voltage generation portion xC17; the digital/analog conversion circuit xC2 (*j*) converts the digital display data into the analog display data (negative-polarity voltage) and outputs it to the source amplification circuit xC3 (*j*).

The source amplification circuit xC3 (*i*) increases the electric-current capability of the display data (positive-polarity data) input from the digital/analog conversion circuit xC2 (*i*) and outputs it to a first input terminal of the selector xC4 that is disposed in a post-stage. On the other hand, the source amplification circuit xC3 (*j*) increases the electric-current capability of the display data (negative-polarity data) input from the digital/analog conversion circuit xC2 (*j*) and outputs it to a second input terminal of the selector xC4 that is disposed in the post-stage. Here, an amplifier enable signal and a bias current are input into the source amplification circuits xC3 (*i*) and xC3 (*j*), respectively.

The selector xC4 suitably changes output points of the source amplification circuits xC3 (*i*) and xC3 (*j*) between output terminals (not shown in FIG. 31) adjacent to each other.

(First Technical Feature)

The first technical feature described hereinafter relates to a voltage amplification circuit that includes a regulator amplifier, a gradation voltage generation circuit and a pixel drive apparatus (liquid crystal drive apparatus) that use the voltage amplification circuit.

Here, with reference to the above figures, the first technical feature relates to the source driver circuit xA3 in FIG. 28; more specifically, the first technical feature relates to the source driver portion xB9 in FIG. 29, further, to the first gradation voltage generation portion xC16 and the second gradation voltage generation portion xC17 in FIG. 30, and their peripheral circuits.

Figure 1:
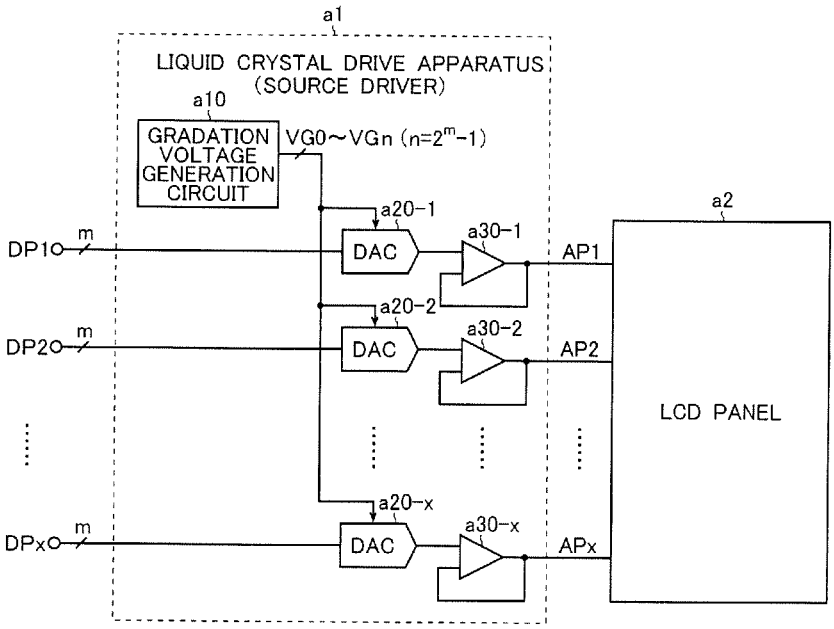
FIG. 1 is a block diagram showing an embodiment of a liquid crystal drive apparatus having a first technical feature.

FIG. 1 is a block diagram showing an embodiment of a liquid crystal drive apparatus having the first technical feature. A liquid crystal drive apparatus a1 in the present embodiment is a means that converts x-system digital pixel signals DP1 to DPx (m bits) input from a not-shown image source into analog pixel signals AP1 to APx, and supplies them to each pixel (to a source terminal of an active element connected to each pixel of a liquid crystal display panel a2 in a case where the liquid crystal display panel a2 is of an active matrix type) of the liquid crystal display panel a2; and has a gradation voltage generation circuit a10; x-system digital/analog converters a20-1 to a20-*x*; and x-system buffers a30-1 to a30-*x*.

The gradation voltage generation circuit a10 supplies n-system (where $n=2^m-1$) gradation voltages VG0 to VGn to the digital/analog converters a20-1 to a20-*x*. Here, an internal structure and operation of the gradation voltage generation circuit a10 are described later.

The digital/analog converters a20-1 to a20-*x* convert the digital pixel signals DP1 to DPx into the analog pixel signals AP1 to APx.

The buffers a30-1 to a30-*x* increase electric-current capabilities of the analog pixel signals AP1 to APx and supply them to the liquid crystal display panel a2.

The liquid crystal display panel a2 is an image output means that uses liquid crystal elements as pixels whose light transmission factors change in accordance with voltage values of the analog pixel signals AP1 to APx.

Figure 2:
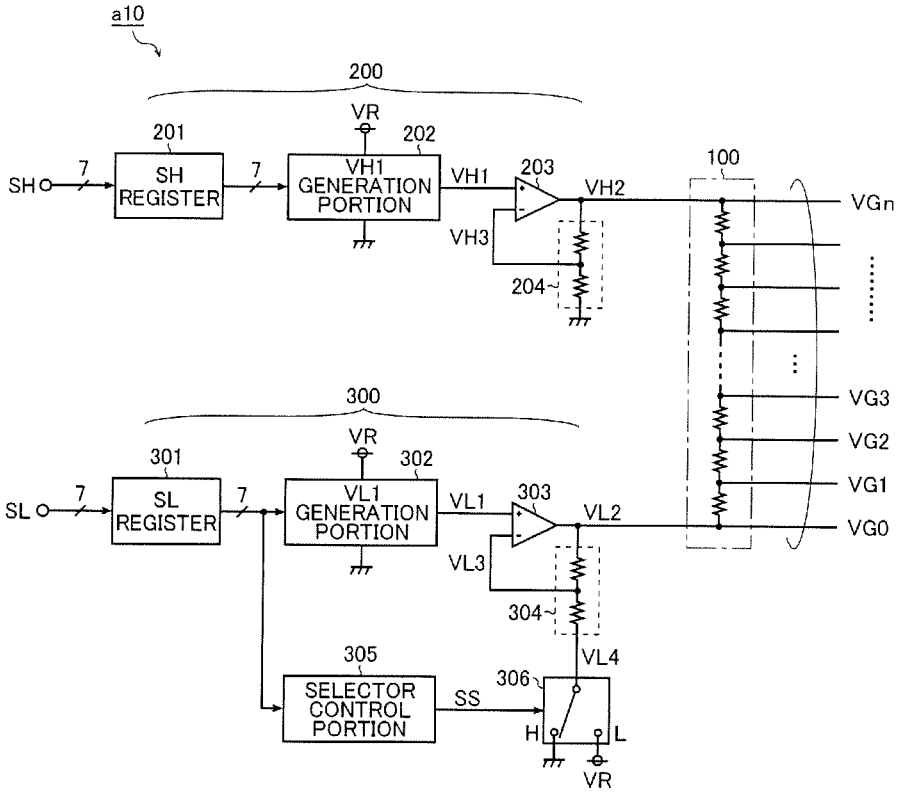
FIG. 2 is a block diagram showing a first structural example of a gradation voltage generation circuit a10.

FIG. 2 is a block diagram showing a first structural example of the gradation voltage generation circuit a10. The gradation voltage generation circuit a10 in the present structural example has: a resistor ladder 100; an upper-limit voltage set circuit 200; and a lower-limit voltage set circuit 300.

The resistor ladder 100 divides a voltage between an upper-limit voltage VH2 applied to one terminal of which and a lower-limit voltage VL2 applied to the other terminal of which to generate n-system gradation voltages VG0 to VGn. The gradation voltage generation circuit a10 in the present embodiment has a structure in which it is possible to arbitrarily adjust the upper-limit voltage VH2 and the lower-limit voltage VL2 based on an upper-limit voltage set value SH and a lower-limit voltage set value SL described later. According to such a structure, it becomes possible to perform optimization (gamma correction) of the gradation voltages VG0 to VGn in accordance with a gamma characteristic that is different for every liquid crystal display panel a2.

The upper-limit voltage set circuit 200 is a means that generates the upper-limit voltage VH2 (e.g., 4 to 6 V) based on the upper-limit voltage set value SH (e.g., 7 bits); and has:

an SH register 201; a VH1 generation portion 202; an operational amplifier 203; and a feedback resistor portion 204.

The SH register stores the upper-limit voltage set value SH input from outside of the circuit.

The VH1 generation portion 202 generates an input voltage VH1 (eg., 0.8 to 1.2 V) from a power-supply voltage VR (e.g., 1.5 V) based on the upper-limit voltage set value SH that is stored in the SH register 201.

The operational amplifier 203 amplifies the input voltage VH1 to generate an output voltage VH2 in such a way that the input voltage VH1 and a feedback voltage VH3 match each other; and applies this as the upper-limit voltage VH2 to one terminal of the resistor ladder 100.

The feedback resistor portion 204 divides a voltage between the output voltage VH2 applied to one terminal of which and the ground voltage GND applied to the other terminal of which to generate the feedback voltage VH3.

In the upper-limit voltage set circuit 200 having the above structure, the feedback gain α set by the feedback resistor portion 204 is fixed; and the following formula (2) is satisfied between the input voltage VH1 and the output voltage VH2.

$$VH2=\alpha\times VH1 \quad (2)$$

Figure 8:
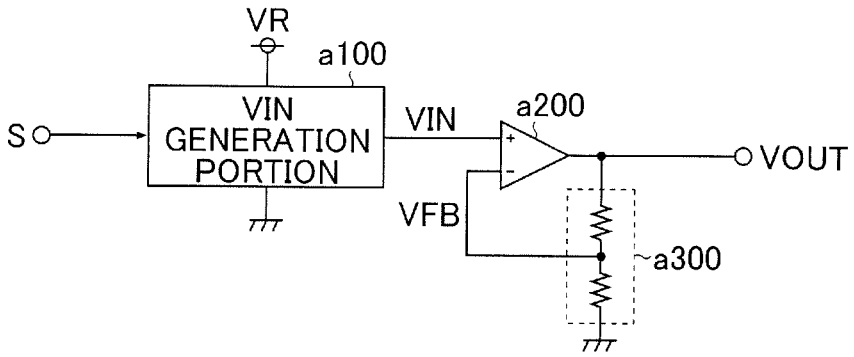
FIG. 8 is a block diagram showing a conventional example of a voltage amplification circuit.

As described above, in the gradation voltage generation circuit a10 in the present structural example, unlike the lower-limit voltage set circuit 300 described later, the upper-limit voltage set circuit 200 employs the same structure as the voltage amplification circuit (see the above FIG. 8) in the conventional example. The reason for this is that in generating the output voltage VH2, it is not necessary to pull down the input voltage VH1 near to the ground voltage GND and the operation is unlikely to become unstable in the presence of noise and fluctuation in the ground voltage GND and the like.

Figure 3:
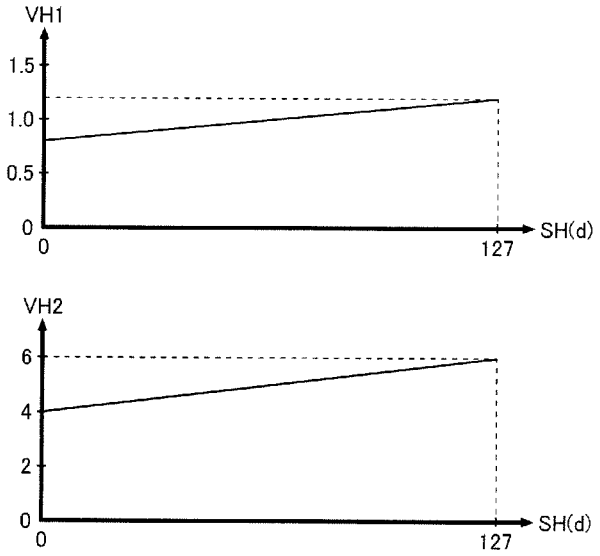
FIG. 3 is a graph showing relationships between an upper-limit voltage set value SH and an input voltage VH1 and between the upper-limit voltage set value SH and an output voltage VH2.

Here, FIG. 3 is a graph showing relationships between the upper-limit voltage set value SH and the input voltage VH1 and between the upper-limit voltage set value SH and the output voltage VH2; and shows an example of a correlation when the feedback gain α is set at 5. In this case, by setting a variable region of the input voltage VH1 in accordance with the upper-limit voltage set value SH at 0.8 to 1.2 V, it is possible to set a variable region of the output voltage VH2 at 4 to 6 V.

The lower-limit voltage set circuit 300 is a means that generates the lower-limit voltage VL2 (e.g., 0.2 to 3.375 V) based on the lower-limit voltage set value SL (e.g., 7 bits); and has: an SL register 301; a VL1 generation portion 302; an operational amplifier 303; a feedback resistor portion 304; and a selector 306.

The SL register stores the lower-limit voltage set value SL input from outside of the circuit.

The VH1 generation portion 302 generates an input voltage VL1 (eg., 0.205 to 0.675 V (in a time of VL4=GND), and 1.24 to 1.4 V (in a time of VL4=VR)) from the power-supply voltage VR (e.g., 1.5 V) based on the lower-limit voltage set value SL that is stored in the SL register 301. Here, the VH1 generation portion 302 is so structured as to generate the input voltage VL1 in such a way that the output voltage VL2 linearly changes with respect to the lower-limit voltage set value SL across the entire variable region of the lower-limit voltage set value SL; and in accordance with a selection state (which one of the ground voltage GND and the power-supply voltage VR is selected as the reference voltage VL4), the variable region of the input voltage VL1 is discontinuous (see FIG. 4 described later).

The operational amplifier 303 amplifies the input voltage VL1 to generate an output voltage VL2 in such a way that the input voltage VL1 and a feedback voltage VL3 match each other; and applies this as the lower-limit voltage VL2 to the other terminal of the resistor ladder 100.

The feedback resistor portion 304 divides a voltage between the output voltage VL2 applied to one terminal of which and the reference voltage VL4 applied to the other terminal of which to generate the feedback voltage VL3.

The selector control portion 305 generates the selector control signal SS based on the lower-limit voltage set value SL. More specifically, when the lower-limit voltage set value SL is equal to or higher than a predetermined value SLz (in the present structure, SLz=32 d (0100000b)), the selector control portion 305 brings the selector control signal SS to a high level; when the lower-limit voltage set value SL is lower than the predetermined value SLz, the selector control portion 305 brings the selector control signal SS to a low level. Here, in the selector control portion 305 in the present structural example, by calculating a logical sum of the high-order 2 bits (SL <7> and SL <6>) of the lower-limit voltage set value SL, it is possible to generate the selector control signal SS.

The selector 306 selects a candidate for the reference voltage VL4 from a plurality of candidates (ground voltage GND/power-supply voltage VR) based on the selector control signal SS. More specifically, when the lower-limit voltage set value SL is equal to or higher than the predetermined value SLz and the selector control signal SS is kept at the high level, the selector 306 selects a first reference voltage (ground voltage GND in the present structural example); when the lower-limit voltage set value SL is lower than the predetermined value SLz and the selector control signal SS is kept at the low level, the selector 306 selects a second reference voltage (power-supply voltage VR in the present structural example) higher than the first reference voltage.

In the lower-limit voltage set circuit 300 having the above structure, the feedback gain α set by the feedback resistor portion 304 is fixed like in the upper-limit voltage set circuit 200 described above; however, in accordance with whether the ground voltage GND is selected as the reference voltage VL4 or the power-supply voltage VR is selected as the reference voltage VL4, a voltage offset for the feedback voltage VL3 is changed.

In other words, in a case where the ground voltage GND is selected as the reference voltage VL4, the following formula (3) is satisfied between the input voltage VL1 and the output voltage VL2; in a case where the power-supply voltage VR is selected as the reference voltage VL4, the following formula (4) is satisfied between the input voltage VL1 and the output voltage VL2. Here, a parameter β in the following formula (4) is an offset gain.

$$VL2=\alpha\times VL1 \quad (3)$$

$$VL2=\alpha\times VL1-\beta\times VR \quad (4)$$

Figure 4:
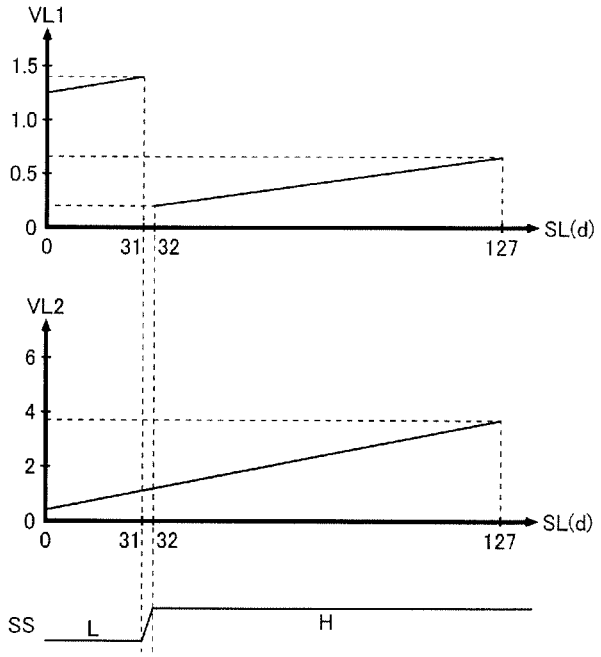
FIG. 4 is a graph showing relationships between a lower-limit voltage set value SL and an input voltage VL1 and between the lower-limit voltage set value SL and an output voltage VL3.

FIG. 4 is a graph showing relationships between the lower-limit voltage set value SL and the input voltage VL1 and between the lower-limit voltage set value SL and the output voltage VL2; and shows an example of a correlation when the feedback gain α is set at 5 and the offset gain β is set at 4.

When the lower-limit voltage set value SL is equal to or higher than the predetermined value SLz (=32 d) and the selector control signal SS is kept at the high level, the ground voltage GND is selected as the reference voltage VL4. In this case, based on the above formula (3), by setting a variable region of the input voltage VL1 in accordance with the lower-limit voltage set value SL at 0.205 to 0.675 V, it is possible to set a variable region of the output voltage VHL at 1.025 to 3.375 V.

Besides, when the lower-limit voltage set value SL is lower than the predetermined value SLz (=32 d) and the selector control signal SS is kept at the low level, the power-supply voltage VR is selected as the reference voltage VL4; and a voltage offset for the feedback voltage VL3 is given. In this case, based on the above formula (4), by setting the variable region of the input voltage VL1 in accordance with the lower-limit voltage set value SL (=0 d to 31 d) at 1.24 to 1.4 V, it is possible to set the variable region of the output voltage VL2 at 0.2 to 1 V. In other words, in the VL1 generation portion 302, even in a case where the output voltage VL equal to or lower than 1 V is generated, it is not necessary to pull down the input voltage VL1 to a value equal to or lower than 0.2 V, the operation is unlikely to become unstable in the presence of noise and fluctuation in the ground voltage and the like.

As described above, according to the lower-limit voltage set circuit 300 in the present structural example, it becomes possible to stably generate the output voltage VL2, which has a desired variable region (totally, 0.2 to 3.375 V), from the input voltage VL1 whose variable region is limited.

Besides, it is possible to easily achieve the selector control portion 305 and the selector 306 that are newly disposed this time by adding a small number of circuit elements such as an OR calculator, an analog switch and the like, so that complicated control and increase in the number of components are not brought compared with the structure in which the variable control of the feedback gain α is performed.

Figure 5:
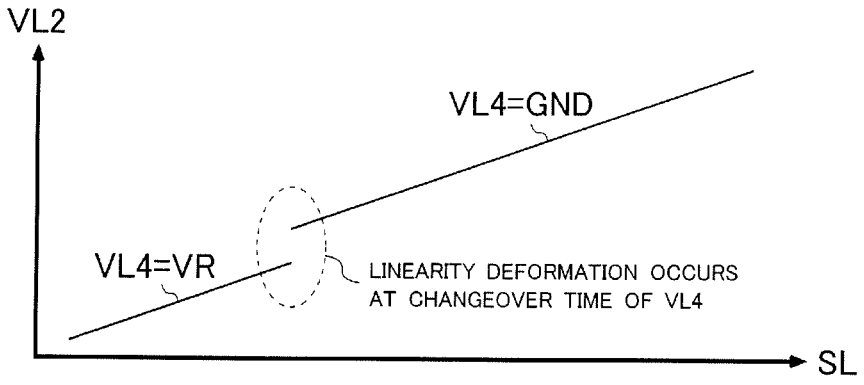
FIG. 5 is a graph for describing a problem (linearity deformation) that occurs at a changeover time of VL4.

FIG. 5 is a graph for describing a problem (linearity deformation) that occurs at a changeover time of VL4. As shown in FIG. 5, in a case where a candidate for the reference voltage VL4 is selected from the plurality of candidates (ground voltage GND/power-supply voltage VR), the linearity of the output voltage VL2 with respect to the lower-limit voltage set value SL is likely to be deformed before and after the changeover. As factors that cause such linearity deformation, it is possible to enumerate unevenness (unevenness in the power-supply voltage VR, unevenness in the resistance value of the resistor element that forms the feedback resistor portion 304, and unevenness in the on-resistance value of the switch element that forms the selector 306) in the offset of the circuit system related to the changeover control of the reference voltage VL4; however, it is extremely hard to remove all of these factors.

Hereinafter, an additional structure to overcome the above problems is described in detail.

Figure 6:
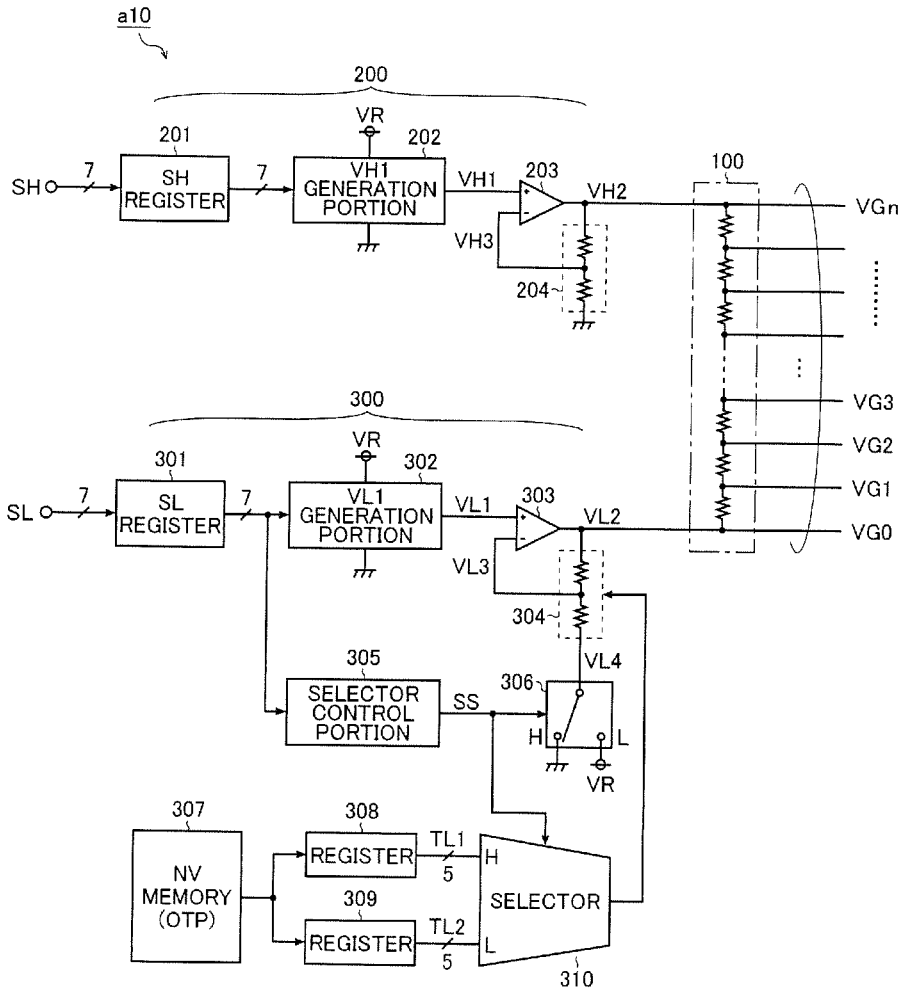
FIG. 6 is a block diagram showing a second structural example of the gradation voltage generation circuit a10.

FIG. 6 is a block diagram showing a second structural example of the gradation voltage generation circuit a10. As shown in FIG. 6, the gradation voltage generation circuit a10 in the present structural example has substantially the same structure as in the above first structural example. Because of this, the same constituent components as in the above first structural example are indicated by the same reference numbers as in FIG. 2 to skip double description; and hereinafter, description is performed focusing on characterizing portions in the present structural example.

The gradation voltage generation circuit a10 in the present structural example newly has: a non-volatile memory 307; a TL1 register 308; a TL2 register 309; and a second selector 310.

The non-volatile memory 307 stores, in a non-volatile manner, a plurality of trimming tables (in the present structural example, a first trimming table TL1 and a second trimming table TL2) that become candidates for selection by the second selector 310. Here, as the non-volatile memory 307, it is possible to use an OTPROM (One Time Programmable Read Only Memory), an EEPROM (Electrically Erasable PROM), or a flash memory. Besides, the first trimming table TL1 and the second trimming table TL2 stored in the non-volatile memory 307 are automatically read in a startup sequence of the liquid crystal drive apparatus a1.

In a startup time (and a startup time of the lower-limit voltage set circuit 300) of the liquid crystal drive apparatus a1, the TL1 register 308 stores the first trimming table TL1 read from the non-volatile memory 307. Here, the first trimming table TL1 is a trimming table that is so built in as to optimize the voltage-division ratio of the feedback resistor portion 304 in a state in which the ground voltage GND is selected as the reference voltage VL4.

In the startup time (and the startup time of the lower-limit voltage set circuit 300) of the liquid crystal drive apparatus a1, the TL2 register 309 stores the second trimming table TL2 read from the non-volatile memory 307. Here, the second trimming table TL2 is a trimming table that is so built in as to optimize the voltage-division ratio of the feedback resistor portion 304 in a state in which the power-supply voltage VR is selected as the reference voltage VL4.

The second selector 310, based on the selector control signal SS, selects a candidate for a trimming table to be supplied to the feedback resistor portion 304 from the plurality of candidates (in the present structural example, the first trimming table and the second trimming table TL2). More specifically, when the lower-limit voltage set value SL is equal to or higher than the predetermined value SLz and the selector control signal SS is kept at the high level, the second selector 310 selects the first trimming table TL1; when the lower-limit voltage set value SL is lower than the predetermined value SLz and the selector control signal SS is kept at the low level, the second selector 310 selects the second trimming table TL2.

The feedback resistor portion 304 performs fine adjustment of the voltage-division ratio of itself based on the trimming table selected by the second selector 310.

As described above, according to the structure where the first trimming table TL1, which is so built in as to optimize the voltage-division ratio of the feedback resistor portion 304, is selected in a state in which the ground voltage GND is selected as the reference voltage VL4; and the second trimming table TL2, which is so built in as to optimize the voltage-division ratio of the feedback resistor portion 304, is selected in a state in which the power-supply voltage VR is selected as the reference voltage VL4; the first trimming table TL1 and the second trimming table TL2 are separately prepared; and the changeover of the reference voltage VL4 and the changeover of the trimming table are performed at the same time, it becomes possible to maintain the linearity of the output voltage VL2 with respect to the lower-limit voltage set value SL before and after the changeover of the reference voltage VL4.

Figure 7:
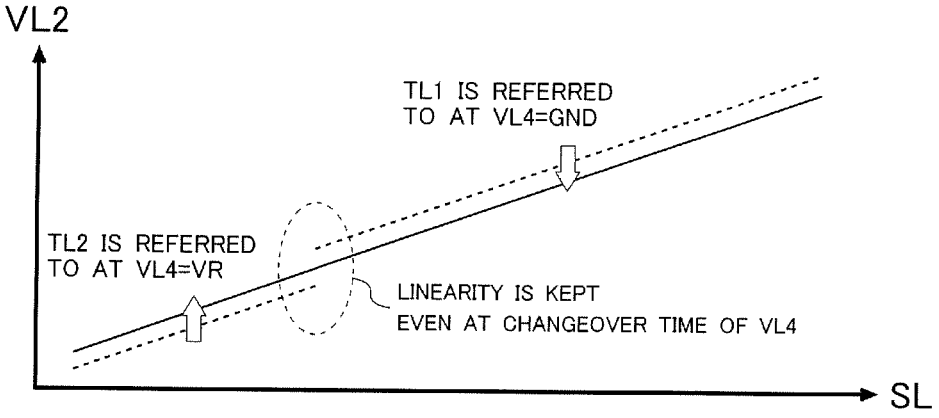
FIG. 7 is a graph for describing an effect (linearity maintenance) of changeover control of TL1, TL2.

FIG. 7 is a graph for describing an effect (linearity maintenance) that is obtained by the changeover control of the first trimming table TL1 and the second trimming table TL2.

Besides, the lower-limit voltage set circuit 300 in the present structural example, as described above, has the structure where in the startup sequence of the liquid crystal drive apparatus a1, the first trimming table TL1 and the second trimming table TL2 that are stored in the non-volatile memory 307 are read into the TL1 register 308 and the TL2 register 309 in advance, respectively. According to such a structure, it becomes possible to perform the changeover control of the trimming table without becoming behind the changeover control of the reference voltage VL4.

Here, in the above embodiment, the structure is described as an example, in which as the means to set the lower-limit value of the gradation voltage that is used for the liquid crystal drive, the voltage amplification circuit having the first technical feature is used; however, the application of the first technical feature is not limited to this, and it is possible to widely apply the first technical feature to voltage amplification circuits that are use for other applications (e.g., pixel drive other than the liquid crystal).

Besides, the structure having the first technical feature is able to be modified in various ways without departing from the spirit besides the above embodiment.

(Second Technical Feature)

The second technical feature described hereinafter relates to a liquid crystal drive apparatus of a dot inversion type, a column inversion type or the like that performs polarity inversion control of an output signal applied to a liquid crystal element and to a liquid crystal display apparatus that uses the liquid crystal drive apparatus.

Here, with reference to the above figures, the second technical feature relates to the source driver circuit xA3 in FIG. 28; more specifically, the second technical feature relates to the source driver portion xB9 in FIG. 29, further, to the source amplification circuits xC3 (*i*), xC (j), and their peripheral circuits.

Figure 9:
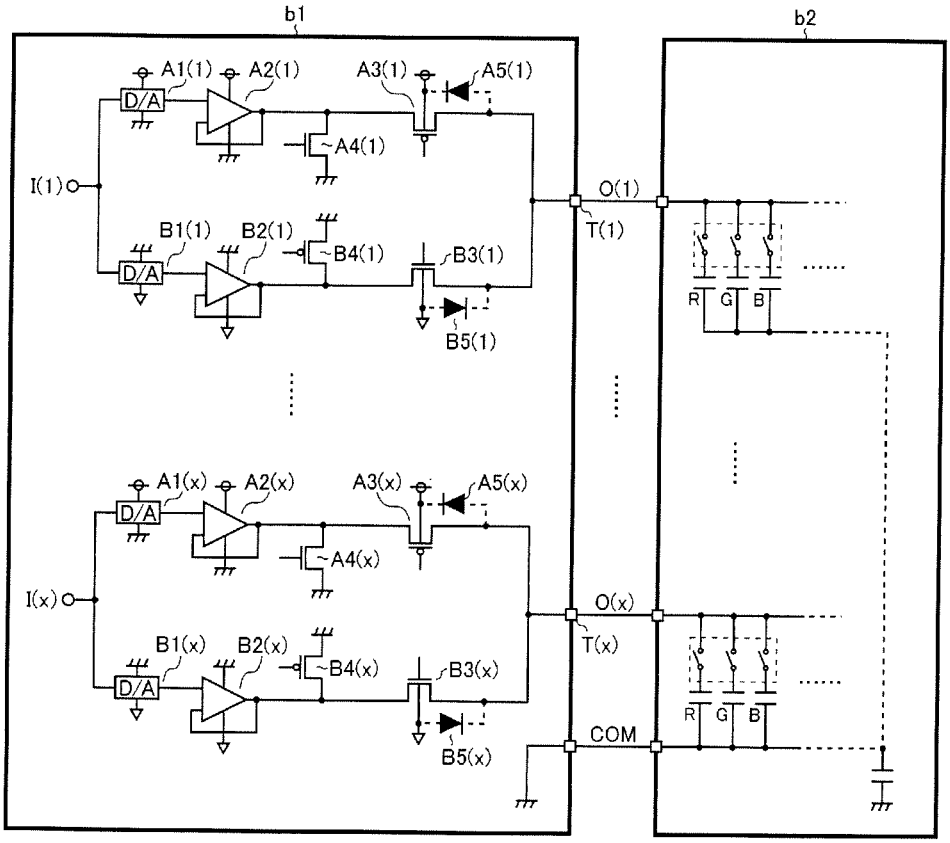
FIG. 9 is a schematic view showing a first embodiment of a liquid crystal display apparatus having a second technical feature.

First, an embodiment of a liquid crystal display apparatus having the second technical feature is described in detail. FIG. 9 is a schematic view showing the first embodiment of the liquid crystal display apparatus having the second technical feature. The liquid crystal display apparatus in the present embodiment has: a liquid crystal drive apparatus b1; and a TFT type liquid crystal display panel b2.

The liquid crystal drive apparatus b1 is a semiconductor apparatus (so-called source driver IC) that converts x-system input signals I (k) (where k=1, 2, . . . , x, hereinafter, the same) input from a not-shown image source; and supplies them to each pixel (more precisely, a source terminal of an active element connected to each pixel of the liquid crystal display panel b2) of the liquid crystal display panel b2.

Besides, the liquid crystal drive apparatus b1, in diving the liquid crystal display panel b2, performs polarity inversion control of an output signal O (k) that is applied to x-column liquid crystal elements, and as shown in FIG. 9, integrates: digital/analog converters A1 (*k*) and B1 (*k*); source amplifiers A2 (*k*) and B2 (*k*); P-channel type MOS field effect transistors A3 (*k*) and B4 (*k*); N-channel type MOS field effect transistors A4 (*k*) and B3 (*k*).

The digital/analog converters A1 (*k*) is driven between the ground voltage GND (which corresponds to the reference voltage) and a positive power-supply voltage VDD (which corresponds to the first power-supply voltage; for example, +6 V) that is higher than the ground voltage; and converts the digital input signal I (k) into an analog positive-polarity voltage. Here, the positive-polarity voltage generated by the digital/analog converter A1 (*k*) becomes a gradation voltage that discretely changes between the ground voltage GND and the positive power-supply voltage VDD in accordance with a data value of the input signal I (k).

The digital/analog converter B1 (*k*) is driven between the ground voltage GND and a negative power-supply voltage VEE (which corresponds to the second power-supply voltage; for example, −6 V) that is lower than the ground voltage; and converts the digital input signal I (k) into an analog negative-polarity voltage. Here, the negative-polarity voltage generated by the digital/analog converter B1 (*k*) becomes a gradation voltage that discretely changes between the ground voltage GND and the negative power-supply voltage VEE in accordance with the data value of the input signal I (k).

The source amplifier A2 (*k*) is a first amplifier that is driven between the ground voltage GND and the positive power-supply voltage VDD; increases and outputs an electric-current capability of the positive-polarity voltage input from the digital/analog converter A1 (*k*).

The source amplifier B2 (*k*) is a second amplifier that is driven between the ground voltage GND and the negative power-supply voltage VDD; increases and outputs an electric-current capability of the negative-polarity voltage input from the digital/analog converter B1 (*k*).

The transistor A3 (*k*) is a first switch that is connected between an output terminal of the source amplifier A2 (*k*) and an external terminal T (k). A drain of the transistor A3 (*k*) is connected to an output terminal of the source amplifier A2 (*k*). A source of the transistor A3 (*k*) is connected to the external terminal T (k). A gate of the transistor A3 (*k*) is connected a not-shown polarity inversion control portion. A back gate of the transistor A3 (*k*) is connected to an application terminal of the positive power-supply voltage VDD.

The transistor B3 (*k*) is a second switch that is connected between an output terminal of the source amplifier B2 (*k*) and the external terminal T (k). A drain of the transistor B3 (*k*) is connected to an output terminal of the source amplifier B2 (*k*). A source of the transistor B3 (*k*) is connected to the external terminal T (k). A gate of the transistor B3 (*k*) is connected a not-shown polarity inversion control portion. A back gate of the transistor B3 (*k*) is connected to an application terminal of the negative power-supply voltage VEE.

Here, a very large potential difference (up to VDD−VEE) is applied across the gate and the source; and across the gate and the drain of each of the transistors A3 (*k*) and B3 (*k*), so that it is necessary to use a high breakdown-voltage element (e.g., 20 V breakdown-voltage element) that has a large element size.

The transistor A4 (*k*) is a third switch that is connected between the output terminal of the source amplifier A2 (*k*) and the application terminal of the ground terminal GND. A drain of the transistor A4 (*k*) is connected to the output terminal of the source amplifier A2 (*k*). A source of the transistor A4 (*k*) is connected to the application terminal of the ground voltage GND. A gate of the transistor A4 (*k*) is connected a not-shown polarity inversion control portion.

The transistor B4 (*k*) is a fourth switch that is connected between the output terminal of the source amplifier B2 (*k*) and the application terminal of the ground terminal GND. A drain of the transistor B4 (*k*) is connected to the output terminal of the source amplifier B2 (*k*). A source of the transistor B4 (*k*) is connected to the application terminal of the ground voltage GND. A gate of the transistor B4 (*k*) is connected a not-shown polarity inversion control portion.

Between the source and the back gate of the transistor A3 (*k*), a body diode A5 (*k*) is parasitic. An anode of the body diode A5 (*k*) is connected to the source of the transistor A3 (*k*). A cathode of the body diode A5 (*k*) is connected to the back gate of the transistor A3 (*k*). In other words, the body diode A5 (*k*) is connected between the external terminal T (k) and the application terminal of the positive power-supply voltage VDD. Accordingly, by devising a layout of the transistor A3 (*k*), it is possible to use the body diode A5 (*k*) that is parasitic in this as an electrostatic discharge protection diode (positive surge protection element) for the external terminal T (k). Here, the layout of the transistor A3 (*k*) is described in detail later.

Between the source and the back gate of the transistor B3 (*k*), a body diode B5 (*k*) is parasitic. A cathode of the body diode B5 (*k*) is connected to the source of the transistor B3 (*k*). An anode of the body diode B5 (*k*) is connected to the back gate of the transistor B3 (*k*). In other words, the body diode B5 (*k*) is connected between the external terminal T (k) and the application terminal of the negative power-supply voltage VEE. Accordingly, by devising a layout of the transistor B5 (*k*), it is possible to use the body diode B5 (*k*) that is parasitic in this as an electrostatic discharge protection diode (negative surge protection element) for the external terminal T (k). Here, the layout of the transistor B3 (*k*) is described in detail later.

The liquid crystal display panel b2 is an image output means that uses the x-column liquid crystal elements as the pixels whose light transmission factors changes in accordance with the voltage value of the output signal O (k).

In the liquid crystal drive apparatus b1 having the above structure, a liquid crystal drive type (a dot inversion type and a column inversion type) that by turning on/off the transistors A3 (*k*) and B3 (*k*) in a complementary manner, performs the polarity inversion control of the output signal O (k) that is applied to the liquid crystal element from the external terminal T (k).

Figure 10:
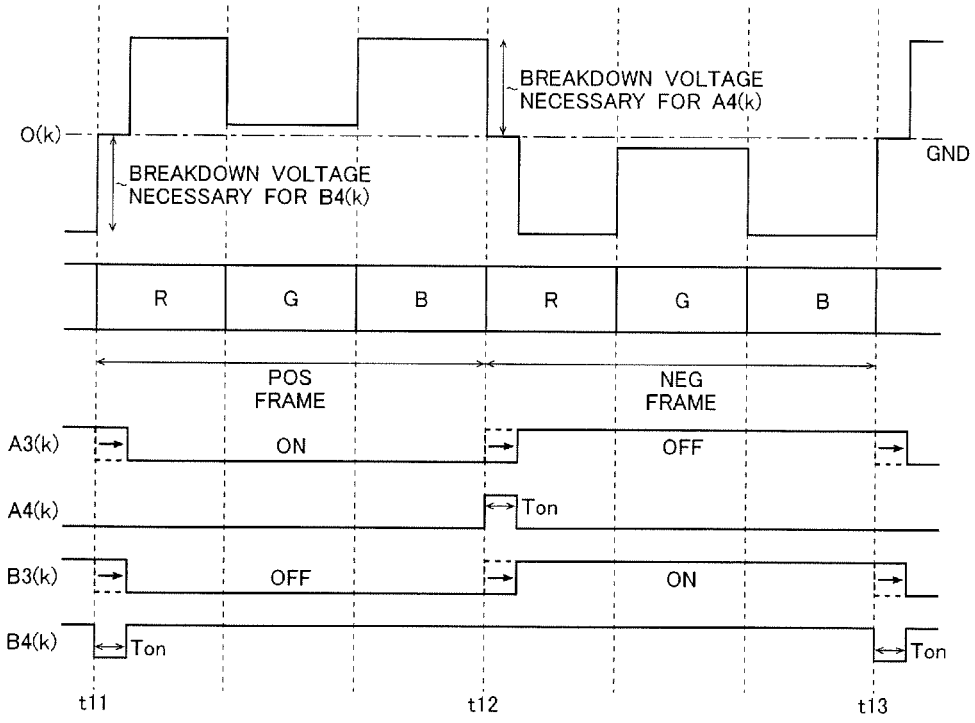
FIG. 10 is a timing chart showing an example of polarity inversion control by a liquid crystal drive apparatus b1.

FIG. 10 is a timing chart showing an example of the polarity inversion control by the liquid crystal drive apparatus b1; and in order from the top of the paper surface, represents: a voltage level of the output signal O (k); a selected state of RGB; a polarity state (positive polarity (POS) frame or negative (NEG) frame) of the output signal O (k); a gate voltage of the transistor A3 (*k*); a gate voltage of the transistor A4 (*k*); a gate voltage of the transistor B3 (*k*); and a gate voltage of the transistor B4 (*k*).

As shown in FIG. 10, in the positive polarity frame (times t11 to t12), the transistor A3 (*k*) is turned on and the transistor B3 (*k*) is turned off. In other words, as the output signal O (k), a positive-polarity analog signal generated by the source amplifier A2 (*k*) is selected. On the other hand, in the negative polarity frame (times t12 to t13), the transistor A3 (*k*) is turned off and the transistor B3 (*k*) is turned on. In other words, as the output signal O (k), a negative-polarity analog signal generated by the source amplifier B2 (*k*) is selected.

According to such a structure that performs the polarity inversion control of the output signal O (k), because a unidirectional voltage is not continued to be applied to the liquid crystal element, it becomes possible to curb deterioration of the liquid crystal element.

Besides, according to the structure that performs the above polarity control of the output signal O (k), it is possible to fix the common voltage COM (voltage applied to opposite electrodes of all the liquid crystal elements) of the liquid crystal display panel b2 at the ground voltage GND, so that charge and discharge of the opposite capacitor of the liquid crystal display panel b2 become unnecessary and it is possible to achieve reduction in the power consumption.

Besides, at the timing (time t12) when the output signal O (k) is inverted from the positive polarity to the negative polarity, the transistor A3 (*k*) is turned off, and the transistor A4 (*k*) is kept in an on state for a predetermined on period Ton before the transistor B3 (*k*) is turned on; at the timing (times t11, t13) when the output signal O (k) is inverted from the negative polarity to the positive polarity, the transistor B3 (*k*) is turned off, and the transistor B4 (*k*) is kept in an on state for the predetermined on period Ton before the transistor A3 (*k*) is turned on As described above, in the polarity inversion of the output signal O (k), according to the structure in which the output signal O (k) is once set at the ground voltage GND, it becomes possible to lower a potential difference that occurs at the time of the polarity inversion of the output signal O (k), and reduce the drive current for the liquid crystal element.

Besides, in the liquid crystal drive apparatus 1 in the present embodiment, by turning on the transistors A4 (*k*) and B4 (*k*) for charge share (for GND short) at the timing that is different from the conventional (compare and see a solid line and a broken line in FIG. 10), it becomes possible to dispose the transistors A4 (*k*) and B4 (*k*) closer to the source amplifier side rather than to the transistors A3 (*k*) and B3 (*k*). Accordingly, the potential difference applied across the gate and the source of each of the transistors A4 (*k*) and B4 (*k*) is limited to (VDD−GND) or (GND−VEE) at most. As a result of this, it is sufficient if as the transistors A4 (*k*) and B4 (*k*), medium breakdown-voltage elements (e.g., 7 V breakdown-voltage elements) that have an element size smaller than high breakdown-voltage elements (e.g., 20 V breakdown-voltage elements) are used, so that it becomes possible to achieve size reduction (chip-area reduction) of the liquid crystal drive apparatus b1.

Here, in FIG. 10, the on periods Ton of the transistors A4 (*k*) and B4 (*k*) are all represented exaggeratedly long; however, in actual setting, for example, it is sufficient if the on period Ton is set at a period that the output signal O (k) takes to change from the positive power-supply voltage VDD or from the negative power-supply voltage VEE to the ground voltage GND, so that the on periods Ton of the transistors A4 (*k*) and B4 (*k*) become sufficiently short compared with one frame period.

Next, element layouts of the transistors A3 (*k*) and B3 (*k*), which should be devised to use the body diodes A5 (*k*) and B5 (*k*) as the electrostatic discharge protection diodes, are described in detail.

Figure 11A:
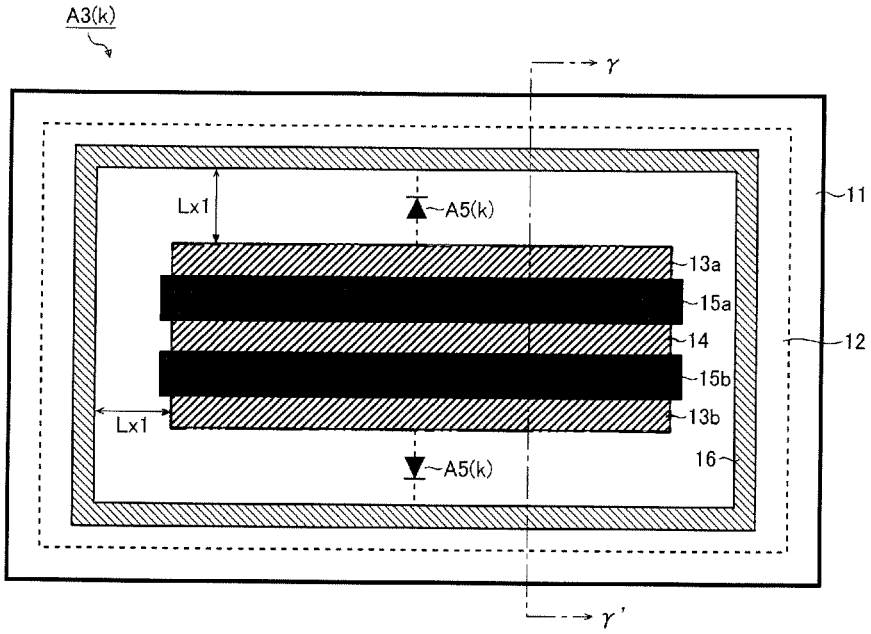
FIG. 11A is a top view showing a layout example of a transistor A3 (*k*).
Figure 11B:
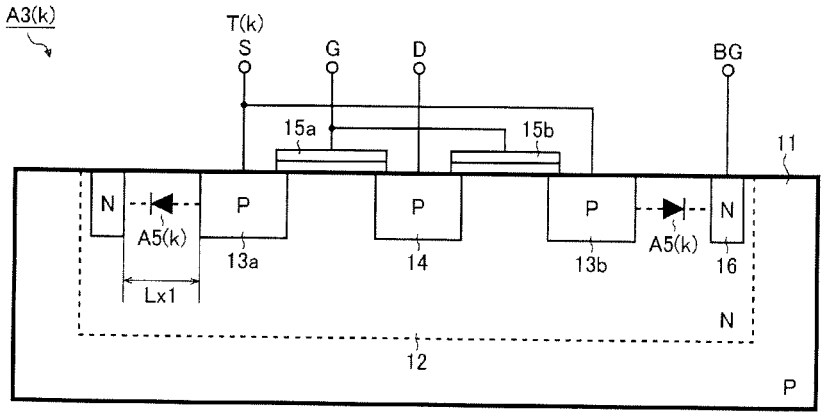
FIG. 11B is a γ-γ' sectional view of the transistor A3 (*k*).

FIG. 11A is a top view showing a layout example of the transistor A3 (*k*); and FIG. 11B is a γ-γ' sectional view of the transistor A3 (*k*). In a P sub 11 of a P-type semiconductor, an N well 12 of an N-type semiconductor is formed. In the N well 12, a first source region 13*a* and a second source region 13*b* of the P-type semiconductor, and a drain region 14 of a P-type semiconductor are formed. The first source region 13*a* and the second source region 13*b* are separately formed on both sides of the drain region 14, and they are all connected to the external terminal T (k) in common. In other words, the transistor A3 (*k*) in the present layout example is disposed in such a way that the first source region 13*a* and the second source region 13*b* directly connected to the external terminal T (k) are outside the transistor A3 (*k*). On a surface of the P sub 11, between the first source region 13*a* and the drain region 14, and between the second source region 13*b* and the drain region 14, gates 15*a* and 15*b* are formed, respectively. Besides, in the N well 12, a contact region 16 of a back gate that is an N-type semiconductor is so formed as to enclose the drain region 14, the first source region 13*a* and the second source region 13*b*. Here, the drain region 14, the first source region 13*a* and the second source region 13*b* are each disposed away from the contact region 16 of the back gate by a predetermined distance Lx1 (e.g, 2 to 4 μm). In junctions between the contact region 16 of the back gate and each of the first source region 13*a* and the second source region 13*b*, the body diodes A5 (*k*) are parasitic.

Figure 12A:
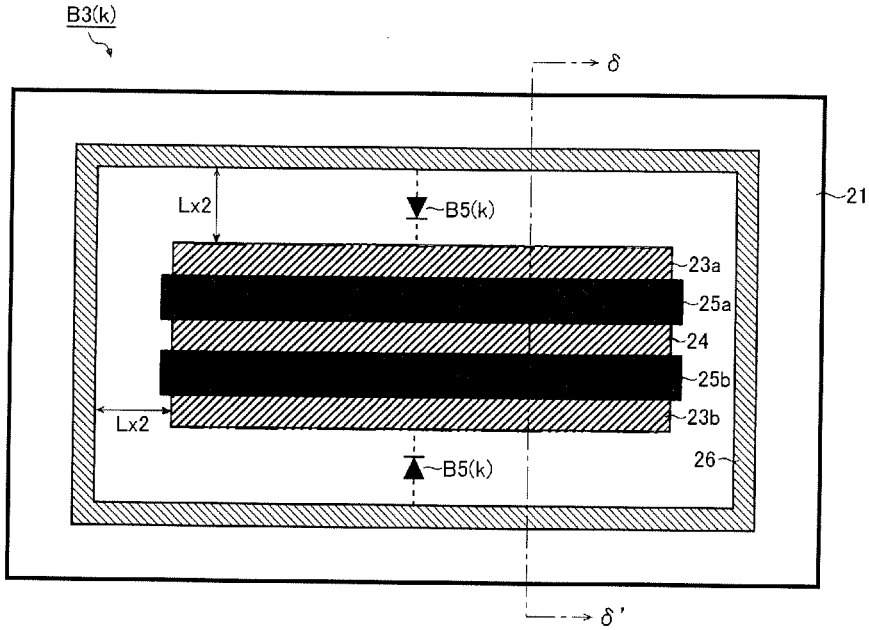
FIG. 12A is a top view showing a layout example of a transistor B3 (*k*).
Figure 12B:
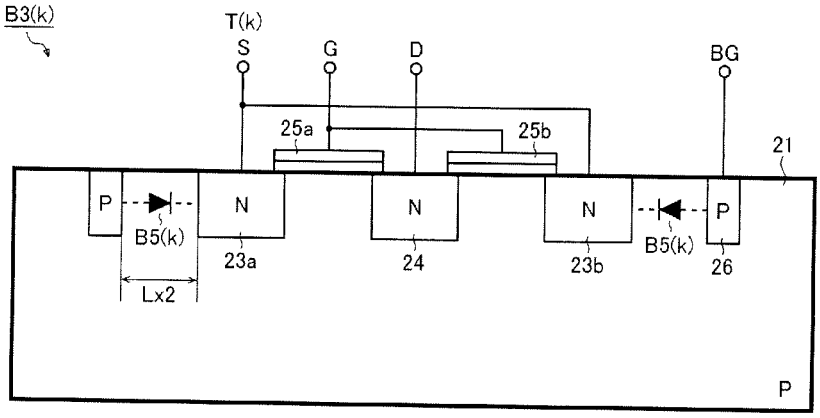
FIG. 12B is a δ-δ' sectional view of the transistor B3 (*k*).

FIG. 12A is a top view showing a layout example of the transistor B3 (*k*); and FIG. 12B is a δ-δ' sectional view of the transistor B3 (*k*). In a P sub 21 of a P-type semiconductor, a first source region 23*a* and a second source region 23*b* of an N-type semiconductor, and a drain region 24 of an N-type semiconductor are formed. The first source region 23*a* and the second source region 23*b* are separately formed on both sides of the drain region 24, and both of them are connected to the external terminal T (k) in common. In other words, the transistor B3 (*k*) in the present layout example is disposed in such a way that the first source region 23*a* and the second source region 23*b* directly connected to the external terminal T (k)

are outside the transistor B3 (*k*). On a surface of the P sub 21, between the first source region 23*a* and the drain region 24, and between the second source region 23*b* and the drain region 24, gates 25*a* and 25*b* are formed, respectively. Besides, in the P sub 21, a contact region 26 of a back gate that is a P-type semiconductor is so formed as to enclose the drain region 24, the first source region 23*a* and the second source region 23*b*. Here, the drain region 24, the first source region 23*a* and the second source region 23*b* are each disposed away from the contact region 26 of the back gate by a predetermined distance Lx2 (e.g, 2 to 4 μm). In junctions between the contact region 26 of the back gate and each of the first source region 23*a* and the second source region 23*b*, the body diodes B5 (*k*) are parasitic.

A first feature of the element layouts of the above transistors A3 (*k*) and B3 (*k*) is that the between-regions distances Lx1, Ls2 are designed to be a sufficiently large value. In forming a usual transistor, it is general to design the between-regions distances Lx1, Lx2 are designed to be 1.2 to 1.5 μm; however, to use the body diodes A5 (*k*) and B5 (*k*) as the electrostatic discharge protection diodes, it is desirable to design the between-regions distances Lx1, Lx2 to be 2 to 4 μm (about the same between-regions distance in a case of forming a diode). According to such a structure, it becomes possible to effectively prevent concentration of electric currents into the body diodes A5 (*k*) and B5 (*k*).

Besides, a second feature of the element layouts of the above transistors A3 (*k*) and B3 (*k*) is that the first source regions 13*a* and 23*a* and the second source regions 13*b* and 23*b* which are all directly connected to the external terminal T (k) are so disposed as to be outside the transistors A3 (*k*) and B3 (*k*), respectively. According to the employment of such element layouts, it is possible to secure a junction area between the source of the transistor A3 (*k*) and the back gate and a junction area between the source of the transistor B3 (*k*) and the back gate, so that it becomes possible to increase electrostatic discharge protection capabilities of the body diodes that are parasitic in these junctions.

Figure 14:
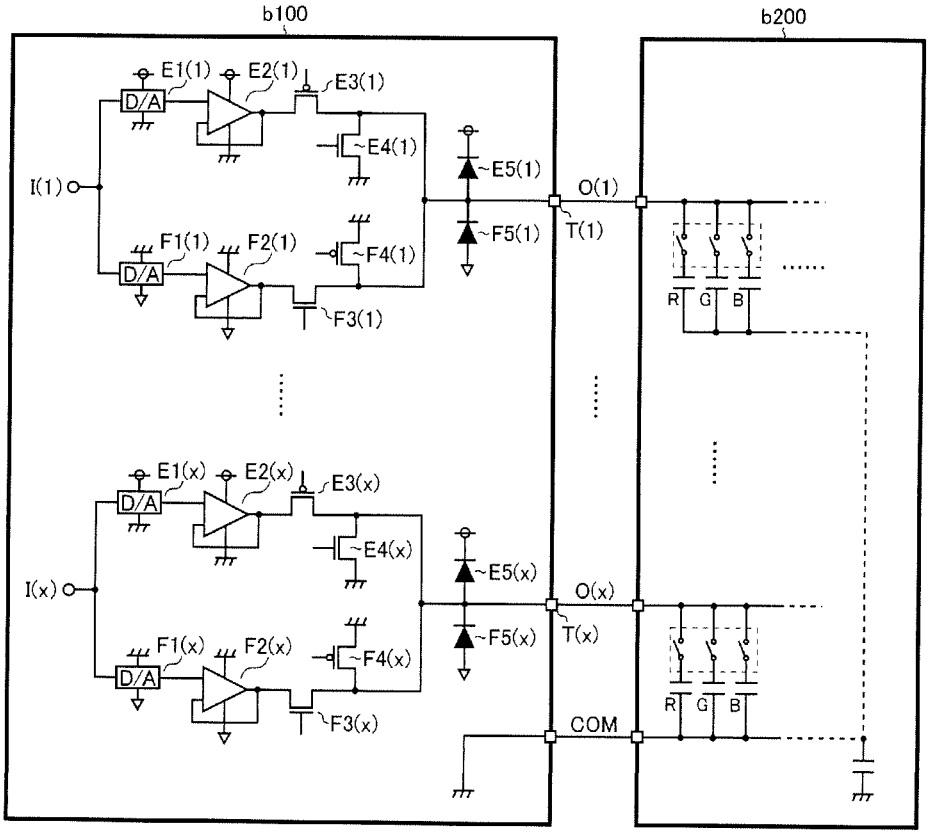
FIG. 14 is a schematic diagram showing a conventional example of a liquid crystal display apparatus.
Figure 15:
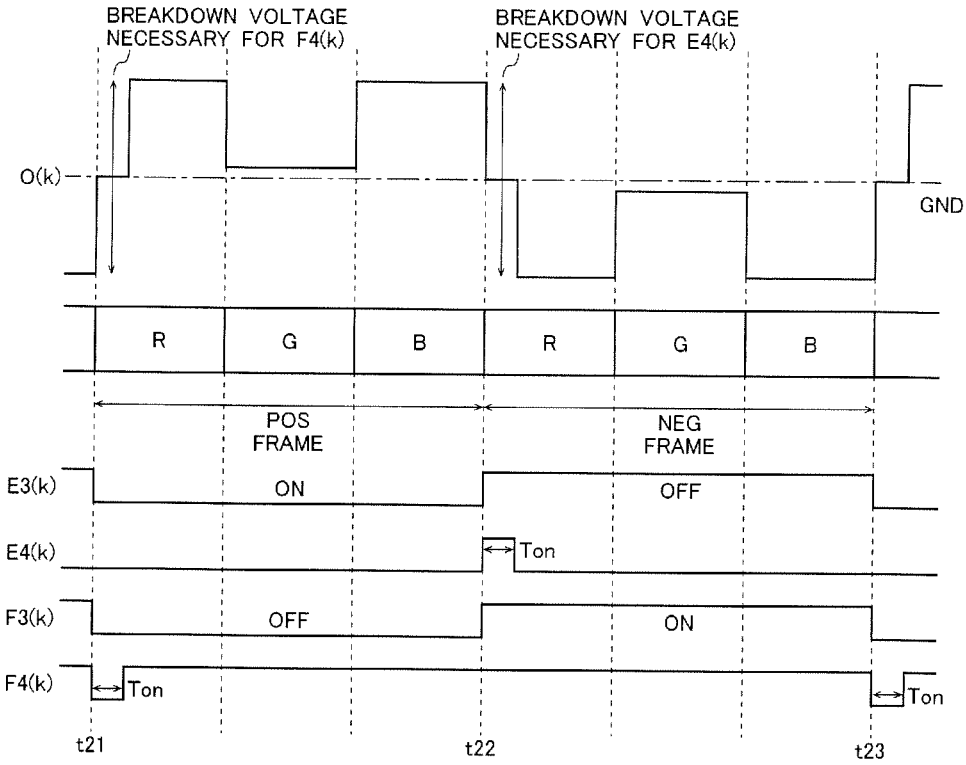
FIG. 15 is a timing chart showing a conventional example of polarity inversion control.

As described above, in the liquid crystal drive apparatus b1, it is possible to use both of the transistors A5 (*k*) and B5 (*k*) as the electrostatic discharge protection diodes for the external terminal T (k), so that it becomes unnecessary to dispose the conventional electrostatic discharge protection diodes E5 (*k*) and F5 (*k*) (see FIG. 14);, and it becomes possible to contribute to size reduction (chip-area reduction) of the liquid crystal drive apparatus b1.

Figure 13:
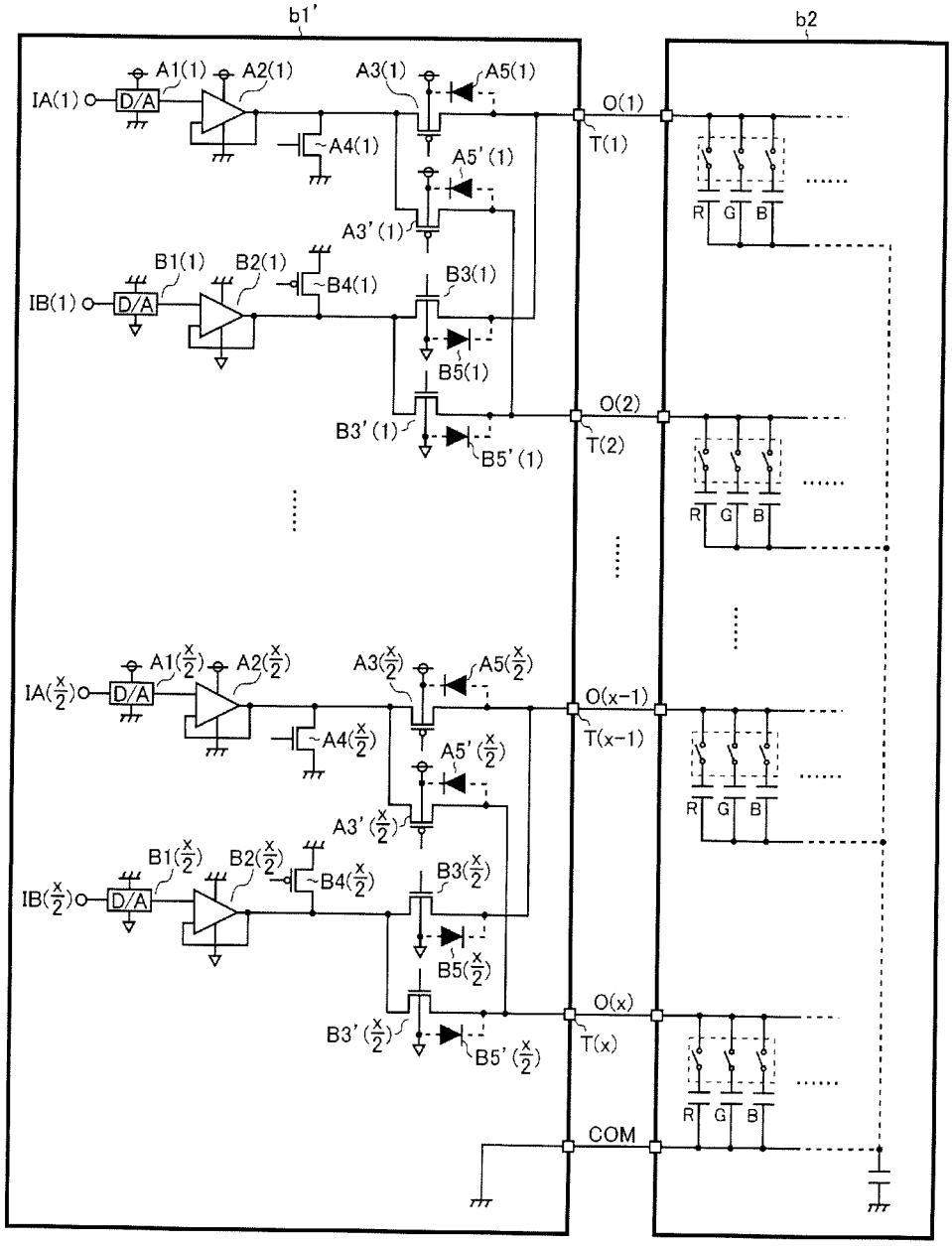
FIG. 13 is a schematic view showing a second embodiment of a liquid crystal display apparatus having a second technical feature.

Next, a second embodiment of the liquid crystal display apparatus having the second technical feature is described in detail. FIG. 13 is a schematic view showing the second embodiment of the liquid crystal display apparatus having the second technical feature. As seen from FIG. 13, the liquid crystal display apparatus in the present embodiment has substantially the same structure as in the above first embodiment. Because of this, the same constituent components as in the first embodiment are indicated by the same reference numbers as in FIG. 9 to skip double description; and hereinafter, description is performed focusing on constituent components unique to the second embodiment.

In the above first embodiment, the structure is employed, in which a set of the positive-polarity circuit (A1 (*k*) to A5 (*k*)) and the negative-polarity circuit (B1 (*k*) to B5 (*k*)) is disposed for each of the x external terminals T (k) (where k=1, 2, . . . , x); however, in the second embodiment, a structure is employed, in which a set of the positive-polarity circuit (A1 (*j*) to A5 (*j*)) and the negative-polarity circuit (B1 (*j*) to B5 (*j*)) (where j=((i+1)/2)=1, 2, 3, . . . , (x/2), hereinafter, the same) is shared between a first external terminal T (i) and a second external terminal T (i+1) (where i=1, 3, 5, . . . , (x−1), hereinafter, the same) that are adjacent to each other. Here, the x is an even number that is to 2 or larger.

More specifically, the liquid crystal drive apparatus b1' in the present embodiment integrates: digital/analog converters A1 (*j*) and B1 (*j*); source amplifiers A2 (*j*) and B2 (*j*); P-channel type MOS field effect transistors A3 (*j*) and B4 (*j*); and N-channel type MOS field effect transistors A4 (*j*) and B3 (*j*); further integrates: a P-channel type MOS field effect transistor A3' (*j*); and an N channel-type MOS field effect transistor B3' (*j*).

The digital/analog converter A1 (*j*) is driven between the ground voltage GND and the positive power-supply voltage VDD; and converts a digital input signal IA (j) into an analog positive-polarity voltage. Here, the positive-polarity voltage generated by the digital/analog converter A1 (*j*) becomes a gradation voltage that discretely changes between the ground voltage GND and the positive power-supply voltage VDD in accordance with a data value of the input signal IA (j).

The digital/analog converter B1 (*j*) is driven between the ground voltage GND and the negative power-supply voltage VEE; and converts a digital input signal IB (j) into an analog negative-polarity voltage. Here, the negative-polarity voltage generated by the digital/analog converter B1 (*j*) becomes a gradation voltage that discretely changes between the ground voltage GND and the negative power-supply voltage VEE in accordance with a data value of the input signal IB (j).

The source amplifier A2 (*j*) is a first amplifier that is driven between the ground voltage GND and the positive power-supply voltage VDD; increases and outputs an electric-current capability of the positive-polarity voltage input from the digital/analog converter A1 (*j*).

The source amplifier B2 (*j*) is a second amplifier that is driven between the ground voltage GND and the negative power-supply voltage VEE; increases and outputs an electric-current capability of the negative-polarity voltage input from the digital/analog converter B1 (*j*).

The transistor A3 (*j*) is a first switch that is connected between an output terminal of the source amplifier A2 (*j*) and the first external terminal T (i). A drain of the transistor A3 (*j*) is connected to an output terminal of the source amplifier A2 (*j*). A source of the transistor A3 (*j*) is connected to the first external terminal T (i). A gate of the transistor A3 (*j*) is connected to a not-shown polarity inversion control portion. A back gate of the transistor A3 (*j*) is connected to the application terminal of the positive power-supply voltage VDD.

The transistor B3 (*j*) is a second switch that is connected between an output terminal of the source amplifier B2 (*j*) and the first external terminal T (i). A drain of the transistor B3 (*j*) is connected to an output terminal of the source amplifier B2 (*j*). A source of the transistor B3 (*j*) is connected to the first external terminal T (i). A gate of the transistor B3 (*j*) is connected a not-shown polarity inversion control portion. A back gate of the transistor B3 (*i*) is connected to the application terminal of the negative power-supply voltage VEE.

Here, a very large potential difference (up to VDD−VEE) is applied across the gate and the source; and across the gate and the drain of each of the transistors A3 (*j*) and B3 (*j*), so that it is necessary to use a high breakdown-voltage element (e.g., 20 V breakdown-voltage element) that has a large element size.

The transistor A4 (*j*) is a third switch that is connected between the output terminal of the source amplifier A2 (*j*) and the application terminal of the ground voltage GND. A drain of the transistor A4 (*j*) is connected to the output terminal of the source amplifier A2 (*j*). A source of the transistor A4 (*j*) is connected to the application terminal of the ground voltage GND. A gate of the transistor A4 (*j*) is connected to a not-shown polarity inversion control portion.

The transistor B4 (*j*) is a fourth switch that is connected between the output terminal of the source amplifier B2 (*j*) and the application terminal of the ground voltage GND. A drain of the transistor B4 (*j*) is connected to the output terminal of the source amplifier B2 (*j*). A source of the transistor B4 (*j*) is connected to the application terminal of the ground voltage GND. A gate of the transistor B4 (*j*) is connected to a not-shown polarity inversion control portion.

Besides, a transistor A3' (*j*) added in the present embodiment is a fifth switch that is connected between the output terminal of the source amplifier A2 (*j*) and the second external terminal T (i+1). A drain of the transistor A3' (*j*) is connected to the output terminal of the source amplifier A2 (*j*). A source of the transistor A3' (*j*) is connected to the second external terminal T (i+1). A gate of the transistor A3' (*j*) is connected to a not-shown polarity inversion control portion. A back gate of the transistor A3' (*j*) is connected to the application terminal of the positive power-supply voltage VDD.

Besides, a transistor B3' (*j*) added in the present embodiment is a sixth switch that is connected between the output terminal of the source amplifier B2 (*j*) and the second external terminal T (i+1). A drain of the transistor B3' (*j*) is connected to the output terminal of the source amplifier B2 (*j*). A source of the transistor B3' (*j*) is connected to the second external terminal T (i+1). A gate of the transistor B3' (*j*) is connected a not-shown polarity inversion control portion. A back gate of the transistor B3' (*j*) is connected to the application terminal of the negative power-supply voltage VEE.

Here, a very large potential difference (up to VDD−VEE) is applied across the gate and the source; and across the gate and the drain of each of the transistors A3' (*j*) and B3' (*j*), so that it is necessary to use a high breakdown-voltage element (e.g., 20 V breakdown-voltage element) that has a large element size.

Between the source and the back gate of the transistor A3 (*j*), a body diode A5 (*j*) is parasitic. An anode of the body diode A5 (*j*) is connected to the source of the transistor A3 (*j*). A cathode of the body diode A5 (*j*) is connected to the back gate of the transistor A3 (*j*). In other words, the body diode A5 (*j*) is connected between the first external terminal T (i) and the application terminal of the positive power-supply voltage VDD. Accordingly, by devising a layout of the transistor A3 (*j*), it is possible to use the body diode A5 (*j*) that is parasitic in this as an electrostatic discharge protection diode (positive surge protection element) for the first external terminal T (i). Here, because the layout of the transistor A3 (*j*) is described above, detailed description is skipped.

Between the source and the back gate of the transistor B3 (*j*), a body diode B5 (*j*) is parasitic. A cathode of the body diode B5 (*j*) is connected to the source of the transistor B3 (*j*). An anode of the body diode B5 (*j*) is connected to the back gate of the transistor B3 (*j*). In other words, the body diode B5 (*j*) is connected between the first external terminal T (i) and the application terminal of the negative power-supply voltage VEE. Accordingly, by devising a layout of the transistor B3 (*j*), it is possible to use the body diode B5 (*j*) that is parasitic in this as an electrostatic discharge protection diode (negative surge protection element) for the first external terminal T (i). Here, because the layout of the transistor B3 (*j*) is described above, detailed description is skipped.

Besides, between the source and the back gate of the transistor A3' (*j*) added in the present embodiment, a body diode A5' (*j*) is parasitic. An anode of the body diode A5' (*j*) is connected to the source of the transistor A3' (*j*). A cathode of the body diode A5' (*j*) is connected to the back gate of the transistor A3' (*j*). In other words, the body diode A5' (*j*) is connected between the second external terminal T (i+1) and the application terminal of the positive power-supply voltage VDD. Accordingly, by devising a layout of the transistor A3' (*j*), it is possible to use the body diode A5' (*j*) that is parasitic in this as an electrostatic discharge protection diode (positive surge protection element) for the second external terminal T (i+1). Here, because the layout of the transistor A3' (*j*) is the same as the transistor A3 (*j*), detailed description is skipped.

Besides, between the source and the back gate of the transistor B3' (*j*) added in the present embodiment, a body diode B5' (*j*) is parasitic. A cathode of the body diode B5' (*j*) is connected to the source of the transistor B3' (*j*). An anode of the body diode B5' (*j*) is connected to the back gate of the transistor B3' (j). In other words, the body diode B5' (*j*) is connected between the second external terminal T (i+1) and the application terminal of the negative power-supply voltage VEE. Accordingly, by devising a layout of the transistor B3' (*j*), it is possible to use the body diode B5' (*j*) that is parasitic in this as an electrostatic discharge protection diode (negative surge protection element) for the second external terminal T (i+1). Here, because the layout of the transistor B3' (*j*) is the same as the transistor B3 (*j*), detailed description is skipped.

In the liquid crystal drive apparatus b1' having the above structure is so structured as to perform polarity inversion control of the output signal O (i+1) that is applied from the second external terminal T (i+1) to the liquid crystal element by means of polarity which is inverse to the output signal O (i) applied from the first external terminal T (i+1) to the liquid crystal element by, in a complementary manner, turning on/off the transistor A3 (*j*) and the transistor A3' (*j*), and the transistor B3 (*j*) and the transistor B3' (*j*).

For example, in the first frame, an image signal to be output from the first external terminal T (i) is input into the digital/analog converter A1 (*j*) as the input signal IA (j); an image signal to be output from the second external terminal T (i+1) is input into the digital/analog converter B1 (*j*) as the input signal IB (j).

Besides, in the above first frame, the transistors A3 (*j*) and B3' (*j*) are turned on; and the transistors A3' (*j*) and B3 (*j*) are turned off.

According to such switching control, in the first frame, as the output signal O (i) that is output to the liquid crystal element from the first external terminal T (i), the positive-polarity analog signal generated by the source amplifier A2 (*j*) is selected; as the output signal O (i+1) that is output to the liquid crystal element from the second external terminal T (i+1), the negative-polarity analog signal generated by the source amplifier B2 (*j*) is selected.

Next, in the second frame that follows the first frame, an image signal to be output from the first external terminal T (i) is input into the digital/analog converter B1 (*j*) as the input signal IB (j); an image signal to be output from the second external terminal T (i+1) is input into the digital/analog converter A1 (*j*) as the input signal IA (j).

Besides, in the above second frame, the second transistors A3 (*j*) and B3' (j) are turned off; and the transistors A3' (*j*) and B3 (*j*) are turned on.

According to such switching control, in the above second frame, as the output signal O (i) that is output to the liquid crystal element from the first external terminal T (i), the negative-polarity analog signal generated by the source amplifier B2 (*j*) is selected; as the output signal O (i+1) that is output to the liquid crystal element from the second external terminal T (i+1), the positive-polarity analog signal generated by the source amplifier A2 (*j*) is selected.

As described above, according to the liquid crystal drive apparatus b1' in the second embodiment, it is possible to share a set of the positive-polarity circuit (A1 (*j*) to A5 (*j*)) and the negative-polarity circuit (B1 (*j*) to B5 (*j*)) between the first external terminal T (i) and the second external terminal T (i+1) that are adjacent to each other, so that it becomes possible to contribute to size reduction (chip-area reduction) of the liquid crystal drive apparatus b1'.

Here, the structure having the second technical feature is able to be modified in various ways without departing from the spirit besides the above embodiment.

For example, in the above embodiment, the structure is described as an example, in which the positive power-supply voltage VDD is used as the first power-supply voltage; the negative power-supply voltage VEE is used as the second power-supply voltage; and the ground voltage GND is used as the reference voltage; however, the structure of the second technical feature is not limited to this.

Besides, in the above embodiment, the structure is described as an example, in which as a means to drive the TFT-type liquid crystal display panel, the liquid crystal drive apparatus having the second technical feature is used; however, the application of the second technical feature is not limited to this, and for example, also as a means to drive an STN (Super Twisted Nematic) type liquid crystal display panel, it is possible to preferably use the liquid crystal drive apparatus having the second technical feature.

(Third Technical Feature)

The third technical feature described hereinafter relates to a power-supply circuit and to a liquid crystal drive apparatus that uses the power-supply circuit.

Here, with reference to the above figures, the third technical feature relates to the source driver circuit xA3 in FIG. 28; more specifically, the third technical feature relates to the LCD power-supply circuit xB19 in FIG. 29 and its peripheral circuits.

Figure 16:
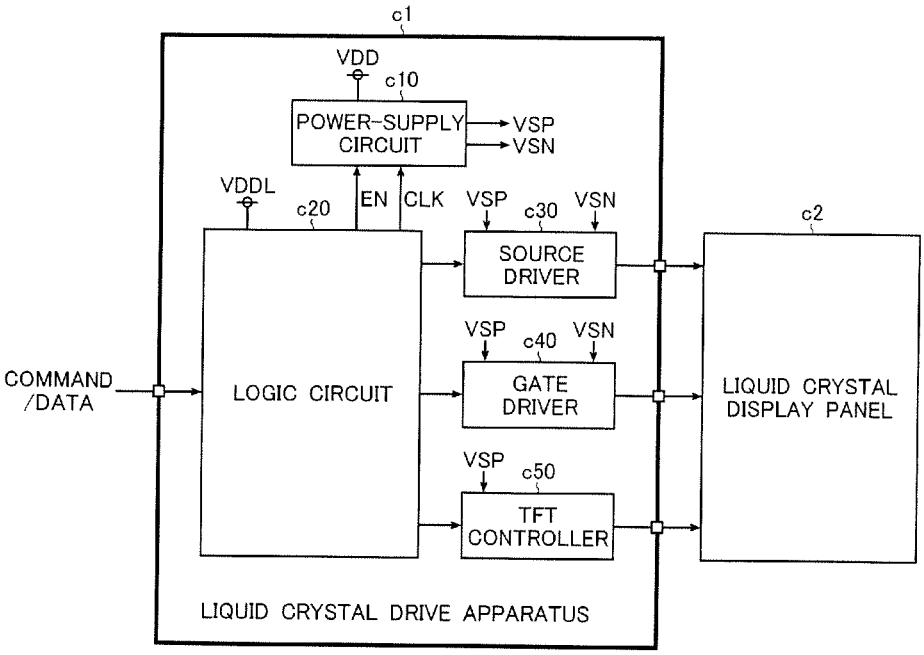
FIG. 16 is a block diagram showing a structural example of a liquid crystal display apparatus having a third technical feature.

FIG. 16 is a block diagram showing a structural example of a liquid crystal display apparatus having the third technical feature. As shown in FIG. 16, the liquid crystal display apparatus in the present structural example has: a liquid crystal drive apparatus c1; and a TFT (Thin Film Transistor) type liquid crystal display panel c2.

The liquid crystal drive apparatus c1 is a semiconductor integrated circuit apparatus that performs drive control of the liquid crystal display panel c2 based on a command and data that are input from a not-shown host apparatus (microcomputer and the like); and for example, has: a power-supply circuit c10; a logic circuit c20; a source driver c30; a gate driver c40; and a TFT controller c50.

The power-supply circuit c10 is supplied with the power-supply voltage VDD to operate, and generates a predetermined positive step-up voltage VSP and a negative step-up voltage VSN. Here, operation and an internal structure of the power-supply circuit c10 are described in detail later.

The logic circuit c20 is supplied with the logic power-supply voltage VDD to operate; and based on a command and data that are input from the host apparatus, performs comprehensive control of each portion of the liquid crystal drive apparatus c1. Especially, for the power-supply circuit c10, the logic circuit c20 functions as a main portion that transmits an enable signal EN and a clock signal CLK.

The source driver c30 is supplied with the positive step-up voltage VSP and the negative step-up voltage VSN to operate; converts a digital image signal input from the logic circuit c20 into an analog image signal; and supplies it to each pixel (more precisely, a source terminal of an active element that is connected to each pixel of the liquid crystal display panel c2) of the liquid crystal display panel c2. Here, the source driver c30 is so structured as to, in driving the liquid crystal display panel c2, perform polarity inversion control of a source signal applied to the liquid crystal element. According to such a structure, because a unidirectional voltage is not continued to be applied to the liquid crystal element, it becomes possible to curb deterioration of the liquid crystal element.

The gate driver c40 is supplied with the positive step-up voltage VSP and the negative step-up voltage VSN to operate; generates a vertical scan signal for the liquid crystal display panel c2 based on a synchronization signal input from the logic circuit c20; and supplies it to each pixel (more precisely, a gate terminal of the active element that is connected to each pixel of the liquid crystal display panel c2) of the liquid crystal display panel c2.

The TFT controller c50, based on a synchronization signal input from the logic circuit c20, generates control signals for circuit elements (a multiplexer that further distributes a plurality of source signals input from the liquid crystal drive apparatus c1 and the like to a plurality of systems).

The liquid crystal display panel c2 is an image output means that uses a plurality of columns of liquid crystal elements as the pixels whose light transmission factors change in accordance with a voltage value of a source signal input from the liquid crystal drive apparatus c1.

Figure 17:
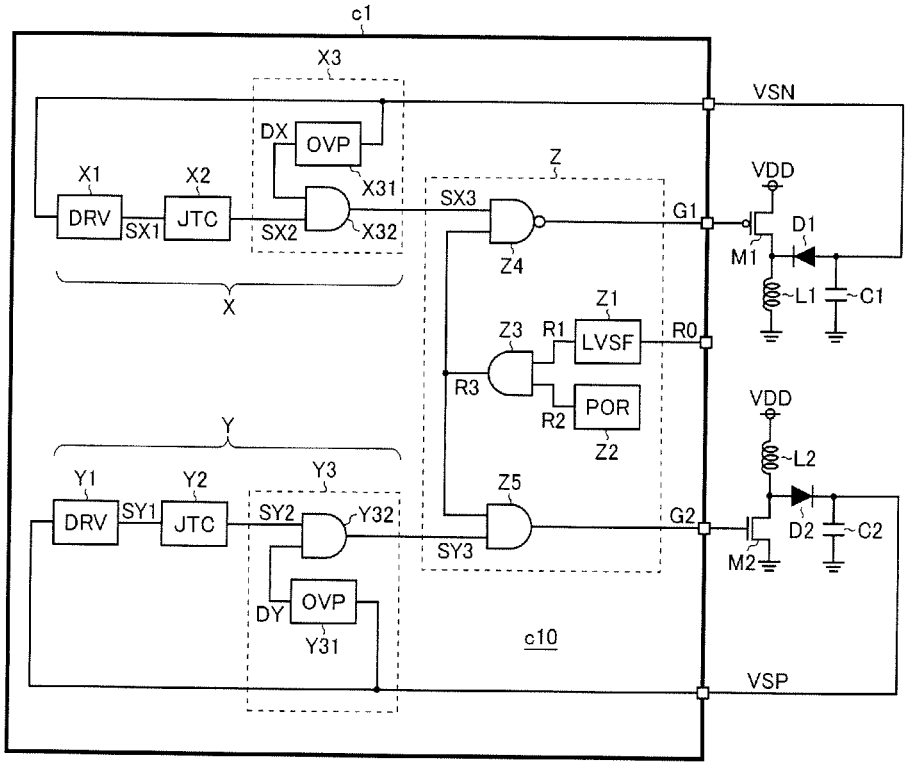
FIG. 17 is a circuit block diagram showing a structural example of a power-supply circuit c10.

FIG. 17 is a circuit block diagram showing a structural example of the power-supply circuit c10. The power-supply circuit c10 in the present structural example has: a first feedback control circuit X; a second feedback control circuit Y; and a reset circuit Z. Here, as discrete components that form a switching regulator, output transistors M1 and M2, inductors L1 and L2, diodes D1 and D2, and capacitors C1 and C2 are externally connected to the power-supply circuit c10.

A source of the output transistor M1 (P-channel type MOS (Metal Oxide Semiconductor) field effect transistor) is connected to the input terminal of the power-supply voltage VDD. A drain of the output transistor M1 is connected to a first terminal of the inductor L1 and to a cathode of the diode D1. A gate of the output transistor M1 is connected to an output terminal (output terminal of a NOT-AND calculator Z4 described later) of a first gate signal G1. A second terminal of the inductor L1 is connected to a ground terminal. An anode of the diode D1 is connected to an output terminal of the negative step-up voltage VSN and to a first terminal of the capacitor C1. A second terminal of the capacitor C1 is connected to the ground terminal.

When the output transistor M1 is brought to an on state, a switch current flows into the inductor M1 from the input terminal of the power-supply voltage VDD to the ground terminal via the output transistor M1, so that the electric energy is accumulated in the inductor L1. At this time, because the diode D1 that is a synchronization rectification element goes to a reverse-bias state, an electric current does not flow from the capacitor C1 into the output transistor M1. On the other hand, when the transistor M1 is brought to an off state, the electric energy accumulated in the inductor L1 is discharged by a counter electromotive voltage generated across the inductor L1. At this time, because the diode D1 goes to a forward-bias state, an electric current is drawn from the ground terminal via the capacitor C1. The above on/off operation of the above output transistor M1 is repeated, so that it is possible to output the negative step-up voltage VSN from the first terminal of the capacitor C1.

A drain of the output transistor M2 (N-channel type MOS field effect transistor) is connected to a first terminal of the inductor L2 and to an anode of the diode D2. A source of the output transistor M2 is connected to the ground terminal. A gate of the output transistor M2 is connected to an output terminal (output terminal of an AND calculator Z5 described later) of a second gate signal G2. A second terminal of the inductor L2 is connected to the input terminal of the power-supply voltage VDD. A cathode of the diode D2 is connected to an output terminal of the positive step-up voltage VSP and to a first terminal of the capacitor C2. A second terminal of the capacitor C2 is connected to the ground terminal.

When the output transistor M2 is brought to an on state, a switch current flows into the inductor M2 from the input terminal of the power-supply voltage VDD to the ground terminal via the output transistor M2, so that the electric energy is accumulated in the inductor L2. At this time, because the diode D2 that is a synchronization rectification element goes to a reverse-bias state, an electric current does not flow from the capacitor C2 into the output transistor M2. On the other hand, when the transistor M2 is brought to an off state, the electric energy accumulated in the inductor L2 is discharged by a counter electromotive voltage generated across the inductor L2. At this time, because the diode D2 goes to a forward-bias state, an electric current is flown into the ground terminal via the capacitor C2. The above on/off operation of the output transistor M2 is repeated, so that it is possible to output the positive step-up voltage VSP from the first terminal of the capacitor C2.

The first feedback control circuit X is a circuit block that generates a feedback control signal SX3 for the output transistor M1 in such a way that a desired negative step-up voltage VSN is generated from the power-supply voltage VDD; and for example, has: a drive control portion X1; a jitter cancel portion X2; and an overvoltage protection portion X3.

The drive control portion X1 performs PWM (Pulse Width Modulation) control of the feedback control signal SX1 in such a way that the negative step-up voltage VSN fed back matches a predetermined target value. Here, operation and an internal structure of the drive control portion X1 are described in detail later.

The jitter cancel portion X2 applies a cancel process to a jitter component and a chattering component of the feedback control signal SX1 to output a feedback control signal SX2 that has undergone the jitter cancel process. Here, operation and an internal structure of the jitter cancel portion X2 are described in detail later.

The overvoltage protection portion X3 is a circuit block that monitors the negative step-up voltage VSN to perform an overvoltage protection operation; and for example, has: an overvoltage detection circuit X31; and an AND calculator X32. An input terminal of the overvoltage detection circuit X31 is connected to the input terminal of the negative step-up voltage VSN. An output terminal of the overvoltage detection circuit X31 is connected to a first input terminal of the AND calculator X32. A second terminal of the AND calculator X32 is connected to an output terminal of the jitter cancel portion X2. An output terminal of the AND calculator X32 is, as a final output terminal of the feedback control signal SX3, connected to a first input terminal (second input terminal of a NOT-AND calculator Z4 described later) of the reset circuit Z. Here, operation and an internal structure of the overvoltage detection circuit X31 are described in detail later.

The second feedback control circuit Y is a circuit block that generates a feedback control signal SY3 for the output transistor M2 in such a way that a desired positive step-up voltage VSP is generated from the power-supply voltage VDD; and for example, has: a drive control portion Y1; a jitter cancel portion Y2; and an overvoltage protection portion Y3.

The drive control portion Y1 performs PWM control of the feedback control signal SY1 in such a way that the positive step-up voltage VSP fed back matches a predetermined target value. Here, operation and an internal structure of the drive control portion Y1 are described in detail later.

The jitter cancel portion Y2 applies a cancel process to a jitter component and a chattering component of the feedback control signal SY1 to output a feedback control signal SY2 that has undergone the jitter cancel process. Here, operation and an internal structure of the jitter cancel portion Y2 are described in detail later.

The overvoltage protection portion Y3 is a circuit block that monitors the positive step-up voltage VSP to perform an overvoltage protection operation; and for example, has: an overvoltage detection circuit Y31; and an AND calculator Y32. An input terminal of the overvoltage detection circuit Y31 is connected to the input terminal of the positive step-up voltage VSP. An output terminal of the overvoltage detection circuit Y31 is connected to a first input terminal of the AND calculator Y32. A second input terminal of the AND calculator Y32 is connected to an output terminal of the jitter cancel portion Y2. An output terminal of the AND calculator Y32 is, as a final output terminal of the feedback control signal SY3, connected to a second input terminal (second input terminal of an AND calculator Z5 described later) of the reset circuit Z. Here, operation and an internal structure of the overvoltage detection circuit Y31 are described in detail later.

The reset circuit Z is a circuit block that forcibly keeps the output transistors M1 and M2 in the off state from at least a turning-on time of the power-supply circuit c10 to a time a predetermined period T elapses; and for example, has: a level shifter Z1; a power on reset portion Z2; an internal reset signal generation portion (AND calculator) Z3; a NOT-AND calculator Z4; and an AND calculator Z5.

An input terminal of the level shifter Z1 is connected to an external terminal into which the external reset signal R0 is input. An output terminal of the level shifter Z1 is connected to a first input terminal of the internal reset signal generation portion Z3. An output terminal of the power on reset portion Z2 is connected to a second input terminal of the internal reset signal generation portion Z3. An output terminal of the internal reset signal generation portion Z3 is connected to a first input terminal of the NOT-AND calculator Z4 and to a first input terminal of the AND calculator Z5. A second input terminal of the NOT-AND calculator 24 is connected to an output terminal (output terminal of the AND calculator X32) of the first feedback control circuit X. An output terminal of the NOT-AND calculator Z4 is, as the output terminal of the first gate signal G1, connected to the gate of the output transistor M1. A second input terminal of the AND calculator Z5 is connected to an output terminal (output terminal of the AND calculator Y32) of the second feedback control circuit Y. An output terminal of the AND calculator Z5 is, as the output terminal of the second gate signal G2, connected to the gate of the gate of the output transistor M2

The level shifter Z1 converts the external reset signal R0 into a suitable voltage level (voltage level suitable for an input into the internal reset signal generation portion Z3) to generate an external reset signal R1 that has undergone the level shifting.

The power on reset portion circuit Z2 generates a power on reset signal R2 that keeps a low level (reset logic) from at least a turning-on time of the power-supply circuit c10 to a time the predetermined period T elapses. Here, operation and an internal structure of the power on reset portion Z2 are described in detail later.

The internal reset signal generation portion Z3 calculates a logical product of the external reset signal R1 that has undergone the level shifting and the power on reset signal R2, thereby generating an internal reset signal R3. In other words, when at least one of the external reset signal R1 that has undergone the level shifting and the power on reset signal R2 is at the low level (reset logic), the internal reset signal R3 goes to the low level (reset logic); only when both of them are at the high level (reset release logic), the internal reset signal R3 goes to the high level (reset release logic).

The NOT-AND calculator Z4 calculates a logical product of the internal reset signal R3 and the feedback control signal SX3 input from the first feedback control circuit X, thereby generating the first gate signal G1. In other words, when at least one of the feedback control signal SX3 and the internal reset signal R3 is at the low level, the first gate signal G1 goes to the high level (output prohibition logic); only when both of them are at the high level, the first gate signal G1 goes to the low level (output permission logic).

The AND calculator Z5 calculates a logical product of the internal reset signal R3 and the feedback control signal SY3 input from the second feedback control circuit Y, thereby generating the second gate signal G2. In other words, when at least one of the feedback control signal SY3 and the internal reset signal R3 is at the low level, the second gate signal G2 goes to the low level (output prohibition logic); only when both of them are at the high level, the second gate signal G1 goes to the high level (output permission logic).

As descried above, the reset circuit Z has a structure in which when the internal reset signal R3 is at the low level (reset logic), the reset circuit Z prohibits the on/off control of the output transistors M1 and M2 in accordance with the feedback control signals SX3 and SY3 to forcibly bring the output transistors M1 and M2 to the off state; on the other hand, when the internal reset signal R3 is at the high level (reset release logic), the reset circuit Z permits the on/off control of the output transistors M1 and M2 in accordance with the feedback control signals SX3 and SY3.

In more detail, the reset circuit Z has a structure in which when the power on reset signal R2 is at the low level (reset logic), the reset circuit Z prohibits the on/off control of the output transistors M1 and M2 in accordance with the feedback control signals SX3 and SY3 to forcibly bring the output transistors M1 and M2 to the off state.

According to the employment of such a structure, not only in a case where the external reset signal R0 is at the low level (reset logic) but also in a case where the external reset signal R0 is at the high level (reset release logic), it is possible to forcibly keep the output transistors M1 and M2 in the off state based on the power on reset signal R2 from at least the turning-on time of the power-supply circuit c10 to the time the predetermined period T elapses, so that even if the feedback control signals SX3 and SY3 are in indeterminate logic states, it becomes possible to nip occurrence of an unintentional overcurrent in the bud.

Besides, in the power-supply circuit c10 in the present structural example, the reset circuit Z is shared by the first feedback control circuit X and the second feedback control circuit Y. According to such a structure, even in a case where a plurality of systems of output voltages (in the present structural example, the two systems of the positive step-up voltage VSP and the negative step-up voltage VSN), it is not necessary to dispose a plurality of the reset circuits Z, which does not unnecessarily increase the circuit size and is able to contribute to size and cost reductions of the chip.

Figure 18:
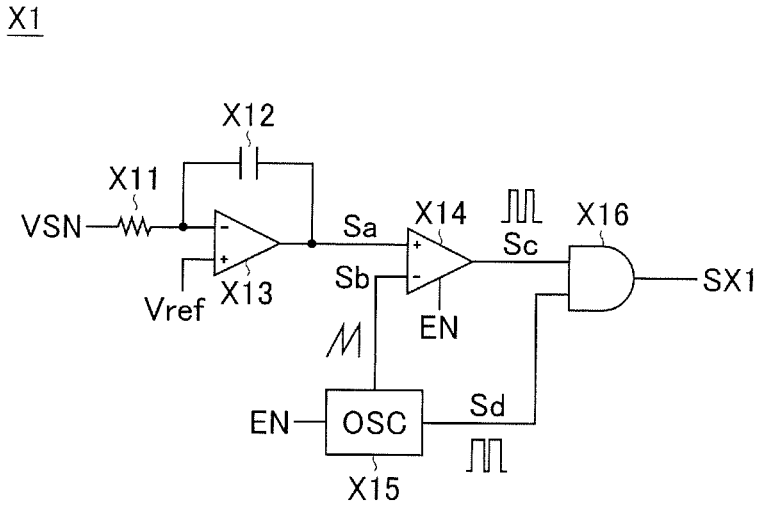
FIG. 18 is a circuit block diagram showing a structural example of a drive control portion X1.

FIG. 18 is a circuit block diagram showing a structural example of the drive control portion X1. The drive control portion X1 in the present structural example has: a resistor X11; a capacitor X12; an operational amplifier X13; a comparator X14; an oscillator X15; and an AND calculator X16. Here, the drive control portion Y1 includes the same structure as the drive control portion X1, with the "X" in the reference number replaced with the "Y," and the "negative step-up voltage VSN" replaced with the "positive step-up voltage VSP"; accordingly, double description is skipped.

A first terminal of the resistor X11 is connected to the input terminal of the negative step-up voltage VSN. A second terminal of the resistor X11 is connected to a first terminal of the capacitor X12 and to an inverting input terminal (−) of the operational amplifier X13. A non-inverting input terminal (+) of the operational amplifier X13 is connected to an input terminal of the reference voltage Vref. An output terminal (output terminal of an error signal Sa) of the operational amplifier X13 is connected to a second terminal of the capacitor X12 and to a non-inverting input terminal (+) of the comparator X14. An inverting input terminal (−) of the comparator X14 is connected to a first output terminal (output terminal of a triangular-wave signal Sb) of the oscillator X15. An output terminal (output terminal of a PWM signal Sc) of the comparator X14 is connected to a first input terminal of an AND calculator Z16. A second input terminal of the AND calculator Z16 is connected to a second output terminal (output terminal of a maximum duty pulse signal Sd) of the oscillator X15. An output terminal of the AND calculator X16 is, as the output terminal of the feedback control signal SX1, connected to an input terminal of the jitter cancel portion X2 (see FIG. 17). Here, the enable signal EN is input into the above comparators X14 and X15 from the not-shown logic circuit c20, so that the operation of the comparators X14 and X15 is controlled.

Figure 19:
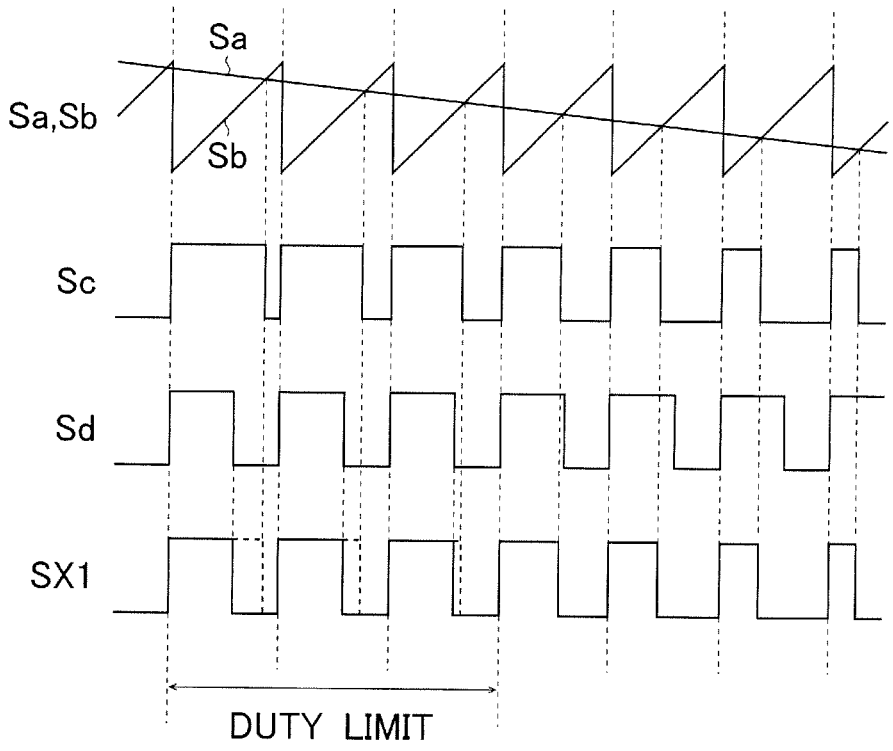
FIG. 19 is a timing chart for describing operation of the drive control portion X1.

FIG. 19 is a timing chart for describing operation of the drive control portion X1; and in order from the top, represents: the error signal Sa; the triangular-wave signal Sb; the PWM signal Sc; the maximum duty pulse signal Sd; and the feedback control signal SX1.

The operational amplifier X13 amplifies a difference between the negative step-up voltage VSN and the reference voltage Vref (which corresponds to a target value of the negative step-up voltage VSN) to generate the error signal Sa. In other words, a voltage level of the error signal Sa changes in accordance with a difference degree from the target value of the negative step-up voltage VSN. More specifically, the more distant the negative step-up voltage VSN is from the target value, the higher the voltage level of the error signal Sa becomes.

The oscillator X15 generates the triangular-wave signal Sb and the maximum duty pulse signal Sd that have a predetermined oscillation frequency. Here, the triangular-wave signal Sb is applied to the second input terminal of the comparator X14; the maximum duty pulse signal Sd is applied to the second input terminal of the AND calculator X16.

The comparator X14 compares the error signal Sa and the triangular-wave signal Sb with each other to generate the PWM signal Sc. In other words, an on duty (the ratio of an on period of the output transistor M1 to unit time) of the PWM signal Sc changes in accordance with a relative height between the error signal Sa and the triangular-wave signal Sb. Specifically, the more distant the negative step-up voltage VSN is from the target value, the larger the on duty (high-level period in FIG. 19) of the PWM signal Sc becomes; as the negative step-up voltage VSN comes closer to the target value, the on duty of the PWM signal Sc becomes smaller. By performing the on/off control of the output transistor M1 based on the PWM signal Sc, it is possible to make the negative step-up voltage VSN match the target value.

Here, the AND calculator X16 calculates a logical product of the PWM signal Sc and the maximum duty pulse signal Sd to generate the feedback control signal SX1. In other words, when at least one of the PWM signal Sc and the maximum duty pulse signal Sd is at the low level, the feedback control signal SX1 goes to the low level; only when both of them are at the high level, the feedback control signal SX1 goes to the high level. According to such a structure, it is possible to limit the maximum duty of the feedback control signal SX1, so that it becomes possible to easily achieve soft-start control at the turning-on time of the power supply.

Figure 20:
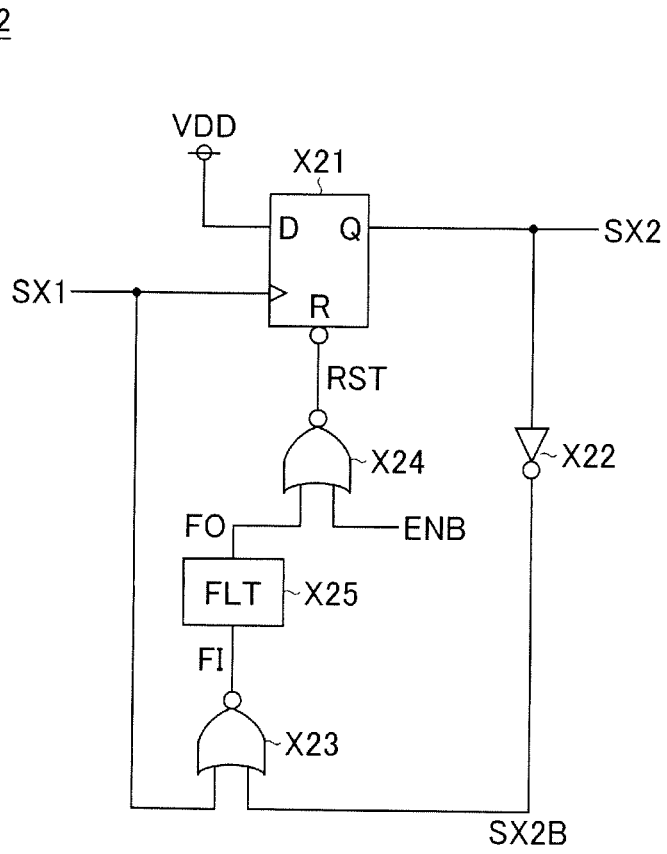
FIG. 20 is a circuit block diagram showing a structural example of a jitter cancel portion X2.

FIG. 20 is a circuit block diagram showing a structural example of the jitter cancel portion X2. The jitter cancel portion X2 in the present structural example has: a D flip-flop X21; an inverter X22; NOT-OR calculators X23 and X24; and a filter circuit X25.

A data terminal of the D flip-flop X21 is connected to the input terminal of the power-supply voltage VDD. A clock terminal of the D flip-flop X21 is connected to an input terminal of the feedback control signal SX1. An output terminal of the D flip-flop X21 is connected to an output terminal of the feedback control signal SX2 that has undergone the jitter cancel process and to an input terminal of the inverter X22. An output terminal (output terminal of an inversion feedback control signal SX2B) of the inverter X22 is connected to a first input terminal of the NOT-OR calculator X23. A second input terminal of the NOT-OR calculator X23 is connected to the input terminal of the feedback control signal SX1. An output terminal of the NOT-OR calculator X23 is connected to an input terminal of the filter circuit X25. An output terminal of the filter circuit X25 is connected to a first input terminal of the NOT-OR calculator X24. A second input terminal of the NOT-OR calculator X24 is connected to an input terminal of an inverted enable signal ENB (logic inverted signal of the enable signal EN). An output terminal of the NOT-OR calculator X24 is connected to a reset terminal of the D flip-flop X21.

Figure 21:
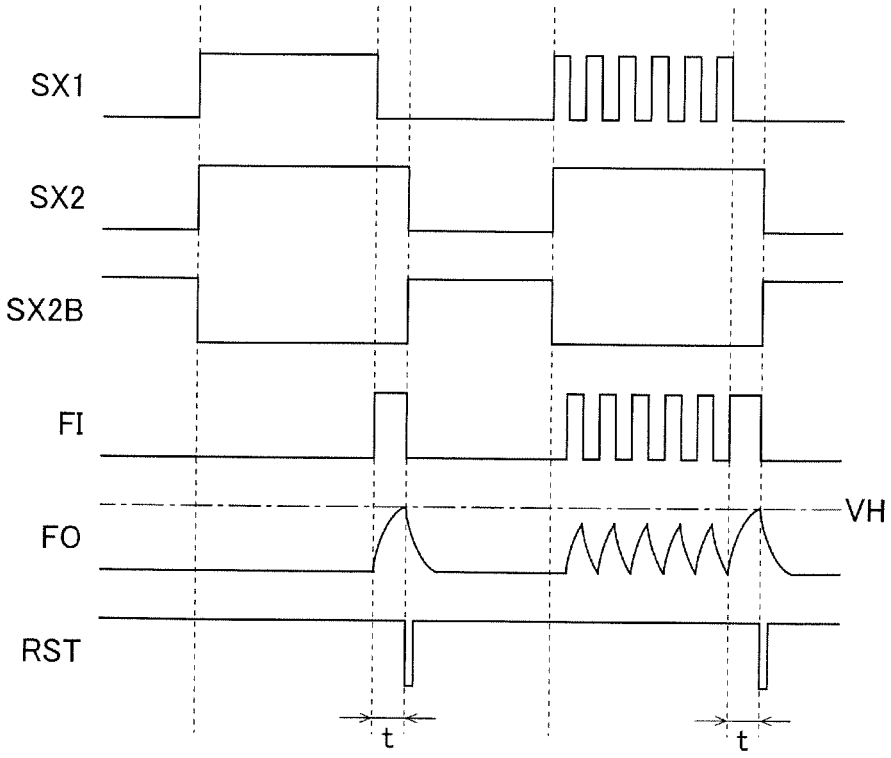
FIG. 21 is a timing chart for describing operation of the jitter cancel portion X2.

FIG. 21 is a timing chart for describing operation of the jitter cancel portion X2 having the above structure; and in order from the top, represents: the feedback control signal SX1; the feedback control signal SX2 that has undergone the jitter cancel process; the inverted feedback control signal SX2B; a filter input signal FI; a filter output signal FO; and a reset signal RST. Here, although not shown in the figure, the inverted enable signal ENB is kept at a low level (enable logic).

The feedback control signal SX2 that has undergone the jitter cancel process rises to a high level by using a rising edge of the feedback control signal SX1 as a trigger, while falls to a low level by using a falling edge of the reset signal RST as a trigger. The reset signal RST is a NOT-OR signal of the inverted enable signal ENB and the filter output signal FO; when the inverted enable signal ENB is kept at the low level, the reset signal RST falls to the low level at a time the filter output signal FO reaches a predetermined high-level potential VH (threshold potential that is recognized as a high level by the NOT-OR calculator X24). The filter output signal FO reaches the high-level potential VH in a predetermined time t (which depends on a time constant of the filter circuit X25) after a rising time of the filter input signal FI. However, in a case where the filter input signal FI falls to the low level before the predetermined time t elapses after the rising time, the filter output signal FO falls to the low level again without reaching the predetermined high-level potential VH. The filter input signal FI is a NOT-OR signal of the feedback control signal SX1 and the inverted feedback control signal SX2B; if both of the feedback control signal SX1 and the inverted feedback control signal SX2B are at the low level, the filter input signal FI goes to the high level, otherwise goes to the low level.

By means of the above series of operations, it becomes possible to apply the jitter cancel process to the feedback control signal SX1. For example, in FIG. 21 shows a state in which during the feedback control signal SX2 that has undergone the jitter cancel process, the chattering of the feedback control signal SX1 is removed.

Here, in FIG. 21, it looks as if the duty changes considerably between the feedback control signal SX1 and the feedback control signal SX2 that has undergone the jitter cancel process; however, this is for a simple illustration, and the actual predetermined period t is so set at a short time as not to affect the duty.

Figure 22:
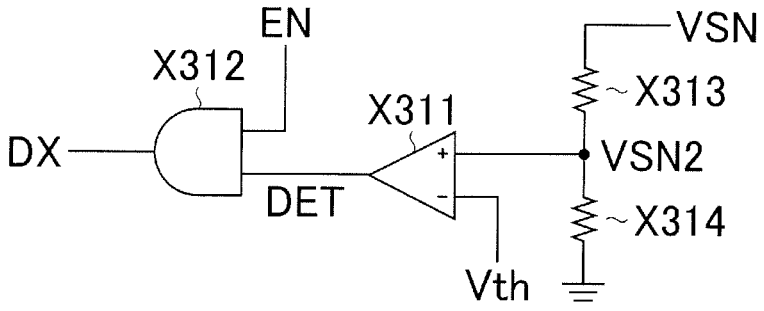
FIG. 22 is a circuit block diagram showing a structural example of an overvoltage detection circuit X31.

FIG. 22 is a circuit block diagram showing a structural example of the overvoltage detection circuit X31. The overvoltage detection circuit X31 in the present structural example has: a comparator X311; an AND calculator X312; resistors X313 and X314. Here, the overvoltage detection circuit Y31 includes the same structure as the overvoltage detection circuit X31, with the "X" in the reference number replaced with the "Y," and the "negative step-up voltage VSN" replaced with the "positive step-up voltage VSP"; accordingly, double description is skipped.

A first terminal of the resistor X313 is connected to the input terminal of the negative step-up voltage VSN. A second terminal of the resistor X313 is connected to a first terminal of the resistor X314. A second terminal of the resistor X314 is connected to a ground terminal. A non-inverting input terminal (+) of the comparator X311 is connected to a second terminal of the resistor X313 and to a connection node (application terminal of a divided voltage of the negative step-up voltage VSN) of the first terminal of the resistor 314. An inverting terminal (−) of the comparator X311 is connected to an input terminal of a predetermined threshold voltage Vth. An output terminal (output terminal of an overvoltage detection signal DET) of the comparator X311 is connected to a first input terminal of the AND calculator X312. A second input terminal of the AND calculator X312 is connected to the input terminal of the enable signal EN. An output terminal (output terminal of an overvoltage protection signal DX) is connected to the first input terminal of not-shown AND calculator X32 (see FIG. 17).

In the overvoltage detection circuit X31 having the above structure, in a case where the negative step-up voltage VSN (more precisely, a divided voltage thereof) becomes larger than the predetermined threshold voltage Vth in absolute value, the overvoltage detection signal DET output from the comparator X311 falls from a high level to a low level. On the other hand, the overvoltage protection signal DX output from the AND calculator X312 is a logical product signal of the overvoltage detection signal DET and the enable signal EN; the overvoltage protection signal DX goes to the low level when at least one of the overvoltage detection signal DET and the enable signal EN is at the low level; and goes to the high level only when both of them are at the high level.

Accordingly, when the negative step-up voltage VSN goes to an overvoltage state and the overvoltage detection signal DET falls from the high level to the low level, the overvoltage protection signal DX also falls to the low level, so that the final feedback control signal SX3 output from the AND calculator X32 (see FIG. 17) is brought down to the low level without depending on the feedback control signal SX2 that has undergone the jitter cancel process. As a result of this, by fixing the gate signal G1 of the output transistor M1 at the high level, it is possible to forcibly bring the output transistor M1 to the off state, so that it becomes possible to stop the output operation of the negative step-up voltage VSN without delay.

Figure 23:
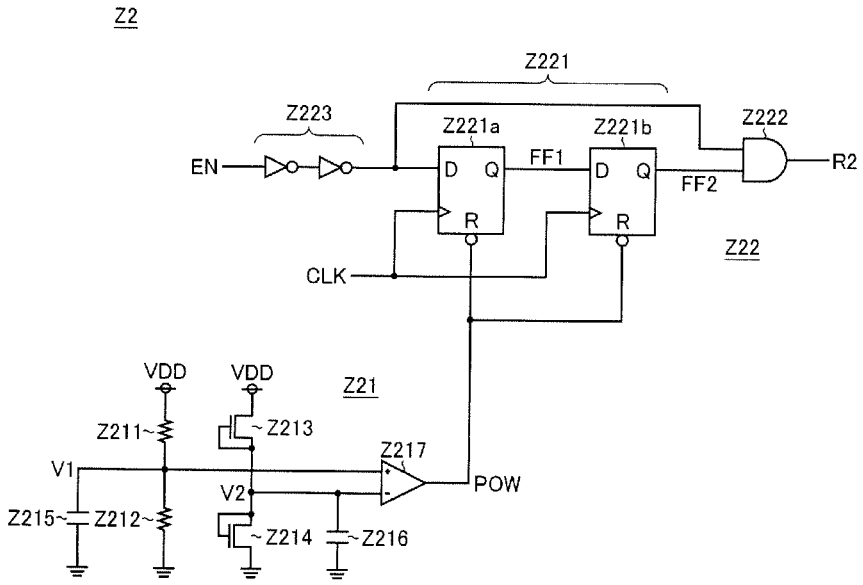
FIG. 23 is a circuit block diagram showing a structural example of a power on reset portion Z2.

FIG. 23 is a circuit block diagram showing a structural example of the power on reset portion Z2. The power on reset portion Z2 in the present structural example has: a power-supply monitor portion Z21; a power on reset signal generation portion Z22.

The power-supply monitor portion Z21 is a circuit portion that generates a power-supply monitor signal POW which indicates whether the predetermined period T elapses from the turning-on time of the power-supply circuit c10 or not; and has: resistors Z211 and Z212; N-channel type MOS field effect transistors Z213 and Z214; capacitors Z215 and Z216; and a comparator Z217. Here, the transistors Z213 and Z214 are of a depletion type that flows an electric current between the drain and the source even when the voltage across the gate and the source is zero.

A first terminal of the resistor Z211 is connected to the input terminal of the power-supply voltage VDD. A second terminal of the resistor Z211 is connected to a first terminal of the resistor Z212 and to a first terminal of the capacitor Z215. A first node voltage V1 appears at this node. A second terminal of the resistor Z212 and a second terminal of the capacitor Z215 are all connected to a ground terminal. A drain of the transistor Z213 is connected to the input terminal of the power-supply voltage VDD. A source and a gate of the transistor Z213 are connected to a source and a gate of the transistor Z214 and to a first terminal of the capacitor Z216. A second node voltage V2 appears at this node. A drain of the Z214 and a second terminal of the capacitor Z216 are all connected to the ground terminal. A non-inverting input terminal (+) of the comparator Z217 is connected to an application terminal of the first node voltage V1. An inverting terminal (−) of the comparator Z217 is connected to an application terminal of the second node voltage V2. An output terminal of the comparator Z217 is connected to an output terminal of the power-supply monitor signal POW.

The power on reset signal generation portion Z22 is a circuit portion that before elapse of the predetermined period T, keeps the power on reset signal R2 at the low level (reset logic) in accordance with the power-supply monitor signal POW; on the other hand, after elapse of the predetermined period T, controls the reset release of the power on reset signal R2 in accordance with the enable signal EN that controls the operation of the first feedback control circuit X and the second feedback control circuit Y; and has: a latch portion Z221; an AND calculator Z222; and a buffer Z223.

The latch portion Z221 is a circuit portion which fetches the enable signal EN as a latch signal at every pulse of the clock signal CLK and in which before elapse of the predetermined period T, latch output signals FF1 and FF2 are reset to the low level (disable logic) in accordance with the power-supply monitor signal POW; and includes a plurality of D flip-flops Z221*a* and Z221*b* connected in a tandem manner.

The AND calculator Z222 is a logic gate that generates the power on reset signal R2 which goes to the low level (reset logic) when at least one of the enable signal EN and the latch output signal FF2 is at the low level (disable logic); and goes to the high level (reset release logic) only when both of them are at the high level (enable logic).

An input terminal of the buffer Z223 is connected to the input terminal of the enable signal EN. An output terminal of the buffer Z223 is connected to a data terminal of the D flip-flop Z221*a* and to a first input terminal of the AND calculator Z222. An output terminal of the D flip-flop Z221*a* is connected to a data terminal of the D flip-flop Z221*b*. An output terminal of the D flip-flop Z221*b* is connected to a second input terminal of the AND calculator Z222. Clock terminals of the D flip-flops Z221*a* and Z221*b* are all connected to an input terminal of the clock signal CLK. Reset terminals of the D flip-flops Z221*a* and Z221*b* are all connected to an input terminal of the power-supply monitor signal POW. An output terminal of the AND calculator Z222 is connected to the output terminal of the power on reset signal R2.

Figure 24:
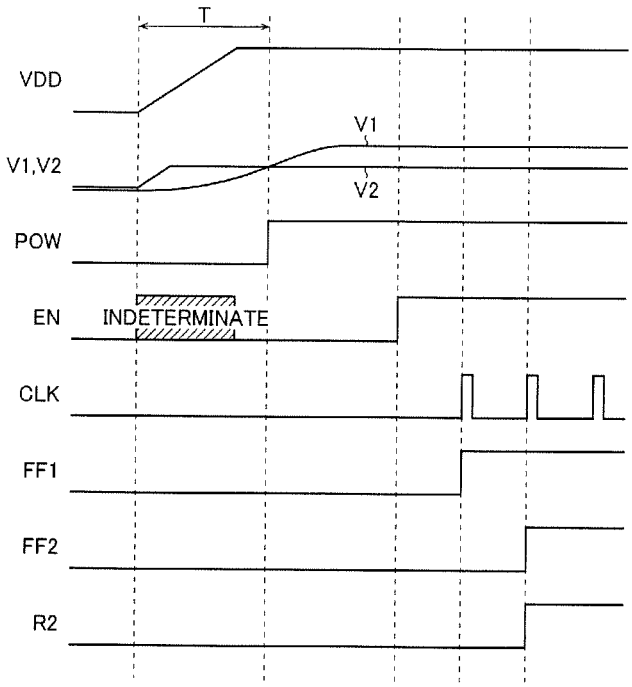
FIG. 24 is a timing chart for describing operation of the power on reset portion Z2.

FIG. 24 is a timing chart for describing operation of the power on reset portion Z2 having the above structure; and in order from the top, represents: the power-supply voltage VDD; the first node voltage V1; the second node voltage V2; the power-supply monitor signal POW; the enable signal EN; the clock signal CLK; the first latch output signal FF1; the second latch output signal FF2; and the power on reset signal R2.

After the power-supply voltage VDD is applied to the power-supply circuit c10, the first node voltage V1 slowly rises in accordance with a time constant of an RC circuit that includes the resistors Z211, Z212 and the capacitor Z215. On the other hand, the second node voltage V2 starts to rise in the same way of behavior as the power-supply voltage VDD and is clamped at a predetermined value (e.g, 0.6 V). The comparator Z217 compares the first node voltage V1 and the second node voltage V2 with each other to generate the power-supply monitor signal POW. During a time the first node voltage V1 is lower than the second node voltage V2, the power-supply monitor signal POW is kept at the low level. On the other hand, when the predetermined period T elapses after the power-supply voltage VDD is applied to the power-supply circuit c10; and the first node voltage V1 becomes higher than the second node voltage V2, the power-supply monitor signal POW is shifted from the low level to the high level. As described above, the power-supply monitor portion Z21 has a circuit structure not to depend on the logic portion c20 (main control portion of the first feedback control circuit X and the second feedback control circuit Y), so that even if the operation of the logic portion c20 is unstable at the turning-on time of the power supply, no trouble occurs in the generation operation of the power-supply monitor signal POW.

The D flip-flops Z221*a* and Z221*b* that form the latch portion Z221 are kept in a reset state in accordance with the power-supply monitor signal POW from the time the power-supply voltage VDD is applied to the power-supply circuit c10 to the time the predetermined period T elapses, thereby outputting the low-level first latch output signals FF1 and second latch output signal FF2. Accordingly, during the time from at least the turning-on time of the power-supply voltage VDD for the power-supply circuit c10 to the elapse of the predetermined period T, the power on reset signal R2 is always kept at the low level, so that it becomes possible to forcibly bring the output transistors M1 and M2 to the off state based on the power on reset signal R2; and it becomes possible to nip occurrence of an unintentional overcurrent in the bud.

On the other hand, when the predetermined period T elapses after the power-supply voltage VDD is applied to the power-supply circuit c10, the power-supply monitor signal POW rises from the low level to the high level; and the D flip-flops Z221*a* and Z221*b* that from the latch portion Z221 are released from the reset state.

Thereafter, when the logic portion c20 (see FIG. 16) starts to operate; the enable signal EN is raised to the high level (enable logic); and the input of the clock signal CLK is started, the D flip-flop Z221*a* fetches the enable signal EN at every pulse of the clock signal CLK to output the first latch output signal FF1; the D flip-flop Z221*b* fetches the first latch output signal FF1 at every pulse of the clock signal CLK to output the second latch output signal FF2. And, at a time (that is, a time two pulses are input into the clock signal CLK) the enable signal EN and the second latch output signal FF2 all go to the high level, the power on reset signal R2 goes from the low level to the high level; thereafter, the reset operation of the power-supply circuit c10 depends on the external reset signal R0.

Here, the power on reset signal R2 is a logical product signal of the enable signal EN and the second latch output signal FF2, so that whatever state the latch portion Z221 (D flip-flops Z221*a* and Z221*b*) is in, the power on reset signal R2 does not go to the high level (reset release logic) as long as the enable signal EN does not go to the high level (enable logic). In other words, when the power on reset signal R2 is at the high level (reset release logic), the enable signal EN is invariably at the high level (enable logic); and it is a state in which it is possible to properly perform output feedback control by means of the first feedback control circuit X and the second feedback control circuit Y, so that an unintentional overcurrent does not occur in the output transistors M1 and M2.

Figure 25:
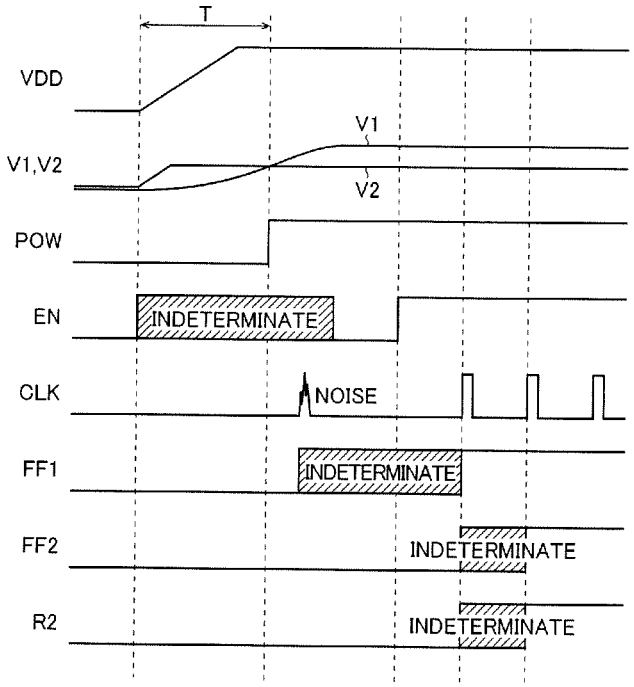
FIG. 25 is a timing chart for describing a meaning of multistage flip-flops.

FIG. 25 is a timing chart for describing a meaning of the multistage D flip-flops that form the latch portion Z221; and like the above FIG. 24, in order from the top, represents: the power-supply voltage VDD; the first node voltage V1; the second node voltage V2; the power-supply monitor signal POW; the enable signal EN; the clock signal CLK; the first latch output signal FF1; the second latch output signal FF2; and the power on reset signal R2.

In the above FIG. 24, the way is represented, in which during the time from the turning-on time of the power supply for the power-supply circuit c10 to the elapse of the predetermined period T, the logic portion c20 completes the startup and the indeterminate logic state of the enable signal EN is eliminated; however, depending on a startup sequence (a case where the logic power-supply voltage VDDL is generated from the power-supply voltage VDD and the like) of the liquid crystal drive apparatus c1, even if the predetermined period T elapses from the power-supply circuit c10 is turned on, there is still a possibility that the logic portion c20 does not complete the startup and the indeterminate logic state of the enable signal EN continues.

In such a state, in a case where pulse noise appears in the clock signal CLK, the D flip-flop Z221*a* fetches the enable signal EN that is in the indeterminate logic state to output the first latch output signal FF1. Because of this, in a case where the latch portion Z221 is formed of the D flip-flop Z221*a* only, the enable signal EN and the first latch output signal FF1 which are all in the indeterminate logic state are input into the AND calculator Z222. At this time, in a case where the enable signal EN and the first latch output signal FF1 which are all in the indeterminate logic state are all at the high level, the power on reset signal R2 goes to the high level (reset release logic), so that it becomes impossible to forcibly bring the output transistors Ma and M2 to the off state based on the power on reset signal R2.

In contrast, according to the power on reset portion Z2 in the present structural example shown in FIG. 23, the latch portion Z221 has a two-stage structure of the D flip-flop Z221*a* and the D flip-flop Z221*b*, so that as long as two pulse noises are not input into the clock signal CLK, the enable signal EN in the indeterminate logic state is not output as the second latch output signal FF2; and it becomes possible to prevent malfunction at the turning-on time of the power supply.

Here, when the logic portion c20 completes the startup and the input of the clock signal CLK into the power on reset portion Z2 is started, the first latch output signal FF1 in the indeterminate logic state is fetched into the D flip-flop Z221*b*; the second latch output signal Z221*b* is output; and the power on reset signal R2 goes to an indeterminate logic state. However, at this time point, the logic portion c20 completes the startup and there is a state in which it is possible to properly perform the output feedback control by means of the first feedback control circuit X and the second feedback control circuit Y, so that a special problem does not occur whichever one of the high level and the low level the power on reset signal R2 has.

Besides, in the latch portion Z221, if three-stage or more than three-stage D flip-flops are connected in a tandem manner, it is possible to further raise the resistance to noise. However, it is necessary to keep in mind that the reset release of the power on reset signal R2 is further delayed and the circuit scale becomes large.

Figure 26:
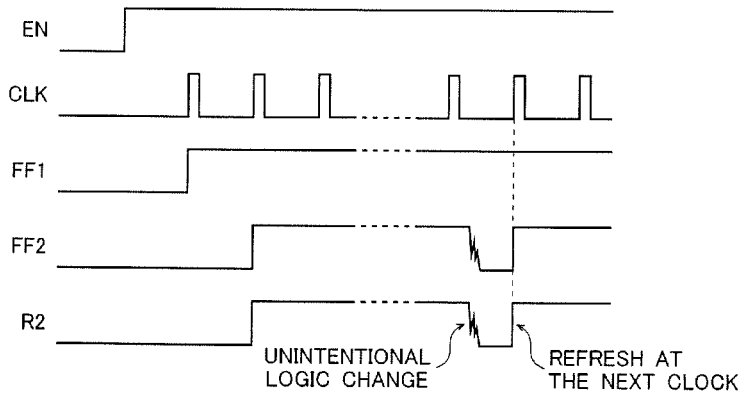
FIG. 26 is a timing chart for describing a meaning of a flip-flop update process.
Figure 27:
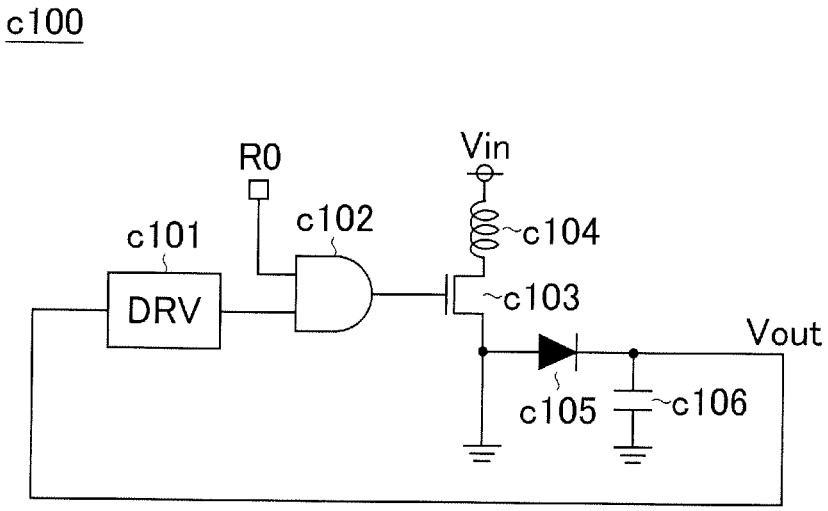
FIG. 27 is a circuit block diagram showing a conventional example of a power-supply circuit.

Besides, in the power on reset portion Z2 in the present structural example, the clock signal CLK is continuously input into the latch portion Z221 during the time the power-supply circuit 10 operates. FIG. 26 is a timing chart for describing a meaning of continuing to update the data stored in the flip-flops that form the latch portion Z221 by means of the clock signal CLK; and, in order from the top, represents: the enable signal EN; the clock signal CLK; the first latch output signal FF1; the second latch output signal FF2; and the power on reset signal R2.

As shown in the figure, during the time the power-supply circuit c10 operates, by continuously inputting the clock signal CLK into the latch portion Z221, it is possible to refresh the first latch output signal FF1 and the second latch output signal FF2 with no delay at a time the next pulse is input into the latch portion Z221, so that an unintentional logic change is not fixed as it is.

Here, in the above embodiment, the structure is described as an example, in which the third technical feature is applied to the power-supply circuit c10 that is incorporated in the liquid crystal drive apparatus c1; however, the application of the third technical feature is not limited to this, and it is possible to widely apply the third technical feature to power-supply circuits that are used for other applications.

Here, the structure having the third technical feature is able to be modified in various ways without departing from the spirit besides the above embodiment. In other words, it should be considered that the above embodiment is an example in all respects and is not limiting; the technical scope of the present invention is not indicated by the above description of the embodiment but by the claims, and all modifications within the scope of the claims and the meaning equivalent to the claims are covered.

For example, in the above embodiment, the structure is described as an example, in which the output type of the power-supply circuit c10 is the positive step-up type and the negative step-up type; however, the third technical feature is not limited to this: a structure may be employed, in which only one of the positive step-up voltage VSP and the negative step-up voltage VSN is output; or, a step-down output type and a step-up/-down output type may be employed.

(Fourth Technical Feature)

The fourth technical feature described hereinafter relates to a liquid crystal drive apparatus (more particularly, to a common voltage generation circuit that supplies a common voltage to a liquid crystal display panel).

Here, with reference to the above figures, the fourth technical feature relates to the source driver circuit xA3 in FIG.

28; more specifically, the fourth technical feature relates to the common voltage generation portion xB15 in FIG. 29 and its peripheral circuits.

Figure 32:
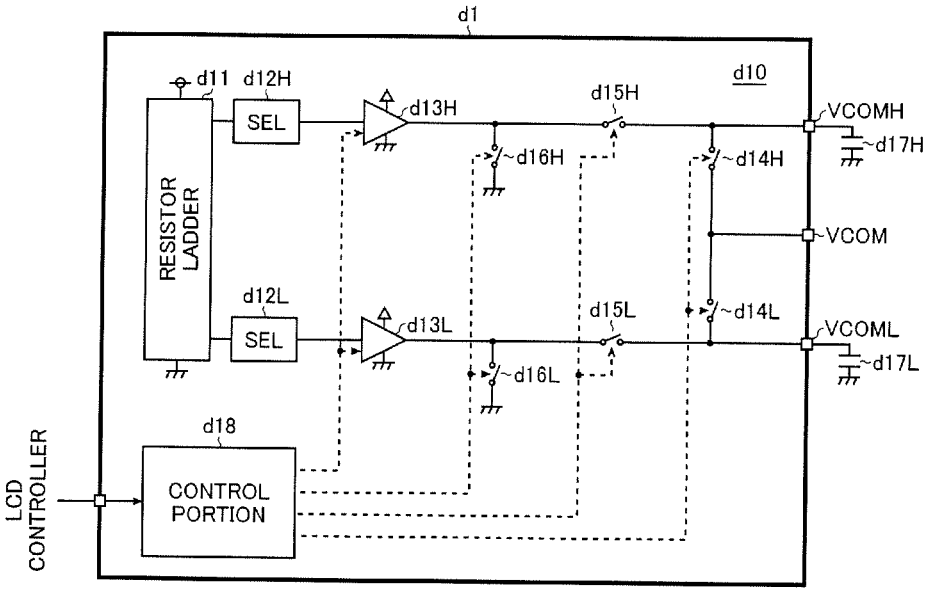
FIG. 32 is a circuit block diagram showing a structural example of a liquid crystal display apparatus having a fourth technical feature.

FIG. 32 is a circuit block diagram showing a structural example of a liquid crystal drive apparatus having the fourth technical feature. A liquid crystal drive apparatus d1 in the present structural example has a common voltage generation circuit d10 that supplies a common voltage VCOM to a not-shown liquid crystal display panel. The common voltage generation circuit d10 has a structure (so-called AC drive type) in which in driving the liquid crystal display panel, so as to perform polarity inversion control of the common voltage VCOM that is supplied in common to all liquid crystal elements which form the liquid crystal display panel, a voltage level of the common voltage VCOM is pulse-driven between a first voltage VCOMH and a second voltage VCOML (where VCOMH>VCOML); and has: a resistor ladder d11; selectors d12H and d12L; amplifiers d13H and d13L; switches d14H and d14L; switches d15H and d15L; switches d16H and d16L; output capacitors d17H and d17L: and a control portion d18. Here, the other circuit blocks contained in the liquid crystal drive apparatus d1 are the same as in the above FIG. 29; accordingly, double description is skipped.

The resistor ladder d11 generates a plurality of divided voltages by dividing the predetermined reference voltage (Vref) by means of a resistor.

The selectors d12H and d12L each select one from the plurality of divided voltages that are generated by the resistor ladder d11. Here, it is supposed that the divided voltage selected by the selector d12H is higher than the divided voltage selected by the selector d12L.

The amplifiers d13H and d13L each amplify the divided voltages input from the selectors d12H and d12L, respectively to generate the first voltage VCOMH and the second voltage VCOML.

A first terminal of the switch d14H is connected to an output terminal of the common voltage VCOM. A second terminal of the switch d14H is connected to an output terminal of the amplifier d13H via the switch d15H and connected to a ground terminal via the output capacitor d17H. A first terminal of the switch d14L is connected to an output terminal of the common voltage VCOM. A second terminal of the switch d14L is connected to an output terminal of the amplifier d13L via the switch d15L and connected to the ground terminal via the output capacitor d17L. First terminals of the switches d16H and d16L are connected to output terminals of the amplifiers d13H and d13L, respectively. Second terminals of the switches d16H and d16L are all connected to the ground terminal.

The control portion d18, in accordance with an instruction input from an LCD controller (main portion that comprehensively controls a liquid crystal display apparatus), performs on/off control of the amplifiers d13H and d13L; switches d14H and d14L; switches d15H and d15L; and switches d16H and d16L.

FIG. 33 is a table for describing a generation operation of the common voltage VCOM.

In a case where the first common voltage VCOMH is output as the common voltage VCOM (see item (1)), the amplifiers d13H and d13L are all turned on. Besides, the switches d14*h*, d15H and d15L are all turned on and the other switches d16H, d14L and d16L are all turned off. According to such on/off control, as the common voltage VCOM, the first voltage VCOMH is output from the amplifier d13H via the switches d15H and d14H. At this time, electric charges are accumulated into the output capacitor d17H. Here, even if the amplifier d13L and the switch d15L are all turned off, the operation is not influenced.

In a case where the first common voltage VCOMH which is output as the common voltage VCOM is held (see item (2)), the amplifiers d13H and d13L are all turned off. Besides, the switches d14H, d16H and d16L are all turned on and the other switches d15H, d14L and d15L are all turned off. According to such on/off control, the common voltage VCOM is held at the first voltage VCOMH by the electric charges accumulated in the output capacitor d17H. Here, even if the switches d16H and d16L are all turned off, the operation is not influenced.

In a case where the second common voltage VCOML is output as the common voltage VCOM (see item (3)), the amplifiers d13H and d13L are all turned on. Besides, the switches d15H, d14L and d15L are all turned on and the other switches d14H, d16H and d16L are all turned off. According to such on/off control, as the common voltage VCOM, the second voltage VCOML is output from the amplifier d13L via the switches d15L and d14L. At this time, electric charges are accumulated into the output capacitor d17L. Here, even if the amplifier d13H and the switch d15H are all turned off, the operation is not influenced.

In a case where the second common voltage VCOML which is output as the common voltage VCOM is held (see item (4)), the amplifiers d13H and d13L are all turned off. Besides, the switches d16H, d14L and d16L are all turned on and the other switches d14H, d15H and d15L are all turned off. According to such on/off control, the common voltage VCOM is held at the second voltage VCOML by the electric charges accumulated in the output capacitor d17L. Here, even if the switches d16H and d16L are all turned off, the operation is not influenced.

In a case where the liquid crystal drive apparatus d1 is shut down (see item (5)), the amplifiers d13H and d13L are all turned off. Besides, all the switches d14H to d16H and d14L to d16L are turned on. According to such on/off control, the electric charges accumulated in the output capacitors d17H and d17L are discharged to the ground terminal via the switches d16H and d17H.

Figure 34:
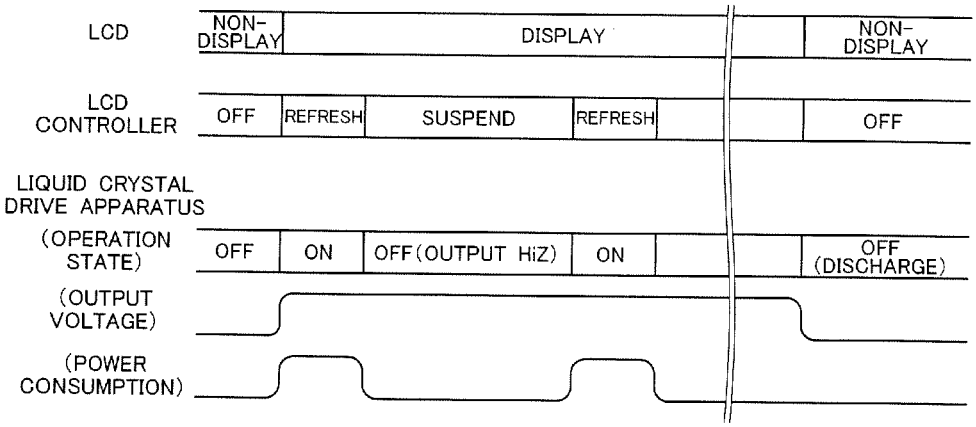
FIG. 34 is a timing chart for describing a generation operation of the common voltage VCOM.

FIG. 34 is a timing chart for describing the generation operation of the common voltage VCOM; and, in order from the top, schematically represents: an operation state of the liquid crystal display panel; an operation state of the LCD controller; an operation state of the liquid crystal drive apparatus d1; an output voltage (common voltage); and power consumption. Here, below, a case is described as an example, in which a static image is continuously displayed on the liquid crystal display panel.

In changing the liquid crystal display panel from a non-display state to a display state, first, the liquid crystal drive apparatus d1 is started up; and the output of the common voltage VCOM using the amplifiers d13H or d13L is performed (see item (1) or item (3) in FIG. 33). At this time, also an image signal (source signal) corresponding to the static image to be displayed is supplied to the liquid crystal display panel.

On the other hand, if an instruction for shifting to a suspended state is input from the LCD controller with the display state of the liquid crystal display panel kept, the liquid crystal drive apparatus d1 turns off the switches d15H or d15L to bring the amplifier d13H or d13L to a high-impedance state, thereby holding the electric charges in the output capacitor d17H or d17L and basically turning off the generation operation of the common voltage VOM (see item (2) or item (4) in FIG. 33). According to such operation, it is possible to stop the operation of the common voltage generation circuit d10 with the display state of the liquid crystal display panel kept, so that it becomes possible to achieve dramatic reduction in the power consumption.

Here, in a case where the liquid crystal display panel is provided with a memory that holds the image signal (source signal), it is possible to completely shut down not only the common voltage generation circuit d10 but also the source driver portion, so that it becomes possible to achieve further reduction in the power consumption.

Thereafter, to keep the display state of the liquid crystal display panel, before the electric charges accumulated in the output capacitor d17H or d17L discharge naturally, the liquid crystal drive apparatus d1 is restarted after a suitable interval; and refresh operation (recharge operation) of the common voltage VCOM is performed by means of the amplifier d13H or d13L (see item (1) or item (3) in FIG. 33).

On the other hand, in changing the liquid crystal display panel from the display state to the non-display state, by turning on the switches d16H and d16L, the electric charges accumulated in the output capacitors d17H and d17L are discharged to the ground terminal. According to such operation, without leaving an unnecessary image on the liquid crystal display panel, it becomes possible to change the liquid crystal display panel to the non-display state.

Here, in FIG. 32, as a means to achieve the above operation, the structure is described as an example, in which the switches d15H, d15L, and switches d16H, d16L are disposed; however, the fourth technical feature is not limited to this: the output stages of the amplifiers d13H and d13L may be provided with the same functions as these switches (i.e., the function to achieve the high impedance and the function to discharge the output capacitor).

(Fifth Technical Feature)

The fifth technical feature described hereinafter relates to a liquid crystal drive apparatus (more particularly, to a common voltage generation circuit that supplies a common voltage to a liquid crystal display panel).

Here, with reference to the above figures, the fifth technical feature relates to the source driver circuit xA3 in FIG. 28; more specifically, the fifth technical feature relates to the common voltage generation portion xB15 in FIG. 29 and its peripheral circuits.

Figure 35:
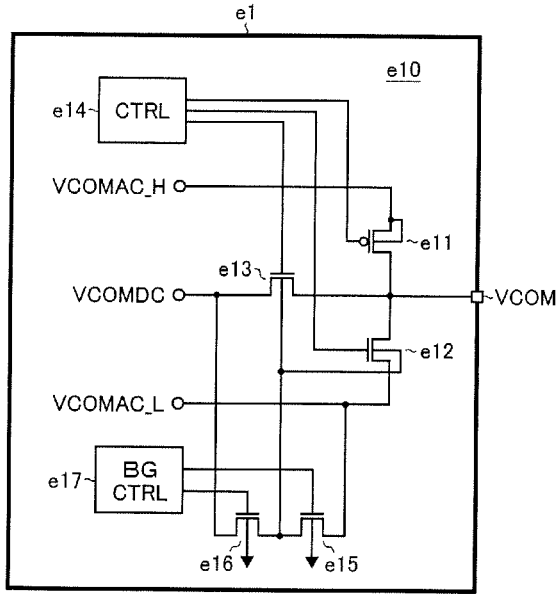
FIG. 35 is a circuit block diagram showing a structural example of a liquid crystal drive apparatus having a fifth technical feature.
Figure 36A:
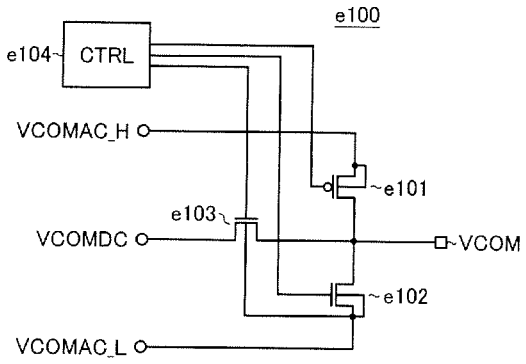
FIG. 36A is a circuit block diagram showing a first conventional example of a common voltage generation circuit.
Figure 36B:
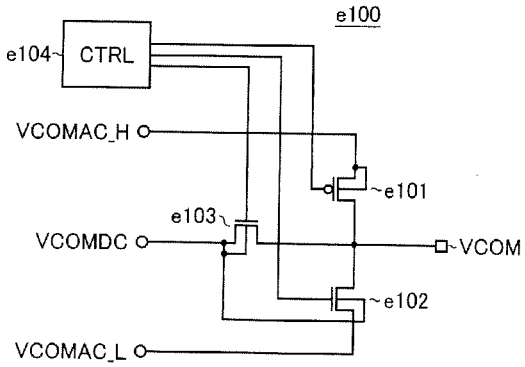
FIG. 36B is a circuit block diagram showing a second conventional example of a common voltage generation circuit.

FIG. 35 is a circuit block diagram showing a structural example of a liquid crystal drive apparatus having the fifth technical feature. A liquid crystal drive apparatus e1 in the present structural example has a common voltage generation circuit e10 that supplies the common voltage VCOM to a not-shown liquid crystal display panel. In driving the liquid crystal display panel, so as to allow an arbitrary changeover between a structure (so-called AC drive type) which performs the polarity inversion control of the common voltage VCOM that is supplied in common to all liquid crystal elements which form the liquid crystal display panel and a structure (so-called DC drive type) which keeps the common voltage VCOM at a fixed value, the common voltage generation circuit e10 has: a P-channel type MOS (Metal Oxide Semiconductor) field effect transistor e11; N-channel type MOS field effect transistors e12 and e13; a control portion e14; besides, has: N-channel type MOS field effect transistors e15 and e16 as back gate control means for the transistors e12 and e13; and a back gate control portion e17. Besides, the other circuit blocks contained in the liquid crystal drive apparatus e1 are the same as in the above FIG. 29; accordingly, double description is skipped.

A source and a back gate of the transistor e11 are connected to the application terminal of the first voltage VCOMAC_H (e.g., +5 V). A drain of the transistor e11 is connected to the output terminal of the common voltage VCOM. A gate of the transistor e11 is connected to the control portion e14. Here, the transistor e11 corresponds to the switch d14H in FIG. 32.

A source of the transistor e12 is connected to the application terminal of the second voltage VCOMAC_L (e.g., −0.3 to +1.7 V) that is lower than the first voltage VCOMAC_H. A drain of the transistor e12 is connected to the output terminal of the common voltage VCOM. A gate of the transistor e12 is connected to the control portion e14. Here, the transistor e12 corresponds to the switch d14L in FIG. 32.

A source of the transistor e13 is connected to the application terminal of the third voltage VCOMDC (e.g., 0 V) that is lower than first voltage VCOMAC_H. A drain of the transistor e13 is connected to the output terminal of the common voltage VCOM. A gate of the transistor e13 is connected to the control portion e14.

The control portion e14 performs on/off control of the transistors e11 to e13. More specifically, the control portion e14, in the AC drive of the common voltage VCOM, on/off-drives the transistors e11 and e12 in a complementary manner (exclusively) to turn off the transistor e13. On the other hand, the control portion e14, in the DC drive of the common voltage VCOM, turns off all of the transistors e11 and e12 and turns on the transistor e13.

The transistor e15 is connected between each of the back gates of the transistors e12, e13 and the application terminal of the second voltage VCOMAC_L. A gate of the transistor e15 is connected to the back gate control portion e17. A back gate of the transistor e15 is connected to the application terminal of the fourth voltage VEE (eg., −3.5 to −5 V) that is further lower than the second voltage VCOMAC_L and the third voltage VCOMDC.

The transistor e16 is connected between each of the back gates of the transistors e12, e13 and the application terminal of the third voltage VCOMDC. A gate of the transistor e16 is connected to the back gate control portion e17. A back gate of the transistor e16 is connected to the application terminal of the fourth voltage VEE.

The back gate control portion e17 performs the on/off control of the transistors e15 and e16 in accordance with a height relationship between the second voltage VCOMAC_L and the third voltage VCOMDC. More specifically, the back gate control portion e17 turns on the transistor e15 and turns off the transistor e16 when the second voltage VCOMAC_L is lower than the third voltage VCOMDC. According to such switching control, the back gates of the transistors e12 and e13 are all connected to the application terminal of the second voltage VCOMAC_L. On the other hand, the back gate control portion e17 turns off the transistor e15 and turns on the transistor e16 when the second voltage VCOMAC_L is higher than the third voltage VCOMDC. According to such switching control, the back gates of the transistors e12 and e13 are all connected to the application terminal of the third voltage VCOMDC.

As described above, according to the structure in which in accordance with the respective voltage setting of the second voltage VCOMAC_L and the third voltage VCOMDC, the back gate control portion e17 determines a potential relationship between them; and in accordance with the determination result, connection points of the transistors e12 and e13 are automatically controlled, in unifying the AC drive type and the DC drive type of the common voltage VCOM, it becomes possible to freely, with no constraints, adjust the set voltages of the first voltage VCOMAC_H, the second voltage VCOMAC_L and the third voltage VCOMDC; and it becomes possible to increase flexibility of the liquid crystal drive apparatus e1.

Beside, it is sufficient if the transistors e12 and e13 have an element breakdown voltage (a medium breakdown voltage of about 6 V) that is able to endure a potential difference (3.3 to 5.3 V as in the above example) between the first voltage VCOMAC_H and the lower voltage of the second voltage VCOMAC_L and the third voltage VCOMDC, so that it is not necessary to enlarge the element sizes of the transistors e12 and e13.

On the other hand, the transistors e15 and e16 need to have an element breakdown voltage (a high breakdown voltage of about 12 V) that is able to endure a potential difference (8.5 to 10 V as in the above example) between the first voltage VCOMAC_H and the fourth voltage VEE; however, unlike the transistors e11 to e13 that need a very large electric-current capability, it is possible to considerably lower the electric-current capabilities of the transistors e15 and e16, so that it is not necessary to enlarge the element sizes of the transistors e15 and e16 very much.

(Sixth Technical Feature)

The sixth technical feature described hereinafter relates to a liquid crystal drive apparatus (more particularly, to a common voltage generation circuit that supplies a common voltage to a liquid crystal display panel).

Here, with reference to the above figures, the sixth technical feature relates to the source driver circuit xA3 in FIG. 28; more specifically, the sixth technical feature relates to the common voltage generation portion xB15 in FIG. 29 and its peripheral circuits.

Figure 37:
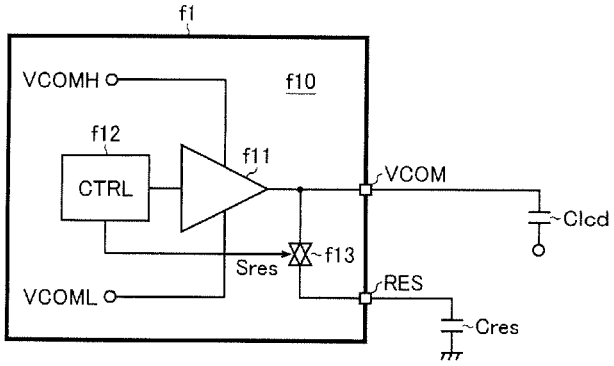
FIG. 37 is a circuit block diagram showing a structural example of a liquid crystal drive apparatus having a sixth technical feature.

FIG. 37 is a circuit block diagram showing a structural example of a liquid crystal drive apparatus having the sixth technical feature. A liquid crystal drive apparatus f1 in the present structural example has a common voltage generation circuit f10 that supplies the common voltage VCOM to a not-shown liquid crystal display panel. The common voltage generation circuit f10 has a structure (so-called AC drive type) in which in driving the liquid crystal display panel, so as to perform the polarity inversion control of the common voltage VCOM that is supplied in common to all liquid crystal elements which form the liquid crystal display panel, the voltage level of the common voltage VCOM is pulse-driven between the first voltage VCOMH and the second voltage VCOML (where VCOMH>VCOML); and has: an amplifier f11; a control portion f12; a switch f13; and a reserve capacitor Cres. Here, the other circuit blocks contained in the liquid crystal drive apparatus f1 are the same as in the above FIG. 29; accordingly, double description is skipped.

The amplifier f11, in accordance with an instruction from the control portion f12, pulse-drives the voltage level of the common voltage VCOM between the first voltage VCOMH and the second voltage VCOML.

The control portion f12 instructs the amplifier f11 which one of the first voltage VCOMH and the second voltage VCOML to output; and outputs an on/off control signal Sres to the switch f13.

The switch f13, based on the on/off control signal Sres input from the control portion f12, electrically connects/disconnects the output terminal of the common voltage VCOM and the connection terminal of the reserve capacitor Cres to and from each other. More specifically, the switch f13 is turned on when the on/off control signal Sres is at a high level, while turned off when the on/off control signal Sres is at a low level. Here, in FIG. 37, the reserve capacitor Cres is shown as an external discrete component; however, the reserve capacitor Cres may be incorporated in a semiconductor apparatus.

Figure 38:
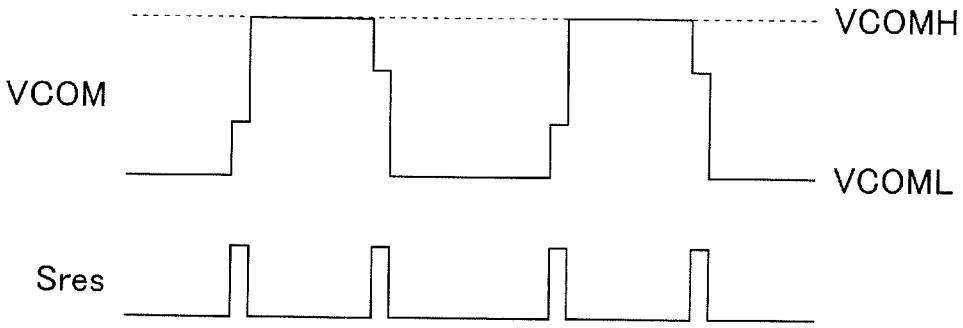
FIG. 38 is a timing chart for describing a generation operation of the common voltage VCOM.
Figure 39:
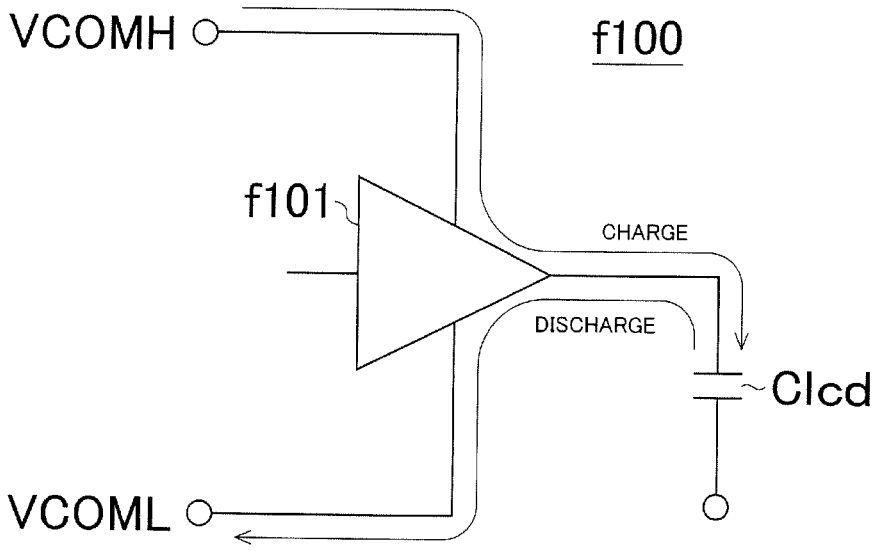
FIG. 39 is a circuit block diagram showing a conventional example of a common voltage generation circuit.
Figure 40:
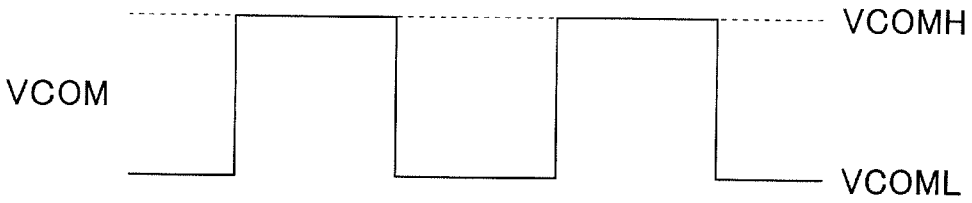
FIG. 40 is a waveform diagram showing a conventional behavior of the common voltage VCOM.

FIG. 38 is a timing chart for describing the generation operation of the common voltage VCOM; and represents the common voltage VCOM on the top stage and the on/off control signal Sres on the bottom stage.

In charging the element capacitor Clcd of the liquid crystal element by boosting the voltage from the second voltage VCOML to the first voltage VCOMH and in discharging the element capacitor Clcd of the liquid crystal element by lowering the voltage from the first voltage VCOMH to the second voltage VCOML, the control portion f12, before the charging and discharging, brings the on/off control signal Sres to the high level for a predetermined period to turn on the switch f13. According to such switching control, in the discharging time of the element capacitor Clcd, all of the electric charges accumulated in the element capacitor Clcd are not thrown out; and part of them are charged into the reserve capacitor Cres. On the other hand, in the charging time of the element capacitor Clcd, electric charges are not anew accumulated by means of the amplifier f11, but part of the electric charges accumulated in the reserve capacitor Cres are used to charge the element capacitor Clcd. However, in the first startup time electric charges are not accumulated in the reserve capacitor Cres, the element capacitor Clcd is charged by means of the capability of the amplifier f11 only.

For example, in a case where the element capacitor Clcd of the liquid crystal element and the reserve capacitor Cres have the same capacitance value, in discharging the element capacitor Clcd of the liquid crystal element, by keeping the switch f13 in the on state, about half of the electric charges accumulated in the element capacitor Clcd are temporarily saved in the reserve capacitor Cres; and the remaining electric charges are thrown out via the amplifier f11. Next, in the charging time of the element capacitor Clcd of the liquid crystal element, about half of the electric charges temporarily saved in the reserve capacitor Cres are reused to charge the element capacitor Clcd.

By repeating such operation, it is possible to temporarily save the discharged electric charges of the element capacitor Clcd that are conventionally thrown out and to reuse them for the next charging of the element capacitor Clcd, so that it becomes possible to reduce effective power consumption due to the charging and discharging of the element capacitor Clcd.

Here, in the above description, the common voltage generation circuit f10 is described as an example; however, the application of the sixth technical feature is not limited to this, and for example, also in generating the source voltage output to the liquid crystal element, it is possible to reduce effective power consumption due to the charging and discharging of the element capacitor Clcd by using the same structure as in the above description.

All of the plurality of technical features disclosed in the present specification are various fundamental technologies that are able to be built and used in liquid crystal drive apparatuses (liquid crystal driver IC); and are able to be preferably used in small-size liquid crystal display apparatuses that are used, for example, in mobile phones; digital cameras; PDAs (Personal Digital/Data Assistant); mobile game machines; car navigation; car audio and the like.

LIST OF REFERENCE SYMBOLS xA1 liquid crystal display panel (liquid crystal pixel)
xA2 multiplexer
xA3 source driver circuit
xA4 gate driver circuit
xA5 external DC/DC converter
xA6 MPU
xA7 image source
xB1 MPU interface xB2 command decoder
xB3 data register
xB4 partial display data RAM
xB5 data control portion
xB6 display data interface
xB7 image process portion
xB8 data latch portion
xB9 source driver circuit
xB10 OTPROM
xB11 control register
xB12 address counter (RAM controller)
xB13 timing generator
xB14 oscillator
xB15 common voltage generation portion
xB16 multiplexer timing generator
xB17 gate driver timing generator
xB18 external DC/DC timing generator
xB19 power-supply circuit for a liquid crystal display apparatus
xC1 (1) to xC1 (*n*) level shifter circuits
xC2 (1) to xC2 (*n*) digital/analog conversion circuits
xC3 (1) to xC3 (*n*) source amplification circuits
xC4 (1) to xC4 (*n*) path switches (for polarity inversion control)
xC5 (1) to xC5 (*n*) path switches (for 8-color display mode)
xC6 (1) to xC6 (*n*) output terminals
xC7 resistor ladder
xC8 to xC11 selectors
xC12 to xC15 amplifiers
xC16 first gradation voltage generation portion (positive polarity)
xC17 second gradation voltage generation portion (negative polarity)
xC18 to xC21 output capacitors
xD1, xD2 (*i*), xD2 (*j*) selectors
a1 liquid crystal drive apparatus (source driver)
a2 liquid crystal display panel (LCD panel)
a10 gradation voltage generation circuit
a20-1 to a20-*x* digital/analog converters (DAC)
a30-1 to a30-*x* buffers
100 resistor ladder
200 upper-limit voltage set circuit
201 SH register
202 VH1 generation portion
203 operational amplifier
204 feedback resistor portion
300 lower-limit voltage set circuit (voltage amplification circuit according to the present invention)
301 SL register
302 VL1 generation portion
303 operational amplifier
304 feedback resistor portion
305 selector control portion
306 selector
307 non-volatile memory (OTPROM and the like)
308 TL1 register
309 TL2 register
310 second selector
DP1 to DPx digital pixel signals (m bits)
AP1 to APx analog pixel signals
VG0 to VGn ($N=2^m-1$) gradation voltages
VH1 input voltage
VH2 output voltage (upper-limit voltage)
VH3 feedback voltage
VL1 input voltage
VL2 output voltage (lower-limit voltage)
VL3 feedback voltage
VL4 reference voltage
GND ground voltage (first reference voltage)
VR power-supply voltage (second reference voltage)
SH upper-limit voltage set value
SL lower-limit voltage set value
SS selector control signal
TL1 first trimming table (at a time VL4=GND)
TL2 second trimming table (at a time VL4=VR)
b1, b1' liquid crystal drive apparatuses (source divers)
b2 liquid crystal display panel
A1 ( ) digital/analog converter (positive polarity)
A2 ( ) source amplifier (positive polarity)
A3 ( ) P-channel type MOS field effect transistor (first switch)
A3' ( ) P-channel type MOS field effect transistor (fifth switch)
A4 ( ) N-channel type MOS field effect transistor (third switch)
A5 ( ), A5' ( ) body diodes
B1 ( ) digital/analog converter (negative polarity)
B2 ( ) source amplifier (negative polarity)
B3 ( ) N-channel type MOS field effect transistor (second switch)
B3' ( ) N-channel type MOS field effect transistor (sixth switch)
B4 ( ) P-channel type MOS field effect transistor (fourth switch)
B5 ( ), B5' ( ) body diodes
I ( ), IA ( ), IB ( ) input signals (digital pixel signals)
O ( ) output signal (analog pixel signal)
COM common voltage
11 P sub
12 N well
13*a*, 13*b* source regions (P type)
14 drain region (P type)
15*a*, 15*b* gates
16 contact region (N type)
21 P sub
23*a*, 23*b* source regions (N type)
24 drain region (N type)
25*a*, 25*b* gates
26 contact region (P type)
VDD positive power-supply voltage (first power-supply voltage)
VEE negative power-supply voltage (second power-supply voltage)
GND ground voltage (reference voltage)
T ( ) external terminal
Ton on period
Lx1, Lx2 between-regions distance
c1 liquid crystal drive apparatus
c2 liquid crystal display panel
c10 power-supply circuit (switching regulator)
c20 logic circuit
c30 source driver
c40 gate driver
c50 TFT controller
X first feedback control circuit (negative step-up system)
Y second feedback control circuit (positive step-up system)
Z reset circuit
X1, Y1 drive control portions
X2, Y2 jitter cancel portions
X3, Y3 overvoltage protection portions
X31, Y31 overvoltage detection circuits
X32, Y32 AND calculators
Z1 level shifter Z2 power on reset portion
Z3 internal reset signal generation portion (AND calculator)
Z4 NOT-AND calculator
Z5 AND calculator
M1, M2 output transistors
L1, L2 inductors
D1, D2 diodes
C1, C2 capacitors
X11 resistor
X12 capacitor
X13 operational amplifier
X14 comparator
X15 oscillator
X16 AND calculator
X21 D flip-flop
X22 inverter
X23, X24 NOT-OR calculators
X25 filter circuit
X311 comparator
X312 AND calculator
X313, X314 resistors
Z21 power supply monitor portion
Z211, Z212 resistors
Z213, Z214 N-channel type field effect transistors (depletion type)
Z215, Z216 capacitors
Z22 power on reset signal generation portion
Z221 latch portion
Z221*a*, Z221*b* D flip-flops
Z222 AND calculator (logic gate)
Z223 buffer
d1 liquid crystal drive apparatus
d10 common voltage generation circuit
d11 resistor ladder
d12H, d12L selectors
d13H, d13L amplifiers
d14H, d14L switches
d15H, d15L switches
d16H, d16L switches
d17H, d17L output capacitors
e1 liquid crystal drive apparatus
e10 common voltage generation circuit
e11 P-channel type MOS field effect transistor
e12, e13 N-channel type MOS field effect transistors
e14 control portion
e15, e16 N-channel type MOS field effect transistors
e17 back gate control portion
f1 liquid crystal drive apparatus
f10 common voltage generation circuit
f11 amplifier
f12 control portion
f13 switch
Clcd liquid crystal element
Cres reserve capacitor

The invention claimed is:

1. A voltage amplification circuit comprising:

an input-voltage generation portion that generates an input voltage based on a set value;

an operational amplifier that amplifies the input voltage to generate an output voltage in such a way that the input voltage and a feedback voltage match each other;

a feedback resistor portion which divides a voltage between the output voltage applied to one terminal of which and a reference voltage applied to the other terminal of which to generate the feedback voltage;

a selector control portion that generates a selector control signal based on the set value; and a selector that based on the selector control signal, selects one from a plurality of candidates as the reference voltage.

2. The voltage amplification circuit according to claim 1, wherein the selector selects a first reference voltage when the set value is a predetermined value or larger, and selects a second reference voltage higher than the first reference voltage when the set value is smaller than the predetermined value; and the input-voltage generation portion generates the input voltage in such a way that across a whole variable region of the set value, the output voltage linearly changes with respect to the set value.

3. The voltage amplification circuit according to claim 1, further comprising:

a second selector that based on the selector control signal, selects one from a plurality of candidates as a trimming table to be supplied to the feedback resistor portion;

wherein the feedback resistor portion finely adjusts a voltage-division ratio of itself based on the trimming table selected by the second selector.

4. The voltage amplification circuit according to claim 3, further comprising:

a non-volatile memory that stores a plurality of trimming tables which are the selection candidates in the second selector; and a plurality of registers that respectively store the plurality of trimming tables which are read from the non-volatile memory at a startup time of the voltage amplification circuit.

5. The voltage amplification circuit according to claim 3, wherein the second selector selects a first trimming table when the set value is the predetermined value or larger, and selects a second trimming table when the set value is smaller than the predetermined value.

6. A degradation voltage generation circuit comprising:

a resistor ladder which divides a voltage between an upper-limit voltage applied to one terminal of which and a lower-limit voltage applied to the other terminal of which to generate a plurality of gradation voltages; and the voltage amplification circuit according to claim 1 that outputs the output voltage as the lower-limit voltage.

7. A liquid crystal drive apparatus comprising:

a digital/analog converter that converts a digital pixel signal into an analog pixel signal and supplies it to a liquid crystal element; and the gradation voltage generation circuit according to claim 6 that supplies the plurality of gradation voltages to the digital/analog converter.

8. The liquid crystal drive apparatus according to claim 7, further comprising:

a power-supply circuit that generates an output voltage necessary for drive control of the liquid crystal element;

wherein the power-supply circuit includes: a feedback control circuit that generates a feedback control signal of an output transistor in such a way that a desired output voltage is generated from a second input voltage; and a reset circuit that forcibly keeps the output transistor in an off state from at least a turning-on time of a power supply to a time a predetermined time elapses.

9. A liquid crystal drive apparatus comprising:

a digital/analog converter that converts a digital pixel signal into an analog pixel signal and supplies it to a liquid crystal element;

a gradation voltage generation circuit that supplies a plurality of gradation voltages to the digital/analog converter, the gradation voltage generation circuit comprising:

a resistor ladder which divides a voltage between an upper-limit voltage applied to one terminal of which and a lower-limit voltage applied to the other terminal of which to generate the plurality of gradation voltages; and a voltage amplification circuit that outputs an output voltage as the lower-limit voltage, the voltage amplification circuit comprising:

an input-voltage generation portion that generates a first input voltage based on a set value;

an operational amplifier that amplifies the first input voltage to generate the output voltage in such a way that the first input voltage and a feedback voltage match each other;

a feedback resistor portion which divides a voltage between the output voltage applied to one terminal of which and a reference voltage applied to the other terminal of which to generate the feedback voltage;

a selector control portion that generates a selector control signal based on the set value; and a selector that based on the selector control signal, selects one from a plurality of candidates as the reference voltage;

a power-supply circuit that generates an output voltage necessary for drive control of the liquid crystal element, wherein the power-supply circuit includes a feedback control circuit that generates a feedback control signal of an output transistor in such a way that a particular output voltage is generated from a second input voltage; and a reset circuit that forcibly keeps the output transistor in an off state from at least a turning-on time of a power supply to a time a predetermined time elapses, wherein the reset circuit includes a power on reset portion that generates a power on reset signal that has reset logic from at least the turning-on time of the power supply to the time the predetermined time elapses; and wherein when the power on reset signal has the reset logic, on/off control of the output transistor in accordance with the feedback control signal is prohibited to forcibly bring the output transistor to an off state.

10. The liquid crystal drive apparatus according to claim 9, wherein the reset circuit includes an internal reset signal generation portion that has the reset logic when at least one of the power on reset signal and an external reset signal has the reset logic, and has reset release logic only when both of the power on reset signal and the external reset signal have the reset release logic;

prohibits the on/off control of the output transistor in accordance with the feedback control signal to forcibly bring the output transistor to the off state when the internal reset signal has the reset logic; and permits the on/off control of the output transistor in accordance with the feedback control signal when the internal reset signal has the reset release logic.

11. The liquid crystal drive apparatus according to claim 9, wherein the power on reset portion includes:

a power-supply monitor portion that generates a power-supply monitor signal which indicates whether the predetermined time elapses from the turning-on time of the power supply; and a power on reset signal generation portion that keeps the power on reset signal in the reset logic in accordance with the power-supply monitor signal before the predetermined time elapses; and controls the reset release of the power on reset signal in accordance with an enable signal for controlling operation of the feedback control circuit after the predetermined time elapses.

12. The liquid crystal drive apparatus according to claim 11, wherein the power on reset signal generation portion includes:

a latch portion that fetches the enable signal as a latch output signal at every pulse of a clock signal, and resets the latch output signal to disable logic in accordance with the power-supply monitor signal before the predetermined time elapses; and a logic gate that has the reset logic when at least one of the enable signal and the latch output signal has the disable logic, and has the reset release logic only when both of the enable signal and the latch output signal have enable logic.

13. The liquid crystal drive apparatus according to claim 12, wherein the latch portion includes a plurality of flip-flops that are connected to each other in a tandem manner.

14. The liquid crystal drive apparatus according to claim 12, wherein the clock signal is continuously input into the latch portion during a time the power-supply circuit operates.

15. The liquid crystal drive apparatus according to claim 8, wherein the reset circuit is shared with a plurality of the feedback control circuits.

16. The liquid crystal drive apparatus according to claim 7, further comprising:

an amplifier that is kept in a startup state during a first period to generates an output voltage for the liquid crystal element, and kept in an output high-impedance state during a second period; and a capacitor that holds the output voltage that is generated during the first period.

17. The liquid crystal drive apparatus according to claim 7, further comprising a common voltage generation circuit;

the common voltage generation circuit includes:

a P-channel type field effect transistor that is connected between an application terminal of a first voltage and an output terminal of a common voltage;

a first N-channel type field effect transistor that is connected between an application terminal of a second voltage lower than the first voltage and the output terminal of the common voltage;

a second N-channel type field effect transistor that is connected between an application terminal of a third voltage lower than the first voltage and the output terminal of the common voltage;

a selector that selects one of the application terminal of the second voltage and the application terminal of the third voltage as a connection point for respective back gates of the first and second N-channel type field effect transistors; and a back gate control portion that controls the switch in accordance with a potential relationship between the second voltage and the third voltage.

18. The liquid crystal drive apparatus according to claim 7, further comprising:

a reserve capacitor that in discharging an element capacity of a liquid crystal element, reserves part of electric charges;

wherein in charging the element capacitor of the liquid crystal element, part of the electric charges reserved in the reserve capacitor are reused to charge the element capacitor.

19. A liquid crystal display apparatus comprising:

the liquid crystal drive apparatus according to claim 7; and a liquid crystal display panel.

* * * * *